US007550245B2

(12) United States Patent
Inoue et al.

(10) Patent No.: US 7,550,245 B2
(45) Date of Patent: Jun. 23, 2009

(54) TONER AND PRODUCTION METHOD OF THE SAME, AND IMAGE FORMING METHOD

(75) Inventors: Ryota Inoue, Numazu (JP); Shigeru Emoto, Numazu (JP); Yohichiroh Watanabe, Fuji (JP); Naohiro Watanabe, Sunto-gun (JP); Masahide Yamada, Numazu (JP); Akinori Saitoh, Numazu (JP); Masahiro Ohki, Numazu (JP); Tsunemi Sugiyama, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 600 days.

(21) Appl. No.: 11/313,817

(22) Filed: Dec. 22, 2005

(65) Prior Publication Data

US 2006/0160011 A1 Jul. 20, 2006

(30) Foreign Application Priority Data

Dec. 28, 2004 (JP) ..... 2004-381368
Dec. 28, 2004 (JP) ..... 2004-381408
Mar. 4, 2005 (JP) ..... 2005-060995

(51) Int. Cl.
*G03G 5/00* (2006.01)

(52) U.S. Cl. ..... 430/137.17; 430/109.4

(58) Field of Classification Search ..... 430/137.17, 430/109.4

See application file for complete search history.

(56) References Cited

U.S. PATENT DOCUMENTS 2,297,691 A 10/1942 Carlson
6,787,280 B2 9/2004 Yamashita et al.
6,846,604 B2 1/2005 Emoto et al.
6,849,369 B2 2/2005 Yagi et al.
6,852,462 B2 2/2005 Emoto et al.
6,936,390 B2 8/2005 Nanya et al.

(Continued)

FOREIGN PATENT DOCUMENTS

EP 1 347 313 A1 9/2003

(Continued)

OTHER PUBLICATIONS

U.S. Appl. No. 11/611,165, filed Dec. 15, 2006, Sugimoto, et al.

(Continued)

*Primary Examiner*—Mark A Chapman
(74) *Attorney, Agent, or Firm*—Oblon, Spivak, McClelland, Maier & Neustadt, P.C.

(57) ABSTRACT

The object of the present invention is to provide a toner having a uniform composition of toner materials among toner particles, excelling in charge stability, enabling high-quality images without substantially causing fog and toner scattering, and having a small diameter and a narrow particle size distribution. The present invention also provides an effective production method of the toner, and an image forming method and the like using the toner. For this end, the present invention provides a method for producing a toner in which a dissolved and dispersed solution of toner materials is dispersed as dispersion particles in an aqueous medium containing no organic resin fine particles to prepare an oil droplet-in-water dispersion, and organic resin fine particles are added to the oil droplet-in-water dispersion to thereby granulate a toner in the presence of the organic resin fine particles.

29 Claims, 7 Drawing Sheets

U.S. PATENT DOCUMENTS

| | | | | |
|---|---|---|---|---|
| 2004/0053155 | A1* | 3/2004 | Emoto et al. | 430/137.15 |
| 2004/0131961 | A1 | 7/2004 | Watanabe et al. | |
| 2004/0142264 | A1 | 7/2004 | Tanaka et al. | |
| 2004/0157146 | A1 | 8/2004 | Tomita et al. | |
| 2004/0191656 | A1 | 9/2004 | Ishiyama et al. | |
| 2005/0003291 | A1 | 1/2005 | Takada et al. | |
| 2005/0026066 | A1 | 2/2005 | Tanaka et al. | |
| 2005/0031980 | A1 | 2/2005 | Inoue et al. | |
| 2005/0042534 | A1 | 2/2005 | Tanaka et al. | |
| 2005/0164112 | A1 | 7/2005 | Ohki et al. | |
| 2005/0164114 | A1 | 7/2005 | Yagi et al. | |

FOREIGN PATENT DOCUMENTS

| | | |
|---|---|---|
| JP | 4-184358 | 7/1992 |
| JP | 10-20552 | 1/1998 |
| JP | 10-147649 | 6/1998 |
| JP | 10-301332 | 11/1998 |
| JP | 11-7156 | 1/1999 |
| JP | 2000-250261 | 9/2000 |
| JP | 2002-296839 | 10/2002 |
| JP | 2003-122051 | 4/2003 |
| JP | 2003-140381 | 5/2003 |
| JP | 2003-173043 | 6/2003 |
| JP | 2003-280268 | 10/2003 |
| JP | 2003-302791 | 10/2003 |
| JP | 2004-206081 | 7/2004 |
| JP | 2004-226669 | 8/2004 |
| JP | 2004-295110 | 10/2004 |
| JP | 2004-302458 | 10/2004 |
| JP | 3640918 | 1/2005 |

OTHER PUBLICATIONS

U.S. Appl. No. 11/934,929, filed Nov. 21, 2007, Nakayama, et al.
U.S. Appl. No. 11/943,972, filed Nov. 21, 2007, Nakayama, et al.
U.S. Appl. No. 12/026,937, filed Feb. 6, 2008, Seshita, et al.
U.S. Appl. No. 11/685,872, filed Mar. 14, 2007, Uchinokura, et al.
U.S. Appl. No. 11/687,075, filed Mar. 16, 2007, Yamada, et al.
U.S. Appl. No. 11/687,372, filed Mar. 16, 2007, Yamada, et al.
U.S. Appl. No. 12/040,451, filed Feb. 29, 2008, Saitoh, et al.
U.S. Appl. No. 11/685,969, filed Mar. 14, 2007, Uchinokura, et al.
U.S. Appl. No. 12/042,041, filed Mar. 4, 2008, Yamada, et al.
U.S. Appl. No. 12/046,941, filed Mar. 12, 2008, Awamura, et al.
U.S. Appl. No. 12/046,011, filed Mar. 11, 2008, Nagatomo, et al.
U.S. Appl. No. 11/738,149, filed Apr. 20, 2007, Iwamoto, et al.
U.S. Appl. No. 11/755,484, filed May 30, 2007, Watanabe, et al.
U.S. Appl. No. 11/755,517, filed May 30, 2007, Iwamoto, et al.
U.S. Appl. No. 11/851,475, filed Sep. 7, 2007, Watanabe, et al.
U.S. Appl. No. 11/852,778, filed Sep. 10, 2007, Nagatomo, et al.
U.S. Appl. No. 11/855,806, filed Sep. 14, 2007, Awamura, et al.
U.S. Appl. No. 11/856,379, filed Sep. 17, 2007, Sawada, et al.
U.S. Appl. No. 11/857,791, filed Sep. 19, 2007, Kojima, et al.
U.S. Appl. No. 11/943,929, filed Nov. 21, 2007, Nakayama, et al.
U.S. Appl. No. 12/203,278, filed Sep. 3, 2008, Yamada, et al.
U.S. Appl. No. 12/209,583, filed Sep. 12, 2008, Seshita, et al.

* cited by examiner

FIG. 4A

Table of Viscosity and Refractive Index of Liquids

| Liquid Name | Refractive Index | Temperature (°C) Low | Viscosity (cP) ← | Temperature (°C) High | Viscosity (cP) ← |
|---|---|---|---|---|---|
| Acetaldehyde | 1.33 | 10 | 0.255 | 20 | 0.22 |
| Acetic Acid | 1.37 | 18 | 1.30 | 25 | 1.16 |
| Acetic Anhydride | 1.39 | 18 | 0.90 | 50 | 0.62 |
| Acetone | 1.36 | 20 | 0.326 | 25 | 0.316 |
| Acetonitrile | 1.35 | 15 | 0.375 | 25 | 0.345 |
| Acetonitrile | 1.35 | 20 | 0.26 | 25 | 0.345 |
| Acetophenone | 1.53 | 20 | 1.8 | 25 | 1.62 |
| Allyl Alcohol | 1.41 | 20 | 1.363 | 30 | 1.07 |
| n-Amyl Alcohol | 1.41 | 15 | 4.65 | 30 | 2.99 |
| Aniline | 1.59 | 20 | 4.40 | 50 | 1.85 |
| Anisole | 1.52 | 20 | 1.32 | | |
| Benzaldehyde | 1.55 | 20 | 1.6 | 25 | 1.39 |
| Benzene | 1.50 | 20 | 0.652 | 50 | 0.436 |
| Benzyl Alcohol | 1.54 | 20 | 5.8 | 50 | 2.57 |
| Benzylamine | 1.54 | 20 | 1.59 | | |
| m-Bromoaniline | 1.63 | 20 | 6.81 | | |
| Bromoform | 1.60 | 15 | 2.15 | 25 | 1.89 |
| n-Butyl Alcohol | 1.40 | 20 | 2.948 | 50 | 1.42 |
| Carbon Tetrachloride | 1.46 | 20 | 0.969 | 50 | 0.654 |
| Castor Oil | 1.47 | 25 | 600 | | |
| Chlorobenzene | 1.52 | 20 | 0.799 | 50 | 0.58 |
| Chloroform | 1.45 | 20 | 0.580 | 25 | 0.542 |
| Cyclohexane | 1.43 | 17 | 1.02 | 20 | 0.696 |
| Cyclohexanone | 1.45 | | | | |
| Cyclohexanol | 1.47 | 20 | 68 | 50 | 11.8 |
| Cyclohexene | 1.45 | 20 | 0.696 | 50 | 0.456 |
| n-Decane | 1.41 | 20 | 0.92 | 50 | 0.615 |
| Diacetone alcohol | 1.42 | 25 | 2.79 | 50 | 1829 |
| Dimethylaniline | 1.56 | 20 | 1.41 | 50 | 0.9 |
| Dimethylformamide | 1.42 | 25 | 0.802 | | |
| Dimethyl Sulfoxide | 1.47 | 25 | 2.0 | | |
| Ether (Di-Ethyl) | 1.35 | 20 | 0.233 | 25 | 0.222 |
| Ethanol (100%) | 1.36 | 20 | 1.2 | 30 | 1.003 |
| Ethyl Acetate | 1.37 | 20 | 0.455 | 25 | 0.441 |
| EthylAlcohol (SeeEthanol | | | | | |
| Ethyl Benzene | 1.49 | 17 | 0.691 | 25 | 0.640 |
| Ethyl Bromide | 1.42 | 20 | .0402 | | |
| Ethylene Bromide | 1.54 | 20 | 1.721 | | |
| Ethylene Glycol (100%) | 1.46 | 20 | 19.9 | 30 | 12.2 |
| Ethylene Glycol (70%) | 1.42 | 20 | 7.11 | 30 | 5.04 |
| Ethylene Glycol (50%) | 1.39 | 20 | 4.2 | 30 | 3.11 |
| Ethylene Glycol (20%) | 1.36 | 20 | 1.835 | 30 | 1.494 |
| Ethylene Glycol (10%) | 1.34 | 20 | 0.812 | 30 | 0.699 |
| Formamide | 1.45 | 20 | 3.76 | 25 | 3.30 |
| Formic Acid | 1.37 | 20 | 1.80 | 50 | 1.03 |

FIG. 4 B

| Liquid Name | Refractive Index | Temperature (°C) Low | Viscosity (cP) ← | Temperature (°C) High | Viscosity (cP) ← |
|---|---|---|---|---|---|
| Freon (11 & 13) | 1.36 | 25 | 0.415 | | |
| Furfural | 1.53 | 20 | 1.63 | 25 | 1.49 |
| Glycerin(Glycetol) 100% | 1.47 | 20 | 1490 | 30 | 0.629 |
| Glycerin 40% (W/W) | 1.38 | 20 | 3.750 | 25 | 3.181 |
| Glycerin 30% (W/W) | 1.37 | | | | |
| Glycerin 20% (W/W) | 1.36 | 20 | 1.769 | 25 | 1.542 |
| Glycerin 10% W/W) | 1.35 | 20 | 1.311 | 25 | 1.153 |
| Glycerin 1% (W/W) | 1.33 | | | | |
| Heptane | 1.39 | 20 | 0.409 | 25 | 0.386 |
| Hexane | 1.38 | 20 | 0.326 | 25 | 0.294 |
| Hydroiodic Acid (N=0.1) | 1.34 | | | | |
| Isobutyl Alcohol | 1.40 | 15 | 4.703 | 20 | 3.900 |
| Isopar G | 1.42 | 20 | 1.490 | 40 | 1.120 |
| Isopar L | 1.63 | | | | |
| Isopar M | 1.44 | | | | |
| Isopentane | 1.36 | 20 | 0.223 | | |
| Isopropyl Alcohol | 1.38 | 15 | 2.860 | 30 | 1.770 |
| Kerosene | 1.45 | | | | |
| Methanol | 1.33 | 20 | 0.597 | 25 | 0.547 |
| Methylacetate | 1.36 | 20 | 0.381 | 50 | 0.286 |
| MethylAlcohol (See Methanol) | | | | | |
| Methyl Ethyl Ketone | 1.38 | 20 | 0.420 | 50 | 0.310 |
| Methyl Isobutyl Ketone | 1.40 | 20 | 0.579 | 50 | 0.542 |
| Methylene Chloride | 1.42 | 15 | 0.449 | 30 | 0.393 |
| Methyl Iodide | 1.53 | 20 | 0.500 | | |
| n,n-DimethylFormamide | 1.43 | 25 | 0.802 | | |
| Mineral Spirits | 1.42 | | | | |
| Nitrobenzene | 1.55 | 20 | 2.000 | 50 | 1.240 |
| Niromethane | 1.38 | 20 | 0.660 | 25 | 0.620 |
| o-Nitrotoluene | 1.55 | 20 | 2.370 | 40 | 1.630 |
| n-Nonane | 1.41 | 20 | 0.711 | 50 | 0.492 |
| Norpar 15 | 1.43 | | | | |
| Oil | | | | | |
| n-Octane | 1.40 | 20 | 0.542 | 50 | 0.389 |
| n-Pentane | 1.36 | 0 | 0.277 | 20 | 0.240 |
| Phenol | 1.54 | 50 | 3.400 | | |
| n-Propylacetate | 1.38 | 20 | 0.537 | 50 | 0.390 |
| Iso Propyl Acetate | 1.38 | 20 | 0.525 | | |
| n-Propyl Alcohol | 1.39 | 20 | 2.230 | 30 | 1.720 |
| Propyl Bromide | 1.43 | 20 | 0.524 | | |
| PropyleneGlycol (100%) | 1.43 | 20 | 56 | 40 | 18 |
| Propylene Glycol (30%) | 1.37 | 20 | 3.000 | 30 | 2.100 |
| Propylene Glycol (20%) | 1.36 | 20 | 2.180 | 30 | 1.590 |
| Propylene Glycol (10%) | 1.34 | 20 | 1.500 | 30 | 1.200 |
| Sedisperse | 1.42 | | | | |
| Silicone Oil | N/A | | | | |

FIG. 4C

| Liquid Name | Refractive Index | Temperature (℃) Low | Viscosity (cP) ← | Temperature (℃) High | Viscosity (cP) ← |
|---|---|---|---|---|---|
| Styrene(Vinyl Benzene) | 1.55 | 20 | 0.749 | 50 | 0.502 |
| Sulphuric Acid (conc.) | 1.83 | 20 | 0.254 | | |
| Tetradecane | 1.43 | 20 | 2.310 | 50 | 1.320 |
| Tetrahydrofuran | 1.40 | 20 | 0.575 | 30 | 0.525 |
| Toluene | 1.50 | 20 | 0.590 | 30 | 0.526 |
| o-Toluidine | 1.57 | 20 | 0.390 | | |
| Vinyl acetate | 1.39 | | | | |
| m-Toluidine | 1.57 | 20 | 0.81 | | |
| p-Toluidine | 1.55 | 20 | 0.80 | | |
| Trans-Cinnamadenhyde | 1.61 | | | | |
| Trichloroethane | 1.44 | 20 | 0.2 | | |
| Trichlorofluoroethane (Freon 113) | 1.36 | 20 | 0.72 | 24 | 0.42 |
| Vegtable Oil | 1.47 | | | | |
| Water | 1.33 | 20 | 1.002 | 30 | 0.797 |
| o-Xylene | 1.51 | 16 | 0.876 | 20 | 0.810 |
| m-Xylene | 1.50 | 15 | 0.650 | 20 | 0.620 |
| p-Xylene | 1.50 | 16 | 0.696 | 20 | 0.648 |

TONER AND PRODUCTION METHOD OF THE SAME, AND IMAGE FORMING METHOD

BACKGROUND OF THE INVENTION

FIELD OF THE INVENTION

The present invention relates to a toner suitably used for electrophotography, electrostatic recording, electrostatic printing, and the like. The present invention also relates to a method for effectively producing the toner. The present invention also relates to a developer, a toner container, a process cartridge, an image forming apparatus, and an image forming method each of which enables forming high-quality images by using the toner.

In image formation based on the electrophotography, an image is generally formed through a series of processes which comprise forming an electrostatic image on a photoconductor (electrostatic image bearing member), developing the electrostatic image using a developer to form a visible image (toner image), transferring the visible image onto a recording medium such as paper, and fixing the visible image on the recording medium to thereby form a fixed image (see U.S. Pat. No. 2,297,691).

For the developer, there have been known one-component developers singularly using a magnetic toner or a non-magnetic toner and a two-component developer comprising a toner and a carrier. Further, for the toner, typically, a toner produced by the following method is used in which a thermoplastic resin is fused and kneaded with a colorant or the like, and crushed into fine particles, and the fine particles are further classified by kneading and pulverization method. With a view to improving flowability and cleaning ability of toner, inorganic fine particles or/and organic fine particles may be added on surfaces of toner particles in accordance with the necessity.

However, a toner obtained by the kneading and pulverization method generally has a wide particle size distribution, which causes nonuniformity of frictional electrification of toner, and fog easily generates. In the interest of efficiency of productivity, there is a problem that a toner having a small volume average particle diameter of 2 μm to 8 μm is rarely obtained, and it is impossible to respond to demands for high-quality images.

Then, a toner which can be obtained by granulating toner particles in an aqueous phase has gotten the attention recently. The toner has a narrow particle size distribution, and it is easy to form toner particles in smaller sizes as well as capable of forming high-quality images and high-definition images, and the toner excels in anti-offset property as well as in low-temperature fixing property by means of high-dispersion of releasing agents such as waxes. In addition, the toner excels in transferring property because of excellent uniformity of charge, and it has excellent flowability, therefore, it is advantageous in terms of designing of developing units, for example, it allows easy designing of hoppers and downsizing of torque for making developing rollers rotate.

For the toner produced by granulating toner particles in the aqueous phase, toners are developed, which are produced by suspension polymerization method, emulsification polymerization aggregation method or the like, which will be hereinafter referred to as chemical toners.

In the suspension polymerization method, a monomer, a polymerization initiator, a colorant, a releasing agent, or the like are added to an aqueous phase containing a dispersion stabilizer while stirring the aqueous phase to form oil droplets, the temperature of the oil droplets is raised and subjected to a polymerization reaction to thereby obtain toner particles. According to the suspension polymerization, it is possible to form toner particles in smaller sizes, however, polyester resins and epoxy resins suitably used for color toners cannot be used, because primary components of binder resin are limited to vinyl polymers, which are capable of radical polymerization. In addition, there are problems that it is difficult to reduce the amount of VOC (volatile organic compounds containing unreacted monomers and the like), and a toner having a narrow particle size distribution is rarely obtained.

In the emulsification-polymerization and aggregation method, for example, toner particles are produced by agglomerating fine particles obtained by using a polyester resin as a binder resin to be emulsified and dispersed in an aqueous phase, and a dispersion prepared by dispersing a colorant, a releasing agent or the like in the aqueous phase to be thermally fused (see Japanese Patent Application Laid-Open (JP-A) Nos. 10-020552, and 11-007156). According to the toner production method, there is no loss in emulsification because of no generation of ultrafine particles, and it is possible to produce a toner having a sharp particle size distribution without performing particle classification, however, there is a limitation on selection of the binder resin to be used because the production processes need a heating process. In addition, the composition of the used materials is inhomogeneous among the obtained toner particles, because the toner particles are formed in a state where a colorant or the like are randomly fused on the toner particles, and there is a problem that it is impossible to form images in stable conditions over a long period of time because of the difference in surface properties among the toner particles.

In addition, a method is proposed in Japanese Patent Application Laid-Open (JP-A) No. 2003-140381, in which a dissolved and dispersed solution formed by dissolving and dispersing toner composition components containing a toner binder which comprises a modified polyester resin capable of reacting with active hydrogen in an organic solvent is reacted with a cross-linking agent or the like in an aqueous medium containing resin fine particles, and the solvent is removed from the obtained dispersion to thereby produce toner particles. The method further includes controlling the amount of resin fine particles remaining on surfaces of toner particles within a given amount. According to the method, there are problems that since the dissolved and dispersed solution of the toner composition is emulsified in the aqueous medium containing organic fine particles to form oil droplets, coalescence among oil droplets progresses along with the emulsification, there is a problem that a toner which has a large volume average particle diameter and inhomogeneous composition of toner materials among the toner particles, is poor in charge stability, and easily causes fog and toner scattering is produced, although the particle size distribution of the toner is relatively narrow.

Thus, a toner production method is strongly demanded in which a toner having uniform and homogenous composition components among toner particles, excelling in charge stability, and enabling forming high-quality images without substantially causing fog and toner scattering, while maintaining the advantages of chemical toners having a small particle diameter and a narrow particle size distribution and excelling in flowability is constantly and effectively produced in a stable condition, however, such a method has not yet been provided so far.

SUMMARY OF THE INVENTION

It is therefore an object of the present invention to provide a toner having uniform composition components among toner particles, excelling in charge stability, enabling forming high-quality images without substantially causing fog and toner scattering, and having a small particle diameter and a narrow particle size distribution. The present invention also provides an effective production method of the toner and a developer, a toner container, a process cartridge, an image forming apparatus, and an image forming method each of which enables forming high-quality images by using the toner.

As a result of keen examinations provided by the present invention, the following findings were obtained. The findings are that when a dissolved and dispersed solution prepared by dissolving and dispersing toner materials in an organic solvent is dispersed as dispersion particles in an aqueous medium containing no organic resin fine particles to prepare an oil droplet-in-water dispersion, the coalescence among the dispersion particles existing near each other is restrained to enable obtaining dispersion particles having a microscopic volume average particle diameter, and then organic resin fine particles are added to the oil droplet-in-water dispersion to granulate a toner in the presence of the organic resin fine particles to thereby make the dispersion particles having a microscopic volume average particle diameter coalesce each other to thereby obtain a toner having a uniform composition among toner particles, excelling in charge stability without substantially causing fog and toner scattering, and having a small particle diameter and a narrow particle size distribution.

The method for producing a toner of the present invention comprises dissolving and dispersing toner materials in an organic solvent to prepare a dissolved and dispersed solution of the toner materials, dispersing the dissolved and dispersed solution as dispersion particles in an aqueous medium containing no organic resin fine particles to prepare an oil droplet-in-water dispersion, adding organic resin fine particles in the oil droplet-in-water dispersion, and granulating a toner in the presence of the organic resin fine particles. In the method for producing the toner, the toner materials are dissolved or dispersed in an organic solvent to thereby prepare a dissolved and dispersed solution, the dissolved and dispersed solution is dispersed in an aqueous medium containing no organic resin fine particles to thereby prepare an oil droplet-in-water dispersion, and organic resin fine particles are added in the oil droplet-in-water dispersion to thereby granulate a toner in the presence of the organic resin fine particles. Here, the particle diameter of the dispersion particles in the aqueous medium containing no organic resin fine particles is microscopic, and the dispersion particles having the microscopic particle diameter are aggregated in the presence of the organic resin fine particles to become particles having a large particle diameter to be granulated as a toner. Consequently, it is possible to obtain a toner having a uniform composition of toner materials among the toner particles, excelling in charge stability, enabling high-quality images without substantially causing fog and toner scattering, and having a small particle diameter and a narrow particle size distribution.

It should be noted that when the toner materials contain at least an active hydrogen group-containing compound and a polymer capable of reacting with the active hydrogen group-containing compound, and the granulation is performed by reacting the active hydrogen group-containing compound with the polymer capable of reacting the active hydrogen group-containing compound to form an adhesive base as well as obtaining particles containing at least the adhesive base, a toner further excelling in various properties such as flocculation resistance, charging ability, flowability, releasing property, and fixing property, especially excelling in low-temperature fixing property, and enabling high-quality images can be effectively produced.

In the method for producing the toner of the present invention, it is preferred that a water dispersion containing a wax be added with the organic resin fine particles in the oil droplet-in-water dispersion. In this case, wax particles having a smaller particle diameter can be evenly dispersed in the toner without using the organic resin fine particles, and the wax particles can be made to moderately reside on the toner surface, and it is possible to effectively produce a toner capable of preventing uneven distribution of the wax particles in the toner particles, excelling in releasing property, and enabling high-quality images without substantially causing fog and toner scattering. In addition, since a heating process is unnecessary, a wax having a low-melting point can be used, and it is possible to achieve both low-temperature fixing property and heat resistant storage stability.

Further, it is also preferred that the method comprises removing the organic solvent before granulating the toner, and the concentration of the organic solvent in the dispersion particles after the removal of the organic solvent be 0.5% by mass to 35% by mass. By doing so, a heteromorphous toner which excels in cleaning ability can be obtained.

In the active hydrogen group-containing compound, the distribution coefficient represented by the amount of the active hydrogen group-containing compound dissolved out in the aqueous medium relative to the entire amount of the active hydrogen group-containing compound dissolved in the organic solvent be preferably more than 0.01 or more and less than 3, and more preferably, the active hydrogen group-containing compound be a N-alkyl alkane diamine. In this case, because outflow of the active hydrogen group-containing compound to the aqueous medium, and uneven distribution of the active hydrogen group-containing compound on the surfaces of the dispersion particles can be restrained, and the active hydrogen group-containing compound remain within the dispersion particles to react with the polymer capable of reacting with the active hydrogen group-containing compound, a toner which excels further in charge stability, graininess, anti-hot-offset property, low-temperature fixing property or the like can be produced.

The toner materials preferably comprise a crystalline polyester resin. In this case, a toner which excels particularly in fixing property can be obtained.

The toner of the present invention is produced by the method for producing the toner. Thus, the toner of the present invention has a small particle diameter, a narrow particle size distribution, a uniform composition of toner materials among toner particles, excels in charge stability, and enables high-quality images without substantially causing fog and toner scattering.

In addition, when the toner comprises particles containing at least an adhesive base which can be obtained by reacting the active hydrogen group-containing compound with the polymer capable of reacting with the active hydrogen group-containing compound, the toner excels in various properties such as flocculation resistance, charging ability, flowability, releasing property, fixing property. When an image is formed using the toner, a high-quality image can be obtained under low-temperatures.

The developer of the present invention comprises the toner of the present invention. Therefore, when an image is formed using the developer by means of electrophotography, a high-quality image can be formed with high image density and high-sharpness.

A toner container of the present invention comprises the toner. Therefore, when an image is formed using the toner filled in the toner container by means of electrophotography, a high-quality image can be formed with high image density and high-sharpness.

A process cartridge of the present invention comprises a latent electrostatic image bearing member, a developing unit configured to develop a latent electrostatic image formed on the latent electrostatic image bearing member using the toner to form a visible image. The process cartridge is detachably mounted to an image forming apparatus and excellent in convenience. Since the toner of the present invention is used with the process cartridge, a high-quality image can be formed with high image density and high-sharpness.

An image forming apparatus of the present invention comprises a latent electrostatic image bearing member, a latent electrostatic image forming unit configured to form a latent electrostatic image on the latent electrostatic image bearing member, a developing unit configured to develop the latent electrostatic image using the toner to form a visible image, a transferring unit configured to transfer the visible image onto a recording medium, and a fixing unit configured to fix the transferred image on the recording medium.

According to the image forming apparatus, a latent electrostatic image is formed on the latent electrostatic image bearing member by the latent electrostatic image forming unit; the latent electrostatic image is developed using the toner to form a visible image by the developing unit; the visible image is transferred on to a recording medium by the transferring unit; and the transferred image on the recording medium is fixed by the fixing unit. As a result, a high-quality image can be formed with high image density and high-sharpness.

The image forming method of the present invention comprises forming a latent electrostatic image on a latent electrostatic image bearing member, developing the latent electrostatic image using the toner to form a visible image, transferring the visible image onto a recording medium, and fixing the transferred image on the recording medium. In the image forming apparatus, a latent electrostatic image is formed on a latent electrostatic image bearing member in the forming latent electrostatic image; the latent electrostatic image is developed using the toner to form a visible image in the developing; the visible image is transferred onto a recording medium in the transferring; and the transferred image is fixed on the recording medium in the fixing. As a result, a high-quality image can be formed with high image density and high-sharpness.

BRIEF DESCRIPTION OF THE DRAWINGS

FIG. 4A is a table showing liquid viscosity and liquid refractive index described in "Guideline on Measurement Input Conditions" published by NIKKISO Co., Ltd.

FIG. 4B is a table showing liquid viscosity and liquid refractive index described in "Guideline on Measurement Input Conditions" published by NIKKISO Co., Ltd.

FIG. 4C is a table showing liquid viscosity and liquid refractive index described in "Guideline on Measurement Input Conditions" published by NIKKISO Co., Ltd.

Figure 1:
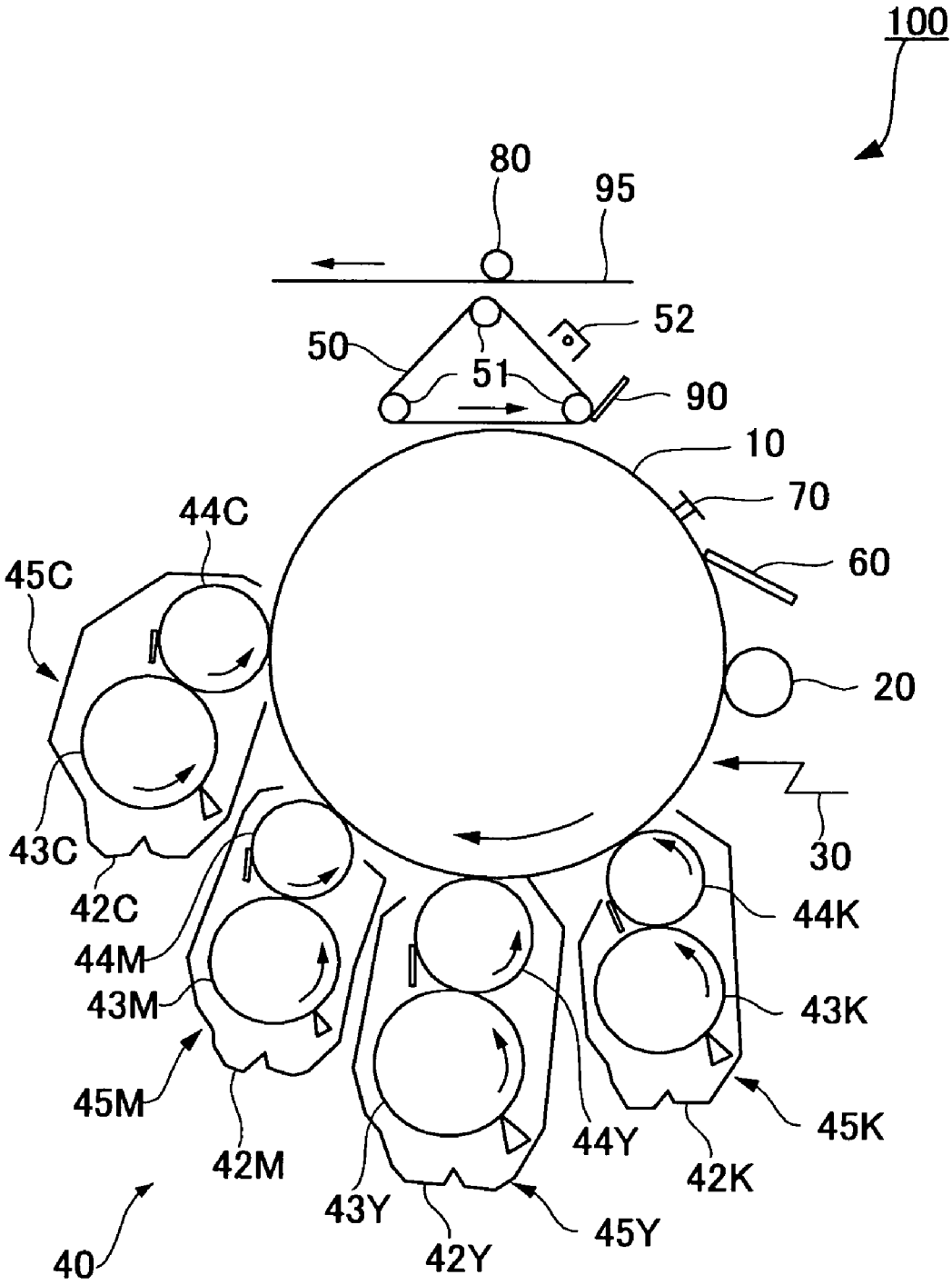
FIG. 1 is a schematic illustration exemplarily showing an example of performing the image forming method of the present invention using an image forming apparatus of the present invention.

DESCRIPTION OF THE PREFERRED EMBODIMENTS (Toner and Method for producing Toner)

The method for producing a toner of the present invention comprises preparing an oil droplet-in-water dispersion by dispersing a dissolved and dispersed solution of toner materials as dispersion particles in an aqueous medium containing no organic resin fine particles, and granulating a toner in the presence of organic resin fine particles by adding the organic resin fine particles in the oil droplet-in-water dispersion, and preferably comprises removing the organic solvent before the granulation, and further comprises other steps in accordance with the necessity.

The toner of the present invention can be obtained by the method for producing a toner of the present invention.

Examples of the preferred aspect of the toner of the present invention include a toner in which the toner materials include at least an active hydrogen-group-containing compound and a polymer capable of reacting with the active hydrogen-group-containing compound, and the granulation is performed by reacting the active hydrogen group-containing compound with the polymer capable of reacting with the active hydrogen group-containing compound to form an adhesive base and obtaining particles containing the adhesive base to thereby produce a toner.

Hereinafter, the details of the toner of the present invention will be also clarified through the explanations of the method for producing the toner of the present invention.

<Preparation of Oil Droplet-In-Water Dispersion>

In the preparation of an oil droplet-in-water dispersion, toner materials are dissolved or dispersed in an organic solvent to prepare a dissolved and dispersed solution of the toner materials, and the dissolved and dispersed solution is dispersed as dispersion particles in an aqueous medium containing no organic resin fine particles to thereby prepare an oil droplet-in-water dispersion.

In the method for producing the toner of the present invention, it is required that the dispersion particles be formed in an aqueous medium containing no organic resin fine particles. The organic resin fine particles are generally used for the purpose of controlling the toner shape such as average circularity and particle size distribution, therefore, when the organic resin fine particles are included in the aqueous medium, coalescence of the dispersed droplets residing near each other progresses at the same time of the dispersion particles, and there may be cases where microscopic dispersion particles cannot be obtained, and it is difficult to control a desired particle size distribution, toner shape, reactivity, uneven distribution of toner materials within toner particles, and the like.

—Dissolved Solution or Dispersion of Toner Materials—

The dissolved and dispersed solution of the toner materials used in the present invention is prepared by dissolving and dispersing the toner materials in an organic solvent.

The toner materials are not particularly limited, may be suitably selected in accordance with the intended use as long as a toner can be formed, and examples there of include at least any one of a monomer, a polymer, an active hydrogen group-containing compound, and a polymer or a prepolymer capable of reacting with the active hydrogen group-containing compound, preferably comprises a crystalline polyester resin, and further comprises other components such as an unmodified polyester resin, a releasing agent, a colorant, and a charge controlling agent.

In the preferred aspect of the method for producing the toner of the present invention, the dissolved and dispersed solution can be prepared by dissolving and dispersing toner materials such as the active hydrogen group-containing compound, the polymer capable of reacting with the active hydrogen group-containing compound, the crystalline polyester resin, the unmodified polyester resin, the releasing agent, the colorant, and the charge controlling agent in the aqueous solvent, and among the toner materials, the components other than the active hydrogen group-containing compound and the polymer or prepolymer capable of reacting with the active hydrogen group-containing compound may be added and mixed in an aqueous medium in the preparation of the aqueous medium which will be described below or may be added to the aqueous medium with the dissolved and dispersed solution at the time of adding the dissolved and dispersed solution of the toner materials.

The organic solvent is not particularly limited and may be suitably selected in accordance with the intended use, provided that it is a solvent capable of dissolving and dispersing the toner materials. An organic solvent having a boiling point less than 150° C. and being volatile is preferably used in terms of ease of removal of the organic solvent, and examples of the organic solvent include toluene, xylene, benzene, carbon tetrachloride, methylene chloride, 1,2-dichloroethane, is 1,1,2-trichloroethane, trichloroethylene, chloroform, monochlorobenzene, dichloroethylidene, methylacetate, ethylacetate, methyl ethyl ketone, and methyl isobutyl ketone. Among these organic solvents, toluene, xylene, benzene, methylene chloride, 1,2-dichloroethane, chloroform, and carbon tetrachloride or the like are preferable, and ethyl acetate is particularly preferable. Each of these organic solvents may be used alone or in combination with two or more.

The usage of the organic solvent is not particularly limited, may be suitably selected in accordance with the intended use, and the usage of the organic solvent is preferably 40 parts by mass to 300 parts by mass relative to 100 parts by mass of the toner materials, more preferably 60 parts by mass to 140 parts by mass, and still more preferably 80 parts by mass to 120 parts by mass.

—Active Hydrogen Group-Containing Compound—

The active hydrogen group-containing compound serves as an elongation agent, a cross-linking agent or the like at the time when the active hydrogen-group-containing compound is subjected to an elongation reaction or a cross-linking reaction or the like in the aqueous medium.

In the active hydrogen group-containing compound, the distribution coefficient represented by the amount of the active hydrogen group-containing compound dissolved out in the aqueous medium relative to the entire amount of the active hydrogen group-containing compound dissolved in the organic solvent be preferably more than 0.01 or more and less than 3, and more preferably 0.01 to 1. When the distribution coefficient is more than 0.01 or more to less than 3.0, elution of the active hydrogen group-containing compound to the aqueous medium can be restrained, and the active hydrogen group-containing compound can be retained within the dispersion particles to prevent degradation of the properties of the toner.

The measurement of the distribution coefficient is performed by the following method: In a vessel, 0.125 g of the active hydrogen group-containing compound is adequately dissolved in 50 g of an ethyl acetate solution with 50% by mass of an unmodified polyester resin contained therein to prepared a mixed solution, next, the mixed solution is added to 50 g of deionized water in a 200 mL of glass beaker, and stirred at 200 rpm using a magnetic stirrer and a stirrer tip having a diameter of 20 mm to make the mixed solution in a pseudo emulsion state. Thereafter, the mixture in the pseudo emulsion state is left for 1 hour at a temperature of 25° C. to make the ethyl acetate solution (organic solvent phase) and the deionized water (aqueous medium phase) separate each other. Further, the aqueous medium phase is isolated, titrated in a hydrochloric acid solution to quantitate the amount of the active hydrogen group-containing compound in the aqueous medium phase. Then, the mass ratio between the amount of the active hydrogen group-containing compound dissolved and transferred in the aqueous medium relative to the entire amount of the active hydrogen group-containing compound added is defined as the distribution coefficient.

The active hydrogen group-containing compound is not particularly limited and may be suitably selected in accordance with the intended use, provided that it has an active hydrogen group. For example, when the polymer capable of reacting with the active hydrogen group-containing compound is an isocyanate group containing polyester prepolymer (A), amines (B) are preferably used from the perspective of enabling the active hydrogen group-containing compound to have a high molecular mass by subjecting it to an elongation reaction or a cross-linking reaction or the like with the isocyanate group-containing polyester prepolymer (A).

The active hydrogen group is not particularly limited, may be suitably selected in accordance with the intended use, and example thereof include hydroxyl groups (alcoholic hydroxyl group or phenolic hydroxyl group), amino groups, carboxyl groups, mercapto groups. Each of them may be used alone or in combination with two or more. Among the above mentioned, alcoholic hydroxyl group is particularly preferable.

The amines (B) are not particularly limited, may be suitably selected in accordance with the intended use, and examples the amines (B) include diamines (B1), trivalent or more polyamines (B2), aminoalcohols (B3), aminomercaptans (B4), amino acids (B5), and compounds (B6) in which any of the amino groups B1 to B5 is blocked. Each of these amines may be used alone or in combination with two or more. Among the above mentioned, diamines (B1) and mixtures of diamines (B1) and a small amount of trivalent or more polyamines (B2) are particularly preferable.

For the diamines (B1), it is preferred to be oil-soluble and have a high molecular mass. For example, N-alkyl alkane diamine is preferably used. When the diamine is a substance being water-soluble and having a low-molecular mass, the water-solubility of the diamine is high, and the diamine may flow out into the aqueous medium at the time of granulation of the toner, high-molecular components in the toner materials unevenly may reside near the surfaces of the dispersion particles to take a pseudo-capsule structure. In the method for producing the toner of the present invention, the adverse effects are increasingly conspicuous because the time when the dispersion particles are existing as microscopic particles is long. On the other hand, when the diamine is oil-soluble, outflow of the active hydrogen group-containing compound to the aqueous medium, and uneven distribution of the active hydrogen group-containing compound on the surfaces of the dispersion particles can be restrained, the active hydrogen group-containing compound can be retained within the dispersion particles, and it is possible to obtain a toner having a uniform composition of the toner materials among toner particles and being excellent in low-temperature fixing property.

For the N-alkyl alkane diamine, for example, N-oleyl-1, and 3-propane diamine represented by the following structural formula (1) are particularly preferable.

Structural Formula (1)

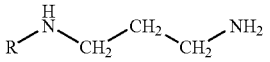

In Structural Formula (1), 'R' represents an oleyl group.

For the diamine (B1), aromatic diamines, alicyclic diamines, aliphatic diamines or the like may be used. Examples of the aromatic diamines include phenylene diamines, diethyl toluene diamines, and 4,4'-diamino diphenyl methanes. Examples of the alicyclic diamines include 4,4'-diamino-3,3'-dimethyl dicyclohexyl methanes, diamine cyclohexanes, and isophorone diamines. Examples of the aliphatic diamines include ethylene diamines, tetramethylene diamines, and hexamethylene diamines.

Examples of the trivalent or more polyamines (B2) include diethylene triamines, and triethylene tetramines.

Examples of the aminoalcohols (B3) include ethanol amines, and hydroxyethylanilines.

Examples of the amino mercaptans (B4) include aminoethyl mercaptans, and aminopropyl mercaptans.

Examples of the amino acids (B5) include aminopropionic acids, aminocaproic acids.

Examples of the compounds (B6) in which the amino groups B1 to B5 are blocked include ketimine compounds which are obtained from any of the above-noted amines B1 to B5 and ketones such as acetones, methyl ethyl ketones, and methyl isobutyl ketones, and oxazolidone compounds.

In the elongation reaction or the cross-linking reaction between the active hydrogen group-containing compound and the polymer capable of reacting with the active hydrogen group-containing compound, it is preferred to use a reaction auxiliary agent (catalyst) for the elongation reaction or the cross-linking reaction. Examples of the catalyst include tertiary amine compounds.

The tertiary amine compound is not particularly limited, may be suitably selected in accordance with the intended use, however, preferred examples thereof include the compounds represented by the following Formula (2). The tertiary amine compounds is preferable in terms of not only serving as a catalyst but also serving as an emulsification auxiliary agent used at the time of dispersing the dissolved and dispersed solution of the toner materials in the aqueous medium in the preparation of the oil droplet-in-water dispersion.

Formula (2)

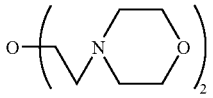

To stop the elongation reaction, the cross-linking reaction or the like between the active hydrogen group-containing compound and the polymer capable of reacting the active hydrogen group-containing compound, a reaction stopper can be used. When the reaction stopper is used, it is preferable in that the molecular mass of the adhesive base can be controlled within the desired range. Examples of the reaction stopper include monoamines such as diethylamines, dibutylamines, butylamines and lauryl amines, and compounds in which any of these monoamines are blocked such as ketimine compounds.

For the mixture ratio of the amines (B) to the isocyanate group-containing polyester prepolymer (A), the mixture equivalent ratio of the isocyanate group [NCO] in the isocyanate group-containing prepolymer (A) to the amino group [NHx] in the amines (B) is preferably 1/3 to 3/1, more preferably 1/2 to 2/1, and particularly preferable 1/1.5 to 1.5/1.

The mixture equivalent ratio ([NCO]/[NHx]) is less than 1/3, low-temperature fixing property of the toner may degrade, and when the mixture equivalent ration is more than 3/1, the molecular mass of the urea-modified polyester resin may be reduced to cause degradation of anti-hot-offset property of the toner.

—Polymer Capable of Reacting with Active Hydrogen Group-containing Compound—

The polymer capable of reacting with the active hydrogen group-containing compound (hereinafter, may be referred to as polymer) is not particularly limited and may be suitably selected from the resins known in the art, provided that it has at least a region capable of reacting with the active hydrogen group-containing compound. Examples thereof include polyol resins, polyacrylic resins, polyester resins, epoxy resins, or derivative resins thereof.

Each of these polymers may be used alone or in combination with two or more. Among the above mentioned, polyester resins are particularly preferable in terms of high-flowability and transparency in the dissolution.

In the prepolymer, the region capable of reacting with the active hydrogen group-containing compound is not particularly limited, may be suitably selected from substituent groups known in the art, and examples of the substituent groups include isocyanate groups, epoxy groups, carboxylic groups, and acid chloride groups.

Each of these groups may be included alone or two or more groups thereof may be included. Among the above mentioned, isocyanate groups are particularly preferable.

Among the prepolymers, polyester resins containing groups formed by urea binding (RMPE) are preferable in that the molecular mass of the high-polymer component is easily controlled, and oil-less low-temperature fixing property in a dry toner, excellent releasing property and excellent fixing property can be assured even particularly when there is no coating mechanism of releasing oil to a heating medium for fixing.

Examples of the groups formed by urea binding include isocyanate groups.

When the group formed by urea binding in the polyester resin containing the group formed by urea binding (RMPE) is the isocyanate group, particularly suitable examples of the polyester resin (RMPE) is isocyanate group-containing polyester prepolymer (A).

The isocyanate group-containing polyester prepolymer (A) is not particularly limited, may be suitably selected in accordance with the intended use, for example, there are polycondensation products between polyol (PO) and polycarboxylic acid (PC), and the products being produced by reacting the active hydrogen group-containing compound with polyisocyanate (PIC).

The polyol (PO) is not particularly limited, may be suitably selected in accordance with the intended use, and examples thereof include diols (DIO), and trivalent or more polyols (TO), and mixtures of diols (DIO) with a small amount of trivalent or more polyols (TO). Each of these polyols (PO) may be used alone or in combination with two or more. Among the above mentioned, the diol (DIO) alone or mixtures of diols (DIO) with a small amount of trivalent or more polyols (TO) or the like are preferably used.

Examples of the diol (DIO) include alkylene glycols, alkylene ether glycols, alicyclic diols, alkylene oxide adducts of alicyclic diols, bisphenols, and alkylene oxide adducts of bisphenols.

The alkylene glycols preferably have 2 to 12 carbon atoms, and examples thereof include ethylene glycols, 1,2-propylene glycols, 1,3-propylene glycols, 1,4-butandiols, and 1,6-hexanediols. Examples of the alkylene ether glycols include diethylene glycols, triethylene is glycols, dipropylene glycols, polyethylene glycols, polypropylene glycols, and polytetramethylene ether glycols. Examples of the alicyclic diols include 1,4-cyclohexane dimethanols, and hydrogenated bisphenol A. Examples of the alkylene oxide adducts of the alicyclic diols include adducts of which alkylene oxides such as ethylene oxides, propylene oxides, and butylene oxides are added to the alicyclic diols. Examples of the bisphenols include bisphenol A, bisphenol F, and bisphenol S. Examples of the alkylene oxide adducts of the bisphenols include adducts of which alkylene oxides such as ethylene oxides, propylene oxides, and butylene oxides are added to the bisphenols.

Among the above mentioned, alkylene glycols having 2 to 12 carbon atoms and alkylene oxide adducts of bisphenols are preferable, and alkylene oxide adducts of bisphenols and mixtures of the alkylene oxide adducts of bisphenols with alkylene glycols having 2 to 12 carbon atoms are particularly preferable.

For the trivalent or more polyols (TO), trivalent to octavalent or more polyols (TO) are preferable, and examples of the trivalent or more polyols (TO) include trivalent or more polyaliphatic alcohols, trivalent or more polyphenols, alkylene oxide adducts of trivalent or more polyphenols.

The trivalent or more polyaliphatic alcohols include glycerine, trimethylol ethane, trimethylol propane, pentaerythritol, and sorbitol. Examples of the trivalent or more polyphenols include trisphenol PA, phenol novolac, and cresol novolac. Examples of the alkylene oxide adducts of the trivalent or more polyphenols include adducts of which alkylene oxides such as ethylene oxides, propylene oxides, and butylene oxides are added to the trivalent or more polyphenols.

In the mixture of the diols (DIO) and the trivalent or more polyols (TO), the mixture mass ratio (DIO:TO) of the diol (DIO) and the trivalent or more polyols (TO) is preferably 100:0.01 to 10, and more preferably 100:0.01 to 1.

The polycarboxylic acid (PC) is not particularly limited, may be suitably selected in accordance with the intended use, and examples of the polycarboxylic acid (PC) include dicarboxylic acids (DIC), and trivalent or more polycarboxylic acids (TC), and mixtures of the dicarboxylic acids (DIC) and trivalent or more polycarboxylic acids (TC).

Each of these polycarboxylic acids may be used alone or in combination with two or more. Among them, mixtures of dicarboxylic acids (DIC) and a small amount of the trivalent or more polycarboxylic acid are preferably used.

Examples of the dicarboxylic acids include alkylene dicarboxylic acids, alkenylen dicarboxylic acids, and aromatic dicarboxylic acids.

Examples of the alkylene dicarboxylic acids include succinic acids, adipic acids, and sebacic acids. For the alkenylen dicarboxylic acids, those having 4 to 20 carbon atoms are preferable, and examples thereof include maleic acids, and fumaric acids. For the aromatic dicarboxylic acids, those having 8 to 20 carbon atoms are preferable, and examples thereof include phthalic acids, isophthalic acids, terephthalic acids, and naphthalene dicarboxylic acids.

Among the above mentioned, alkenylen dicarboxylic acids having 4 to 20 carbon atoms and aromatic dicarboxylic acids having 8 to 20 carbon atoms are preferable.

For the trivalent or more polycarboxylic acids (TO), trivalent to octavalent or more polycarboxylic acids are preferable, and examples thereof include aromatic polycarboxylic acids.

For the aromatic polycarboxylic acids, those having 9 to 20 carbon atoms are preferable, and examples thereof include trimellitic acids, and pyromellitic acids.

For the polycarboxylic acids (PC), acid anhydrides selected from the dicarboxylic acids (DIC), the trivalent or more polycarboxylic acids (TC), and mixtures of the dicarboxylic acids (DIC) with the trivalent or more polycarboxylic acids, or lower alkyl esters may also be used. Examples of the lower alkyl esters include methyl esters, ethyl esters, and isopropyl esters.

In the mixtures of the dicarboxylic acids (DIC) with the trivalent or more polycarboxylic acids (TC), the mixture mass ratio (DIC:TC) of the dicarboxylic acids (DIC) and the trivalent or more polycarboxylic acids (TC) is not particularly limited, may be suitably selected in accordance with the intended use, for example, the mixture mass ratio (DIC:TC) is preferably 100:0.01 to 10, and more preferably 100:0.01 to 1.

The mixture ratio of the polyols (PO) to the polycarboxylic acids (PC) in the polycondensation reaction is not particularly limited and may be suitably selected in accordance with the intended use, for example, the equivalent ratio [OH]/[COOH] of hydroxy group [OH] content in the polyols (PO) to carboxyl group [COOH] content in the polycarboxylic acids (PC) is preferably 2/1 to 1/1, more preferably 1.5/1 to 1/1, and particularly preferably 1.3/1 to 1.02/1.

The content of the polyol (PO) in the isocyanate group-containing polyester prepolymer (A) is not particularly limited and may be suitably selected in accordance with the intended use. For example, the content is preferably 0.5% by mass to 40% by mass, more preferably 1% by mass to 30% by mass, and particularly preferably 2% by mass to 20% by mass.

When the content of the polyol (PO) in the isocyanate group-containing polyester prepolymer (A) is less than 0.5% by mass, anti-hot-offset property degrades, it may be difficult to achieve both heat resistant storage stability and low-temperature fixing property of the toner. When the content is more than 40% by mass, low-temperature fixing property of the toner may degrade.

The polyisocyanate (PIC) is not particularly limited, may be suitably selected in accordance with the intended use, and examples thereof include aliphatic polyisocyanates, alicyclic polyisocyanates, aromatic diisocyanates, aromatic aliphatic diisocyanates, isocyanulates, phenol derivatives of the above-mentioned polyisocyanates, and polyisocyanates being blocked with oxime, caprolactam.

Examples of the aliphatic polyisocyanates include tetramethylene diisocyanate, hexamethylene diisocyanate, and 2,6-diisocyanate methyl caproate, octamethylene diisocyanate, decamethylene diisocyanate, dodecamethylene diisocyanate, tetradecamethylene diisocyanate, trimethylhexane diisocyanates, and tetramethylhexane diisocyanates. Examples of the alicyclic polyisocyanates include isophorone diisocyanate, and cyclohexyl methane diisocyanate. Examples of the aromatic diisocyanates include tolylene diisocyanate, and diphenylmethane diisocyanate, 1,5-naphthilene diisocyanate, diphenylene-4,4'-diisocyanato, 4,4-diisocyanate-3,3'-dimethylphenyl, 3-methyldiphenyl methane-4,4'-diisocyanate, and diphenyl ether-4,4'-diisocyanate. Examples of the aromatic aliphatic diisocyanates include α, α, α', α'-tetramethyl xylylene diisocyanate. Examples of the isocyanurates include tris-isocyanato alkyl-isocyanulates, and tri-isocyanato cycloalkyl-isocyanulates.

Each of these polyisocyanates may be used alone or in combination with two or more.

For the mixture ratio used when reacting the polyisocyanate with the active-hydrogen group-containing polyester resin (for example, hydroxyl group-containing polyester resin), the mixture equivalent ratio [NCO]/[OH] of isocyanate group [NCO] content in the polyisocyanate (PIC) to hydroxy group [OH] content in the hydroxy-containing polyester resin is typically 5/1 to 1/1, preferably 4/1 to 1.2/1, and more preferably 3/1 to 1.5/1.

When the content of isocyanate group [NCO] is more than 5, low-temperature fixing property degrades, and when the content of isocyanate group [NCO] is less than 1, anti-offset property degrades.

The content of polyisocyanate (PIC) component in the isocyanate group-containing polyester prepolymer (A) is not particularly limited, may be suitably selected in accordance with the intended use, for example, it is preferably 0.5% by mass to 40% by mass, more preferably 1% by mass to 30% by mass, and still more preferably 2% by mass to 20% by mass.

When the content is less than 0.5% by mass, anti-hot-offset property degrades, and it may be difficult to achieve both heat resistant storage stability and low-temperature fixing property. When the content is more than 40% by mass, low-temperature fixing property tends to degrade.

The average number of isocyanate group contained in per molecule in the isocyanate-group containing polyester prepolymer (A) is typically one or more, preferably 1.2 to 5, and more preferably 1.5 to 4.

When the number of isocyanate group per molecule is less than 1, the molecular mass of the polyester resin modified by the urea-binding group may lower to cause degraded anti-hot-offset property.

For the mass average molecular mass (Mw) of the polymer capable of reacting with the active hydrogen group-containing compound, based on the molecular mass distribution of tetrahydrofuran (THF) soluble matter through the use of gel permeation chromatography (GPC), it is preferably 3,000 to 40,000, and more preferably 4,000 to 30,000. When the mass average molecular mass (Mw) is less than 3,000, heat resistant storage property may degrade, and when the mass average molecular mass (Mw) is more than 40,000, low-temperature fixing property may degrade.

The mass average molecular mass (Mw) of the polymer capable of reacting with the active hydrogen group-containing compound can be measured using a gel permeation chromatography (GPC) measurement device (GPC-8220GPC, manufactured by TOSOH CORPORATION) based on the following measurement conditions:

Using a triple column having a length of 15 cm (TSKgel SuperHZM-H, manufactured by TOSOH CORPORATION) to set the temperature at 40° C., tetrahydrofuran (THF) is streamed as a solvent at a flow rate of 0.35 mL/minute, and 100 mL of a 0.15% by mass of sample solution (a polymer capable of reacting with the active hydrogen group-containing compound) is poured to the column to measure the mass average molecular mass (Mw) of the polymer capable of reacting with the active hydrogen group-containing compound. It should be noted that as a preliminary treatment, 0.4 mL of the 0.15% by mass sample solution is dissolved in tetrahydrofuran (THF) (containing stabilizer, manufactured by Wako Pure Chemical Industries, Ltd.) so as to be 0.15% by mass, and the solution is passed through a filter with a mesh of 0.2 μm to obtain a filtrate. The filtrate is used as the sample solution.

In the measurement of the molecular mass of the sample, the molecular mass distribution of the sample is calculated based on the relation between logarithm values of the analytical curve prepared using several monodispersed polystyrene standard samples and count values. For the standard polystyrene samples for preparing the analytical curve, No S-7300, s-210, S-390, S-875, S-1980, S-10.9, S-629, S-3.0, S-0.580 of ShowdexSTANDARD available from SHOWA DENKO K.K., and toluene are used. For the detector, a refractive index (RI) detector is used.

The measurement of the molecular mass distribution through the use of the gel permeation chromatography (GPC) can be performed, for example, as follows:

First, the column is stabilized in the heat chamber with the temperature of 40° C. While keeping the temperature, tetrahydrofuran (THF) is streamed as a column solvent at a flow rate of 1 mL/minute, and 50 μL to 200 μL of a tetrahydrofuran resin sample solution with the concentration thereof adjusted to 0.05% by mass to 0.6% by mass is poured into the column to measure the molecular mass distribution. In the measurement of the molecular mass of the sample, the molecular mass distribution held by the sample is calculated based on the relation between logarithm values of the analytical curve prepared using several monodispersed polystyrene standard samples and count values. For the standard polystyrene samples for preparing the analytical curve, those having a molecular mass being $6\times10^2$, $2.1\times10^2$, $4\times10^2$, $1.75\times10^4$, $1.1'\times10^5$, $3.9\times10^5$, $8.6\times10^5$, $2\times10^6$, and $4.48\times10^6$ manufactured by Pressure Chemical Co. or TOSOH CORPORATION are used, and it is preferred to use at least 10 standard polystyrene samples. For the detector, a refractive index (RI) detector can be used.

—Crystalline Polyester Resin—

The crystalline polyester resin has crystallinity and exhibits heat-melting property which causes a sharp decrease in viscosity in the vicinity of fixing start temperatures. Namely, the crystalline polyester resin exhibits excellent heat resistant storage stability due to the crystallinity until just before the melting start temperature, and it exhibits a sharp decrease in viscosity (sharp melting property) at a temperature of the melting start temperature to be fixed, therefore, it is possible to produce a toner achieving both excellent heat resistant storage stability and low-temperature fixing property as well as being excellent in the width of releasing (difference between the lower limit of low-temperature fixing temperature and hot-offset causing temperature).

The crystalline polyester resin is not particularly limited, may be suitably selected in accordance with the intended use, and examples thereof include diol compounds having 2 to 6 carbon atoms as alcohol components, and particularly, crystalline polyester resins represented by the following Formula (1) and synthesized by using a compound containing 1,4-butan diol, 1,6-hexane diol, and derivatives thereof in a molar ratio of 80 mole % or more, more preferably 85 mole % to 100 mole % and at least maleic acid, fumaric acid, succinic acid, and derivatives thereof as acid components.

Formula (1)

$$\left[-O-CO-(CR^1=CR^2)_L-CO-O-(CH_2)_n-\right]_m$$

In Formula (1), 'n' and 'm' respectively represent a repetitive unit value, L represents an integer number from 1 to 3, and $R^1$ and $R^2$ may have the same value or individually have a different value and respectively represent a hydrogen atom or a hydrocarbon atom.

To control the crystallinity and the melting point of the crystalline polyester resin, nonlinear polyesters that have been polycondensed by adding trivalent or more polyvalent alcohols such as glycerine to the alcohol components, or adding trivalent or more polycarboxylic acids such as anhydrous trimellitic acid to the acid components may be used when synthesizing the crystalline polyester. The molecular structure of the crystalline polyester can be identified using a solid NMR or the like.

For the mass average molecular mass (Mw) of the crystalline polyester resin, in the molecular mass distribution of ortho-dichlorobenzene soluble matter based on the gel permeation chromatography (GPC), it is preferably 1,000 to 30,000, and more preferably 1,000 to 6,500. When the mass average molecular mass (Mw) is less than 1,000, heat-resistant storage stability of the toner may degrade. When the mass average molecular mass (Mw) is more than 30,000, low-temperature fixing property may degrade.

For the number average molecular mass (Mn) of the crystalline polyester resin, in the molecular mass distribution of ortho-dichlorobenzene soluble matter based on the gel permeation chromatography (GPC), it is preferably 500 to 6,000, and more preferably 500 to 2,000. In addition, the ratio (Mw/Mn) of the mass average molecular mass (Mw) to the number average molecular mass (Mn) is preferably 2 to 8, and more preferably 2 to 5.

In the molecular mass distribution by the gel permeation chromatography (GPC), it is preferred that the peaked point in the molecular mass distribution chart represented by log (M) as the horizontal axis and % by mass as the vertical axis be ranging from 3.5 to 4.0, and the half-value width of the peak be 1.5 or less.

The melting temperature and the $F_{1/2}$ temperature of the crystalline polyester resin are preferably low temperatures, in so far as the heat resistant storage stability is not degraded, for example, the DSC endothermic peak temperature is preferably 50° C. to 150° C. When the melting temperature and the $F_{1/2}$ temperature of the crystalline polyester resin are less than 50° C., the heat resistant storage stability of the toner may degrade, and toner blocking easily arises at the internal temperature of the developing unit. When the melting temperature and the $F_{1/2}$ temperature of the crystalline polyester resin are more than 150° C., low-temperature fixing property of the toner may degrade due to increased lower limit of fixing temperature.

The crystalline polyester resin preferably has absorption of olefin based on δCH (out-of-plane bending vibration) at any one of wavelengths of 965±10 $cm^{-1}$ and 990±10 $cm^{-1}$ in the infrared absorption spectrum. When the absorption based on the δCH (out-of-plane bending vibration) olefin resides at the position, low-temperature of the toner is improved.

For the acid value of the crystalline polyester resin, in order to achieve low-temperature fixing property from the perspective of compatibility between paper and the resin, the acid value is preferably 8 mgKOH/g or more, and more preferably 20 mgKOH/g or more. On the other hand, in order to improve hot-offset property, the acid value is preferably 45 mgKOH/g or less.

The hydroxyl value of the crystalline polyester resin is preferably 0 mgKOH/g to 50 mgKOH/g, and more preferably 5 mgKOH/g to 50 mgKOH/g from the perspective of low-temperature fixing property and charging ability.

When the unmodified polyester resin (b) and the crystalline polyester resin (c) are included in the toner, the mixture mass ratio of the urea-binding group-containing polyester resin (a), the unmodified polyester resin (b), and the crystalline polyester resin (c), represented as (a)/(b)+(c), is typically 5/95 to 25/75, preferably 10/90 to 25/75, more preferably 12/88 to 25/75, still more preferably 12/88 to 22/78, and the mass ration between (b) and (c) is typically 99/1 to 50/50, preferably 95/5 to 60/40, and more preferably 90/10 to 65/35. When the mass ration deviates from the numerical value range, there may be cases where anti-hot-offset property degrades, and it is difficult to achieve both heat resistant storage stability and low-temperature fixing property.

—Other Components—

The other components are not particularly limited, may be suitably selected in accordance with the intended use, and examples thereof include colorants, charge controlling agents, inorganic fine particles, flowability improvers, cleaning ability improvers, magnetic materials, and metal soaps.

The colorants are not particularly limited and may be suitably selected from dyes and pigments known in the art. Examples of the colorants include carbon black, nigrosine dye, iron black, naphthol yellow S, Hansa yellow (10G, 5G, and G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazinelake yellow, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Hello bordeaux BL, bordeaux 10B, BON maroon light, BON maroon medium, eosin lake, rhodamine lake B, rhodamine lake Y, alizarin lake, thioindigo red B, thioindigo maroon, oil red, quinacridon red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS, BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian green, emerald green, pigment green B, naphthol green B, green gold, acid green lake, malachite green lake, phthalocyanine green, anthraquinon green, titanium oxide, zinc flower, and lithopone.

Each of these colorants may be used alone or in combination with two or more.

The content of the colorants to the toner is not particularly limited, may be suitably selected in accordance with the intended use, however, it is preferably 1% by mass to 15% by mass, and more preferably 3% by mass to 10% by mass.

When the content is less than 1% by mass, the tinting power of the toner may degrade. When the content is more than 15% by mass, defective dispersion of dyes and pigments occurs in toner, and it may cause degradation in tinting power and electric property of toner.

The colorants may be used as a complex masterbatch compound with a resin. The resin is not particularly limited and may be suitably selected from those known in the art. Example of the resin include styrenes or polymers of derivative substitution is thereof; styrene copolymers, polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic resins, rosins, modified rosins, terpene resins, aliphatic hydrocarbon resins, alicyclic hydrocarbon resins, aromatic petroleum resins, chlorinated paraffins, and paraffins. Each of these resins may be used alone or in combination with two or more.

Examples of the styrene or the polymers of derivative substitution thereof include polyester resins, polystyrenes, poly-p-chlorostyrenes, and polyvinyl toluenes. Examples of the styrene copolymers include styrene-p-chlorostyrene copolymers, styrene-propylene copolymers, styrene-vinyltoluene copolymers, styrene-vinylnahthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chloromethacrylate copolymer, styrene-acrylonitrile copolymers, styrene-vinylmethyl-keton copolymers, styrene-butadiene copolymers, styrene -isoprene copolymers, styrene-acrylonitrile-indene copolymers, styrene-maleic acid copolymers, and styrene-ester maleate copolymers.

The masterbatch may be produced by applying a high shearing force to the resins for the masterbatch and the colorants and mixing or kneading the components. Here, to improve the interaction between the colorants and the resins, an organic solvent may be added thereto. Besides, a so-called flashing process is preferably employed, because in the flashing process, a wet cake of colorants can be directly used without the necessity of drying. In the flashing process, a colorant-water-paste containing water is mixed and kneaded with resins and an organic solvent to transfer the colorants to the resins and then to remove the moisture and the organic solvent components. For the mixing and kneading, a high shearing dispersion unit such as a triple roll mill is preferably used.

The charge controlling agent is not particularly limited, may be suitably selected from those known in the art, however, when a colored material is used for the charge controlling agent, the color tone of toner may be changed, therefore, colorless materials or materials in close to white color are preferably used. Examples thereof include triphenylmethane dyes, molybdic acid chelate pigments, rhodamine dyes, alkoxy amines, quaternary ammonium salts such as fluorine-modified quaternary ammonium salts; alkylamides, phosphoric monomer or compounds thereof, tungsten monomer or compounds thereof, fluorine activator, salicylic acid metallic salts, and salicylic acid derivative metallic salts. Each of these charge controlling agents may be used alone or in combination with two or more.

For the charge controlling agent, commercially available products may be used, and examples of the commercially available charge controlling agents include Bontron P-51 being a quaternary ammonium salt, Bontron E-82 being an oxynaphthoic acid metal complex, Bontron E-84 being a salicylic acid metal complex, and Bontron E-89 being a phenol condensate (manufactured by Orient Chemical Industries, Ltd.); TP-302 and TP-415 being a quaternary ammonium salt molybdenum metal complex (by Hodogaya Chemical Co.); Copy Charge PSY VP2038 being a quaternary ammonium salt, Copy Blue PR being a triphenylmethane derivative, and Copy Charge NEG VP2036 and Copy Charge NX VP434 being a quaternary ammonium salt (by Hoechst Ltd.); LRA-901, and LR-147 being a boron metal complex (by Japan Carlit Co., Ltd.); quinacridones, azo pigments, and other high-molecular mass compounds having a functional group such as sulfonic acid group, carboxyl group, and quaternary ammonium salts.

The charge controlling agents may be dissolved and dispersed after dissolving and kneading with the masterbatch or may be directly added to the organic solvent at the time of dissolving and dispersing the organic solvent with each of the toner components.

The content of the charge controlling agent in the toner is determined depending on the type of the binder resin, presence or absence of additives used in accordance with the necessity, and the dispersion method and is not limited uniformly, however, for example, relative to 100 parts by mass of the binder resin, the charge controlling agent is used in the range from 0.1 parts by mass to 10 parts by mass, and more preferably in the range from 0.2 parts by mass to 5 parts by mass. When the usage amount of the charge controlling agent is less than 0.1 parts by mass, charging ability of the toner may not be obtained. When the usage amount of the charge controlling agent is more than 10 parts by mass, charging ability of the toner is exceedingly large, which reduces the effect of the primarily used charge controlling agent, and electrostatic suction force relative to developing rollers increases, resulting in lessened flowability of the developer and reduced image density.

The inorganic fine particles are not particularly limited, may be suitably selected in accordance with the intended use, and examples thereof include silicas, aluminas, titanium oxides, barium titanates, magnesium titanates, calcium titanates, strontium titanates, zinc oxides, tin oxides, silica sand, clay, mica, wallastonite, silious earth, chrome oxides, cerium oxides, colcothar, antimony trioxides, magnesium oxides, zirconium oxides, barium sulfates, barium carbonates, calcium carbonates, silicon carbides, and silicon nitrides. Each of these inorganic fine particles may be used alone or in combination with two or more.

The primary particle diameter of the inorganic fine particles is preferably 5 nanometers to 2 μm, and more preferably 5 nanometers to 500 nanometers. The specific surface area of the inorganic fine particles according to the BET method is preferably 20 $m^2/g$ to 500 $m^2/g$.

The amount of the inorganic fine particles used in the toner is preferably 0.01% by mass to 5.0% by mass, and more preferably 0.01% by mass to 2.0% by mass.

The flowability improvers mean those capable of preventing degradation of flowability and charging ability even under high-humidity conditions by subjecting it to a surface treatment to improve hydrophobicity. Examples of the flowability improvers include silane coupling agents, silyl agents, silane coupling agents containing an alkyl fluoride, organic titanate coupling agents, aluminum coupling agents, silicone oils, and modified silicone oils.

The cleaning ability improvers are added to the toner to remove a residual developer remaining on a photoconductor and a primary transferring medium after image transfer. Examples of the cleaning ability improvers include metallic salts of fatty acids such as zinc stearates, calcium stearates, and stearic acids; and polymer fine particles produced by means of soap-free emulsion polymerization such as polymethyl methacrylate fine particles, and polystyrene fine particles. The polymer fine particles preferably have a relatively narrow particle size diameter and an average volume particle diameter of 0.01 μm to 1 μm.

The magnetic materials are not particularly limited, may be suitably selected from those known in the art, and examples thereof include iron powders, magnetites, and ferrites. Among these magnetic materials, white materials are preferably used in terms of color tone.

—Aqueous Medium—

The aqueous medium is not particularly limited, may be suitably selected from those known in the art, and examples thereof include water, water-miscible solvents, and mixtures thereof. Among them, water is particularly preferable.

The water-miscible solvents are not particularly limited as long as it is miscible in water, and examples thereof include alcohols, dimethylformamides, tetrahydrofurans, Cellosolves, and lower ketones.

Examples of the alcohols include methanols, isopropanols, and ethylene glycols. Examples of the lower ketones include acetones, and methyl ethyl ketones.

Each of the above mentioned aqueous mediums may be used alone or in combination with two or more.

As above mentioned, it is required that no organic resin fine particles be included in the aqueous medium.

The dispersion particles are dispersion i.e. oil droplets which comprise the dissolved and dispersed solution of the toner materials which are formed by dissolving and dispersing the toner materials in the aqueous medium, and the composition of the dispersion particles is same as that of the dissolved and dispersed solution of the toner materials. Namely, the dispersion particles include at least any one of the monomer, the polymer, and the polymer capable of reacting with the active hydrogen group-containing compound i.e. prepolymer and further include the other toner material components such as the unmodified polyester resin, the colorant, and the charge controlling agent in accordance with the necessity.

The dispersion particles are formed by dispersing the dissolved and dispersed solution of the toner materials in the aqueous medium, thereby preparing an oil droplet-in-water dispersion.

The volume average particle diameter (Mv) of the dispersion particles is not particularly limited, may be suitable selected in accordance with the intended use, however, the volume average particle diameter (Mv) of the dispersion particles before increasing the volume average particle diameter (Mv) thereof, i.e. when preparing the oil droplet-in-water dispersion is preferably 0.1 μm to 3 μm, more preferably 0.1 μm to 2 μm, and still more preferably 0.1 μm to 1 μm. When the volume average particle diameter (Mv) of the dispersion particles is microscopic, a toner having excellence in charging ability can be granulated, because nonuniformity of toner material composition is not observed in toner particles formed with the dispersion particles, and the charged amount among the toner particles is uniform.

The volume average particle diameter (Mv) of the dispersion particles can be measured using, for example, a particle size distribution analyzer (nanotrac UPA-150EX, manufactured by NIKKISO Co., Ltd.) and analyzed using analyzer software (MicroTrack Particle Size Analyzer Ver. 10.1.2-016EE, manufactured by NIKKISO Co., Ltd.).

First, to a 30 mL glass sample-bottle, the dissolved and dispersed solution of the toner materials, and the solvent used for the dissolved and dispersed solution of the toner materials, for example, ethyl acetate, are added to prepare a 10% by mass dispersion. The obtained dispersion is subjected to a dispersion treatment for 2 minutes using an ultrasonic dispersion apparatus (W-113MK-II, manufactured by HONDA ELECTRONICS Co., Ltd.).

After measuring the background of the sample with the solvent, for example, ethyl acetate, the dispersion that had been subjected to the dispersion treatment is fallen in drops to the sample-bottle, and the particle diameter of the dispersion is measured under a condition that the value of the sample loading measured by the particle size distribution analyzer is ranging from 1 to 10. It is required that the particle diameter of the dispersion be measured under a condition that the value of the sample loading is 1 to 10 from the perspective of measurement reproductivity of the particle diameter of the dispersion. To obtain the value of the sample loading, it is preferred that the dropped amount of the dispersion be appropriately controlled.

In the measurement and the analysis, the measurement and the analyzing conditions are respectively set as follows: Particle distribution display: Volume; particle diameter category: Standard; particle permeability: Permeation; particle shape: Non-spherical shape; number of channels: 44; measurement time: 60 seconds; the number of measurement time: Once; particle refractive index: 1.5; and degree of density: 1 g/cm$^3$.

For the refractive index value of the solvent, refractive indexes of the solvent of the dissolved and dispersed solution of the toner materials, among the values described in "Guideline of Input Conditions in Measurement" (see FIGS. 4A to 4C), for example, ethyl acetate: 1.37, can be used.

The dissolved and dispersed solution of the toner materials is preferably dispersed in the aqueous medium while stirring the dissolved and dispersed solution of the toner materials in the aqueous medium. The dispersion method is not particularly limited and may be suitably selected in accordance with the intended use. For example, the conventional dispersing units may be used. Examples of the dispersing units include low-speed-shear dispersing units, high-speed-shear dispersing units, friction dispersing units, high-pressure-jet dispersing units, and ultrasonic dispersing units. Among them, high-speed-shear dispersing units are preferable in terms of the capability of controlling particle diameter of the dispersion particles from 0.1 μm to 3 μm.

<Intermediate Removal of Organic Solvent>In the intermediate removal of organic solvent, the organic solvent is removed from the dispersion particles before granulating the toner.

In the intermediate removal of organic solvent, heteromorphous particles or indefinitely shaped toner particles which are different from spherically shaped toner particles can be obtained, because the organic solvent is removed till the toner has a desired solid concentration, and then the dispersion particles are made to coalesce to grow up. Since flocculated mass remain in the obtained particles, blade-cleaning ability on a photoconductor can be improved.

In the intermediate removal of organic solvent, the concentration of the organic solvent in the dispersed particle after removal of the organic solvent is preferably 0.5% by mass to 35% by mass, and more preferably 0.5% by mass to 10% by mass.

When the concentration of the organic solvent is less than 0.5% by mass, viscosity of the dispersion particles is increased, the dispersion particles may not be fused even when the dispersion particles flocculate at the time of the granulation, and the particles fracture during the use of the toner. When the concentration of the organic solvent is more than 35% by mass, after granulating the dispersion particles, retention of the particle flocculation state is weaken, and heteromorphous toner particles are formed with the flocculation state retained, the toner excels in cleaning ability, and the loss of shape in toner particles can be prevented in the formation of the toner particles from the flocculated mass.

Examples of the removal method of the organic solvent include (1) a method in which the pressure of the entire reaction system is gradually reduced so as to completely evaporate and remove the organic solvent in the dispersion particles; (2) a method in which the temperature of the entire reaction system is gradually raised so as to completely evaporate and remove the organic solvent in the dispersion particles; and (3) a method in which the oil droplet-in-water dispersion is sprayed in dry atmosphere so as to completely remove the insoluble organic solvent in the dispersed particles.

For the dry atmosphere into which the oil droplet-in-water dispersion is sprayed, heated gases yielded by heating air, nitrogen gas, carbon dioxide gas, combustion gas, and the like, or various flows or streams heated at temperatures higher than the boiling point of a specific solvent having the highest boiling point among the solvents are typically used. It is possible to obtain a satisfactory and desired quality of each of these dry atmospheres in a short time process using a spray dryer, a belt dryer, a rotary kiln, or the like.

In the intermediate removal of organic solvent, it is preferred to produce a toner having a shape factor SF-1 being 120 to 160, and a shape factor SF-2 being 115 to 160.

When the shape factor SF-1 is less than 120 and the SF-2 is less than 115, cleaning ability may degrade. When the SF-1 and the SF-2 are individually more than 160, defective transfers of toner from a photoconductor, intermediate transfer belt, and roller may occur to cause degradation of image quality.

The shape factor SF-1 indicates the degree of roundness or sphericity of toner shape and represented by the following Equation (1). A value of the shape factor SF-1 is the one that a squared-value of the maximum length (MXLNG) of the figure which can be formed by projecting a toner onto a two-dimensional plane is divided by the figure area (AREA) and then multiplied by $100\pi/4$.

$$SF\text{-}1=\{(MXLNG)^2/AREA\}\times(100\pi/4) \qquad \text{Equation (1)}$$

In Equation (1), when the value of the shape factor SF-1 is 100, the shape of the toner is sphere, and with increased value of the shape factor, the toner is formed in more indefinite shape.

The shape factor SF-2 indicates a degree of concaves and convexes of toner shape and represented by the following Equation (2). A value of the shape factor SF-2 is the one that a squared-value of the peripheral length (PERI) of the figure which can be formed by projecting a toner onto a two-dimensional plane is divided by the figure area (AREA) and then multiplied by $100\pi/4$.

$$SF\text{-}2=\{(PERI)^2/AREA\}\times(100\pi/4) \qquad \text{Equation (2)}$$

In Equation (2), when the value of the shape factor SF-2 is 100, there is no concave and convex on toner surface, and with increased value of the shape factor SF-2, the concaves and convexes on toner surfaces are more conspicuous.

Specifically, the shape factors can be measured using a field emission type scanning electron microscope (S-4500, manufactured by Hitachi Ltd.) to take a toner picture with an accelerating voltage of 8 kV and a lens magnification at 2,000×, and then the picture is scanned into an image analyzer (LUSEX3: manufactured by NIRECO Corp.) to analyze the picture and calculate the shape factors.

<Granulation of Toner>

In the granulation of toner, organic resin fine particles are added to the oil droplet-in-water dispersion to granulate a toner in the presence of the organic resin fine particles.

In the preparation of the oil droplet-in-water dispersion, microscopic dispersion particles can be obtained by not including the organic resin fine particles in the aqueous medium, and in the granulation of toner, the toner shape and the particle size distribution can be controlled, and a toner having a narrow particle size distribution can be obtained.

—Organic Resin Fine Particles—

The organic resin fine particles are not particularly limited and may be suitably selected from resins known in the art as long as it is a resin capable of forming an aqueous dispersion in the oil droplet-in-water-dispersion. The organic resin fine particles may be plastic resin or thermosetting resins, and examples thereof include vinyl resin, polyurethane resin, epoxy resin, polyester resin, polyamide resin, polyimide resin, silicone resin, phenol resin, melamine resin, urea resin, anilline resin, ionomer resin, polycarbonate resin. These may be selected singly or in combination with two or more, for use as the fine resin particles. Among these examples, the resin particles are preferably formed of one selected from the vinyl resin, polyurethane resin, epoxy resin, and polyester resin in view of an easy formation of aqueous dispersion of fine and spherical resin particles.

The vinyl resin is a polymer in which vinyl monomer is mono-or co-polymerized. Examples of the vinyl resin include styrene-(meth)acrylic ester resins, styrene-butadiene1 copolymers, (metha)acrylic acid-acrylic ester copolymers, sthrene-acrylonitrile copolymers, styrene-maleic anhydride copolymers, and styrene-(metha)acrylic acid copolymers.

Further, the organic resin fine particles may be formed of copolymer containing a monomer having two or more unsaturated groups. The monomer having two or more unsaturated groups is not particularly limited, and can be selected in accordance with the intended use. Examples of such a monomer include sodium salt of sulfuric acid ester of ethylene oxide adduct of methacrylic acid (Eleminol RS-30, manufactured by Sanyo Chemical Industries Co.), divinylbenzene, and hexane-1,6-diol acrylate.

The organic resin fine particles are formed by polymerizing the above-listed monomers in accordance with a method appropriately selected from conventional methods. The fine resin particles are preferably obtained in the form of aqueous dispersion of the resin particles. Examples of preparation method of such an aqueous dispersion include the following (1)-(8):

(1) a preparation method of aqueous dispersion of the resin particles, in which, in the case of the vinyl resin, a vinyl monomer as a starting material is polymerized by suspension-polymerization method, emulsification-polymerization method, seed polymerization method or dispersion-polymerization method;

(2) a preparation method of aqueous dispersion of the resin particles, in which, in the case of the polyaddition and/or condensation resin such as the polyester resin, the polyurethane resin, or the epoxy resin, a precursor (monomer, oligomer or the like) or solvent solution thereof is dispersed in an aqueous medium in the presence of an appropriate dispersing agent, and sequentially is heated or added with a curing agent so as to be cured, thereby obtaining the aqueous dispersion of the resin particles;

(3) a preparation method of aqueous dispersion of the resin particles, in which, in the case of the polyaddition and/or condensation resin such as the polyester resin, the polyurethane resin, or the epoxy resin, an arbitrary selected emulsifier is dissolved in a precursor (monomer, oligomer or the like) or solvent solution thereof (preferably being liquid, or being liquidized by heating), and then water is added thereto so that a phase inversion emulsification is induced, thereby obtaining the aqueous dispersion of the resin particles;

(4) a preparation method of aqueous dispersion of the fine resin particles, in which a previously prepared resin by a polymerization method, which is any of addition polymerization, ring-opening polymerization, polyaddition, addition condensation or condensation polymerization, is pulverized by means of a pulverizing mill such as mechanical rotation-type, jet-type or the like, the thus obtained resin powder is classified to thereby obtain resin particles, and then the resin particles are dispersed in an aqueous medium in the presence of an arbitrary selected dispersing agent, thereby obtaining the aqueous dispersion of the resin particles;

(5) a preparation method of aqueous dispersion of the resin particles, in which a previously prepared resin by a polymerization method, which is any of addition polymerization, ring-opening polymerization, polyaddition, addition condensation or condensation polymerization, is dissolved in a solvent to thereby obtain a resin solution, the resin solution is sprayed in the form of mist to thereby obtain resin particles, and then the thus obtained resin particles are dispersed in an aqueous medium in the presence of an arbitrary selected dispersing agent, thereby obtaining the aqueous dispersion of the resin particles;

(6) a preparation method of aqueous dispersion of the resin particles, in which a previously prepared resin by a polymerization method, which is any of addition polymerization, ring-opening polymerization, polyaddition, addition condensation or condensation polymerization, is dissolved in a solvent to thereby obtain a resin solution, the resin solution is subjected to precipitation by adding a poor solvent thereto or cooling after heating and dissolving, the solvent is sequentially removed to thereby obtain resin particles, and then the thus obtained fine resin particles are dispersed in an aqueous medium in the presence of an arbitrary selected dispersing agent, thereby obtaining the aqueous dispersion of the resin particles;

(7) a preparation method of aqueous dispersion of the resin particles, in which a previously prepared resin by a polymerization method, which is any of addition polymerization, ring-opening polymerization, polyaddition, addition condensation or condensation polymerization, is dissolved in a solvent to thereby obtain a resin solution, the resin solution is dispersed in an aqueous medium in the presence of an arbitrary selected dispersing agent, and then the solvent is removed by heating or reduced pressure to thereby obtain the aqueous dispersion of the resin particles;

(8) a preparation method of aqueous dispersion of the resin particles, in which a previously prepared resin by a polymerization method, which is any of addition polymerization, ring-opening polymerization, polyaddition, addition condensation or condensation polymerization, is dissolved in a solvent to thereby obtain a resin solution, an arbitrary selected emulsifier is dissolved in the resin solution, and then water is added to the resin solution so that phase inversion emulsification is induced, thereby obtaining the aqueous dispersion of the resin particles.

For the organic fine particles, depending on the added amount thereof, the particle diameter of the toner can be changed, and the added amount of the organic resin fine particles used in the oil droplet-in-water dispersion is not particularly limited and may be suitably selected in accordance with the intended use. For example, it is preferably 0.5% by mass to 10% by mass.

In the granulation of the toner, a water dispersion of a wax (wax dispersion) is preferably added to the oil droplet-in-water dispersion along with the organic resin fine particles. By adding the water dispersion of the wax (wax dispersion) to the oil droplet-in-water dispersion after the preparation of the organic resin fine particles (after forming the dispersion particles), the wax particles can be uniformly dispersed in the toner without using a dispersing agent or the like, and it is possible to make the wax particles moderately reside on the surface of the toner as well as to prevent uneven distribution of the wax particles in the toner particles and to form a toner which excels in releasing property and charging ability. Consequently, it is possible to prevent occurrence of toner filming to photoconductors.

Wax-Water Dispersion

The water dispersion of wax (wax dispersion) is prepared by dispersing the wax in the aqueous medium. The volume average particle diameter (Mv) of the dispersion particles of the wax in the water dispersion of the wax (wax dispersion) is not particularly limited and may be suitably selected in accordance with the intended use, however, it is preferred to be microscopic. For example, it is preferably 0.1 μm to 2 μm, and more preferably 0.1 μm to 1 μm. When the volume average particle diameter of the dispersion particles of the wax is less than 0.1 μm, releasing property of the toner may not be sufficiently obtained. When the volume average particle diameter is more than 2 μm, uniform dispersibility of the wax in the toner may degrade.

The melting point of the wax is not particularly limited, may be suitably selected in accordance with the intended use, however, the wax preferably has a low melting point in terms of low-temperature fixing property. For example, the melting point is preferably 50° C. to 90° C., and more preferably 60° C. to 85° C.

When the melting point is less than 50° C., the wax may adversely affect heat resistant storage stability, and when the melting point is more than 90° C., cold-offset may be liable to occur at the time of fixing at low-temperatures.

The melting point (Tm) of the wax is determined by the peaked point of the maximum endothermic amount shown in a differential scanning calorimetry (DSC) curb which is obtained by performing the differential scanning calorimetry (DSC) based on the following measurement conditions using TA-60WS and DSC-60 manufactured by SHIMADZU Corp.

Namely, an aluminum sample pan (with a lid) is used as a sample vessel. To the sample vessel, 5 mg of the wax is added as the sample amount, and another aluminum sample pan is used for 10 mg of alumina as a reference to measure the sample in the presence of nitrogen atmosphere at a flow rate of 50 mL/minutes. For the temperature conditions, the temperature of the sample is raised from 20° C. as the beginning temperature at a rate of temperature rise of 10° C./minute to 150° C. of the end temperature, and then with no retention time, the temperature of the sample is lowered at a rate of temperature decrease of 10° C./minute to 20° C. as the end temperature, and further with no retention time, the temperature of the sample is raised again at a rate of temperature rise of 10° C./minute to 150° C. as the end temperature.

The measurement result obtained under the measurement conditions can be analyzed by using data analyzer software (TA-60 Version 1.52, manufactured by SHIMADZU Corp.). For the detailed analyzing method, centering on the maximum peak point in the DrDSC curve which is the DSC derivative curve of the second time temperature raise, the maximum peak point±5° C. is designated as the range to obtain the peaked temperature of the sample using the peak analyzing function of the analyzer software. Next, the maximum endothermic temperature in the DSC curve of the sample in the range +5° C. to −5° C. is obtained using the peak analyzing function of the analyzer software. The temperature indicated by the analyzer software corresponds to the melting point (Tm) of the wax.

The wax is not particularly limited as long as it can be dispersed in the aqueous medium and may be suitably selected in accordance with the intended use. Examples of the wax include long-chain hydrocarbons, carbonyl group-containing waxes, and polyolefin waxes. Each of these waxes may be used alone or in combination with two or more. Among them, long-chain hydrocarbons are preferably used.

Examples of the long-chain hydrocarbons include paraffin waxes, and Sasol Wax. Of these long-chain hydrocarbons, paraffin waxes having a low melting point are preferable in terms of improvement of low-temperature fixing property.

Examples of the carbonyl group-containing waxes include polyalkanoic esters, polyalkanol esters, polyalkanoic acid amides, polyalkyl amides, and dialkyl ketones. Examples of the polyalkanoic ester include carnauba waxes, montan waxes, trimethylolpropane tribehenate, pentaerythritol tetrabehenate, pentaerythritol diacetate dibehenate, glycerin tribehenate, and octadecan-1,18-diol distearate. Examples of the polyalkanol ester include trimellitic tristearates, and distearyl maleates. Examples of the polyalkanoic acid amide include behenyl amides. Examples of the polyalkyl amide include trimellitic acid tristearyl amides. Examples of the dialkyl ketone include distearyl ketones. Of these carbonyl group-containing waxes, the polyalkanoic esters are particularly preferable.

Examples of the polyolefin wax include polyethylene waxes, and polypropylene waxes.

As described above, the was is required to be added as a water dispersion, however, the wax may be included in the dissolved and dispersed solution of the toner materials to be dispersed in the dissolved and dispersed solution for use. By making several types of the waxes contained in a toner, it is possible to impart versatility to the toner.

The content of the wax used in the toner is not particularly limited and may be suitably selected in accordance with the intended use, however, it is preferably 0% by mass to 40% by mass, and more preferably 3% by mass to 30% by mass.

When the content is more than 40% by mass, flowability of the toner may degrade.

In the granulation of the toner, it is preferred that the volume average particle diameter (Mv) of the dispersion particles obtained in the preparation of the oil droplet-in-water dispersion be increased and then to granulate a toner. The increased volume average particle diameter of the dispersion particles needs to be lager than that of the dispersion particles before the increasing the volume average particle diameter. In the preparation of oil droplet-in-water-dispersion, after obtaining dispersion particles having a microscopic volume average particle diameter, the volume average particle diameter of the dispersion particles is increased and then to granulate a toner. With the above processes, it is possible to obtain a toner having a uniform and homogenous composition of materials among toner particles, excelling in charge stability without substantially causing fog and toner scattering, and having a small particle diameter and a narrow particle size distribution.

Specifically, it is preferred that the volume average particle diameter (Mv) of the dispersion particles obtained through the preparation of oil droplet in-water-dispersion be increased to 3 times to 45 times and then to granulate the toner, and it is preferable that the volume average particle diameter (Mv) be increased to 3 times to 30 times.

When the volume average particle diameter (Mv) of the dispersion particles is increased to less than 3 times the primary volume average particle diameter, uniformity of the toner material composition among toner particles may degrade. When the volume average particle diameter (Mv) is increased to more than 45 times the primary volume average particle diameter, it is difficult to granulate the toner, which may cause degraded particle size distribution and deteriorations of images.

Specifically, it is preferred that the volume average particle diameter (Mv) of the dispersion particles obtained through the preparation of oil droplet-in-water dispersion be increased to 3 μm to 9 μm and then to granulate the toner. More preferably, the volume average particle diameter (Mv) be increased to almost the same volume average particle diameter of the toner particles.

To increase the volume average particle diameter of the dispersion particles, it is preferred to add an ionizing agent along with the organic resin fine particles when adding the organic resin fine particles. By adding the ionizing agent, it is possible to make the dispersion particles coalesce each other as well as to make the dispersion particles grow to be a desired particle diameter.

The ionizing agent is not particularly limited as long as the dispersion particles can be flocculated and may be suitably selected in accordance with the intended use, however, the ionizing agent is preferably at least one selected from salts comprising a monovalent cation and a monovalent anion.

The monovalent cation in the salts comprising a monovalent cation and a monovalent anion is not particularly limited and may be suitably selected in accordance with the intended use. For example, sodium ions, and potassium ions are preferable.

Thus, specific preferred examples of the ionizing agent include sodium chlorides, potassium chlorides, sodium hydroxides, and potassium hydroxides.

In the preparation of the oil droplet-in-water-dispersion, when the stirring rate at the time of dispersing the dissolved and dispersed solution of the toner materials in the aqueous medium is represented as Am/s, and the stirring rate at the time of granulating the toner is represented as Bm/s, it is preferable that the following expressions be satisfied:

$$7<A<23, \text{ and } 1.4<B<100$$

When the stirring rate A of the dispersion satisfies the expression, dispersion particles having a desired microscopic particle diameter can be obtained. In addition, in relation to the stirring rate B at the time of granulating the toner, when the values A and B satisfy the expressions, the particle diameter of the dispersion particles can be controlled to increase it to a desired particle diameter, and it is possible to obtain a toner having a homogenous composition of materials among toner particles, excelling in charge stability without substantially causing fog and toner scattering, and having a small particle diameter and a narrow particle size distribution. Namely, when dispersing the dissolved and dispersed solution of the toner materials in the aqueous medium, the dispersion particles can be formed by setting the stirring rate faster, and before granulating the toner, it is possible to make the dispersion particles coalesce each other to increase the volume average particle diameter of the dispersion particles.

In a preferred aspect of the toner production method of the present invention, when the active hydrogen-group-containing compound and the polymer capable of reacting with the active hydrogen group-containing compound are subjected to an elongation reaction and a cross-linking reaction in the preparation of the oil droplet-in-water dispersion and the granulation of toner, a binder resin is formed.

—Adhesive Base Material—

The adhesive base material has adhesiveness to recording medium such as paper, contains at least an adhesive polymer which is produced by reacting the active hydrogen group-containing compound with the polymer capable of reacting with the active hydrogen group-containing compound in the aqueous medium, and may further comprise a binder resin suitably selected from binder resins known in the art.

The mass average molecular mass (Mw) of the adhesive base material is not particularly limited and may be suitably selected in accordance with the intended use. For example, the mass average molecular mass (Mw) is preferably 3,000 or more, more preferably 5,000 to 1,000,000, and particularly preferably 7,000 to 500,000.

The mass average molecular mass (Mw) is less than 3,000, anti-hot-offset property may degrade.

The glass transition temperature of the adhesive base material (Tg) is not particularly limited and may be suitably selected in accordance with the intended use, for example, it is preferably 30° C. to 70° C., and more preferably 40° C. to 65° C.

In the toner, by making a polyester resin that have been subjected to a cross-linking reaction and an elongation reaction exist together, the toner enables exhibiting excellent storage stability even with lower glass transition temperatures, compared to that of the conventional polyester toners.

When the glass transition temperature (Tg) is less than 30° C., heat resistant storage stability of the toner may degrade, when the glass transition temperature (Tg) is more than 70° C., sufficient low-temperature fixing property may not be obtained.

The glass transition temperature (Tg) of the adhesive base material can be measured based on the following measurement conditions using TA-60WS and DSC-60 manufactured by SHIMADZU Corp.

Namely, an aluminum sample pan (with a lid) is used as a sample vessel. To the sample vessel, 5 mg of the adhesive base material is added as the sample amount, and another aluminum sample pan is used for 10 mg of alumina as a reference to measure the sample in the presence of nitrogen atmosphere at a flow rate of 50 mL/minutes. For the temperature conditions, the temperature of the sample is raised from 20° C. as the beginning temperature at a rate of temperature rise of 10° C./minute to 150° C. of the end temperature, and then with no retention time, the temperature of the sample is lowered at a rate of temperature decrease of 10° C./minute to 20° C. as the end temperature, and further with no retention time, the temperature of the sample is raised again at a rate of temperature rise of 10° C./minute to 150° C. as the end temperature.

The measurement result obtained under the measurement conditions can be analyzed by using data analyzer software (TA-60 Version 1.52, manufactured by SHIMADZU Corp.). For the detailed analyzing method, centering on the maximum peak point on the lowest temperature side in the DrDSC curve which is the DSC derivative curve of the second time temperature raise, the maximum peak point±5° C. is designated as the range to obtain the peaked temperature of the sample using the peak analyzing function of the analyzer software. Next, the maximum endothermic temperature in the DSC curve of the sample in the range +5° C. to −5° C. is obtained using the peak analyzing function of the analyzer software. The temperature indicated by the analyzer software corresponds to the glass transition temperature (Tg) of the adhesive base material.

The glass transition temperature can be measured based on the following method using, for example, TG-DSC system TAS-100 (manufactured by Rigaku Corporation). First, approx. 10 mg of toner is placed in an aluminum sample vessel, the sample vessel is placed on the sample-holder unit to be set in an electric furnace. The temperature of the sample is raised from room temperature to 150° C. at a rate of temperature rise of 10° C./minute, then left at 150° C. for 10 minutes. The sample is then cooled down to room temperature and left as it is for 10 minutes. Thereafter, the sample is heated to 150° C. at a rate of temperature rise of 10° C./minute in the presence of nitrogen atmosphere to measure the differential scanning calorimetry (DSC) curve using a differential scanning calorimeter. Based on the obtained DSC curve, the glass transition temperature (Tg) of the sample can be calculated from the contact point between the tangent to the endothermic curve near the glass transition temperature (Tg) and the base line.

The adhesive base material is not particularly limited, may be suitably selected in accordance with the intended use, and particularly, preferred examples thereof include polyester resins.

The polyester resin is not particularly limited, may be suitably selected in accordance with the intended use, and particularly, preferred examples thereof include urea-modified polyester resins.

The urea modified polyester which is obtained by reacting (B) amines as the active hydrogen-containing compound, and (A) a polyester prepolymer having an isocyanate group as the polymer capable of reacting with the active hydrogen-containing compound in the aqueous medium phase.

In addition, the urea modified polyester may include a urethane bond as well as a urea bond. A molar ratio of the urea bond content to the urethane bond content is preferably 100/0 to 10/90, more preferably 80/20 to 20/80, and further more preferably 60/40 to 30/70. When a molar ratio of the urea bond is less than 10, it is liable to adversely affects on hot-offset resistance.

Specific examples of the urea-modified polyester are preferably the following (1)-(10):

(1) A mixture of (i) polycondensation product of bisphenol A ethyleneoxide dimolar adduct and isophthalic acid, and (ii) urea-modified polyester prepolymer which is obtained by reacting isophorone disocyanate with a polycondensation product of bisphenol A ethyleneoxide dimolar adduct and isophtalic acid so as to form polyester prepolymer, and modifying the polyester prepolymer with isophorone diamine;

(2) A mixture of (iii) a polycondensation product of bisphenol A ethyleneoxide dimolar adduct and terephthalic acid, and (ii) urea-modified polyester prepolymer which is obtained by reacting isophorone disocyanate with a polycondensation product of bisphenol A ethyleneoxide dimolar adduct and terephthalic acid so as to form polyester prepolymer, and modifying the polyester prepolymer with isophorone diamine;

(3) A mixture of (iv) polycondensation product of a bisphenol A ethyleneoxide dimolar adduct, a bisphenol A propyleneoxide dimolar adduct and terephthalic acid, and (v) urea-modified polyester prepolymer which is obtained by reacting isophorone disocyanate with a polycondensation product of a bisphenol A ethyleneoxide dimolar adduct, a bisphenol A propyleneoxide dimolar adduct and terephthalic acid so as to form polyester prepolymer, and modifying the polyester prepolymer with isophorone diamine;

(4) A mixture of (vi) polycondensation product of a bisphenol A propyleneoxide dimolar adduct and terephthalic acid, and (v) urea-modified polyester prepolymer which is obtained by reacting isophorone disocyanate with a polycondensation product of a bisphenol A ethyleneoxide dimolar adduct, a bisphenol A propyleneoxide dimolar adduct and terephthalic acid so as to form polyester prepolymer, and modifying the polyester prepolymer with isophorone diamine;

(5) A mixture of (iii) polycondensation product of a bisphenol A ethyleneoxide dimolar adduct and terephthalic acid, and (vii) urea-modified polyester prepolymer which is obtained by reacting isophorone disocyanate with a polycondensation product of a bisphenol A ethyleneoxide dimolar adduct and terephthalic acid so as to form polyester prepolymer, and modifying the polyester prepolymer with hexamethylene diamine;

(6) A mixture of (iv) polycondensation product of a bisphenol A ethyleneoxide dimolar adduct, a bisphenol A propyleneoxide dimolar adduct and terephthalic acid, and (vii) urea-modified polyester prepolymer which is obtained by reacting isophorone disocyanate with a polycondensation product of a bisphenol A ethyleneoxide dimolar adduct and terephthalic acid so as to form polyester prepolymer, and modifying the polyester prepolymer with hexamethylene diamine;

(7) A mixture of (iii) polycondensation product of a bisphenol A ethyleneoxide dimolar adduct and terephthalic acid, and (viii) urea-modified polyester prepolymer which is obtained by reacting isophorone disocyanate with a polycondensation product of a bisphenol A ethyleneoxide dimolar adduct and terephthalic acid so as to form polyester prepolymer, and modifying the polyester prepolymer with ethylene diamine;

(8) A mixture of (i) polycondensation product of a bisphenol A ethyleneoxide dimolar adduct and isophthalic acid, and (ix) urea-modified polyester prepolymer which is obtained by reacting diphenylmethane disocyanate with a polycondensation product of a bisphenol A ethyleneoxide dimolar adduct and isophthalic acid so as to form polyester prepolymer, and modifying the polyester prepolymer with hexamethylene diamine;

(9) A mixture of (iv) polycondensation product of a bisphenol A ethyleneoxide dimolar adduct, a bisphenol A propyleneoxide dimolar adduct and terephthalic acid, and (x) urea-modified polyester prepolymer which is obtained by reacting diphenylmethane disocyanate with a polycondensation product of a bisphenol A ethyleneoxide dimolar adduct/bisphenol A propyleneoxide dimolar adduct and terephthalic acid/dodecenylsuccinic anhydride so as to form polyester prepolymer, and modifying the polyester prepolymer with hexamethane diamine;

(10) A mixture of (i) polycondensation product of a bisphenol A ethyleneoxide dimolar adduct and isophthalic acid, and (xi) urea-modified polyester prepolymer which is obtained by reacting toluene disocyanate with a polycondensation product of a bisphenol A ethyleneoxide dimole adduct and isophthalic acid so as to form polyester prepolymer, and modifying the polyester prepolymer with hexamethane diamine.

—Binder Resin—

The binder resin is not particularly limited, and may be suitably selected in accordance with the intended use. Examples of the binder resin include polyesters. Of these examples, unmodified polyester (polyester which is not modified) is particularly preferable.

By containing the unmodified polyester in the toner, the toner can realize improved low-temperature fixing properties and glossiness.

Examples of the unmodified polyester include resins each of which are equivalent to the polyester resin containing a group capable of generating urea bonding (RMPE), i.e., polycondensation product of polyols (PO) and polycarboxylic acids (PC). The unmodified polyester is preferably compatible with the polyester resin containing a group capable of generating urea bonding (RMPE) at part thereof, i.e., having a similar polymeric structure which allow to be compatible, in view of low-temperature fixing properties and hot-offset resistance.

The mass average molecular mass (Mw) of the non-polyester is preferably 1,000 to 30,000, and more preferably 1,500 to 15,000 in terms of a molecular mass distribution of a tetrahydrofuran (THF) soluble part measured by means of gel permeation chromatography (GPC).

When the mass average molecular mass (Mw) is less than 1,000, it is liable to degrade heat resistance preservation. Therefore, the amount of the unmodified polyester having a mass average molecular mass is 8% by mass to 28% by mass. When mass average molecular mass (Mw) is more than 30,000, it is liable to degrade low-temperature fixing properties.

The mass average molecular mass (Mw) of the unmodified polyester resin can be measured using a gel permeation chromatography (GPC) measurement device (GPC-8220GPC, manufactured by TOSOH CORPORATION) based on the following measurement conditions:

Using a triple column having a length of 15 cm (TSKgel SuperHZM-H, manufactured by TOSOH CORPORATION) to set the temperature at 40° C., tetrahydrofuran (THF) is streamed as a solvent at a flow rate of 0.35 mL/minute, and 100 mL of a 0.15% by mass of sample solution (a polymer capable of reacting with the active hydrogen group-containing compound) is poured to the column to measure the mass average molecular mass (Mw) of the polymer capable of reacting with the active hydrogen group-containing compound. It should be noted that as a preliminary treatment, 0.4 mL of the 0.15% by mass sample solution is dissolved in tetrahydrofuran (THF) (containing stabilizer, manufactured by Wako Pure Chemical Industries, Ltd.) so as to be 0.15% by mass, and the solution is passed through a filter with a mesh of 0.21 μm to obtain a filtrate. The filtrate is used as the sample solution.

In the measurement of the molecular mass of the sample, the molecular mass distribution of the sample is calculated based on the relation between logarithm values of the analytical curve prepared using several monodispersed polystyrene standard samples and count values. For the standard polystyrene samples for preparing the analytical curve, No S-7300, s-210, S-390, S-875, S-1980, S-10.9, S-629, S-3.0, S-0.580 of ShowdexSTANDARD available from SHOWA DENKO K.K., and toluene are used. For the detector, a refractive index (RI) detector is used.

The glass transition temperature of the unmodified polyester is 30° C. to 70° C., preferably 35° C. to 70° C., more preferably 35° C. to 70° C., and particularly preferably 35° C. to 45° C. When the glass transition temperature is lower than 30° C., it is liable to degrade heat resistance preservation of the toner. When the glass transition temperature is higher than 70° C., it is liable to degrade lower-temperature fixing properties.

The hydroxyl value of the unmodified polyester is 5 mg KOH/g or more, preferable 10 mg KOH/g to 120 mg KOH/g, and more preferably 20 mg KOH/g to 80 mg KOH/g. When the hydroxyl value is less than 5 mg KOH/g, it becomes difficult to achieve both heat resistance preservation and low-temperature fixing properties.

The acid value of the unmodified polyester is typically 1.0 mg KOH/g to 30.0 mg KOH/g, and preferably 5.0 mg KOH/g to 20.0 mg KOH/g. By imparting the acid value to the toner, the toner is generally liable to be negatively chargeable.

When the hydroxyl value and the acid value are outside the ranges, the toner is liable to be affected by the fluctuation of the environment, especially under high-temperature high-humidity or low-temperature low-humidity environment, and thus the formed image may be degraded.

When the unmodified polyester is contained in the toner, a mass ratio (RMPE/PE) of the urea-modified polyester (RMPE) to the unmodified polyester (PE) is 5/95 to 25/75, and preferably 10/90 to 25/75.

When the mass ratio of the unmodified polyester (PE) is more than 95, it is liable to degrade offset resistance. When the mass ratio of the unmodified polyester is less than 75, it is liable to degrade glossiness.

The adhesive-base material (e.g. the urea-modified polyester) is formed, for example, by the following method (1)-(3):

(1) the oil phase the polymer capable of reacting with the active hydrogen group-containing compound (e.g. (A) polyester prepolymer containing an isocyanate group) is emulsified and/or dispersed in the aqueous medium phase together with the active hydrogen group-containing compound so as to form the dispersed droplets, and then the active hydrogen group-containing compound and the polymer capable of reacting with the active hydrogen group-containing compound are subjected to elongation and/or crosslinking reaction in the aqueous medium phase;

(2) the oil phase is emulsified and/or dispersed in the aqueous medium phase previously added with the active hydrogen group-containing compound to form the dispersed droplets, and then the active hydrogen group-containing compound and the polymer capable of reacting with the active hydrogen group-containing compound are subjected to elongation and/or crosslinking reaction in the aqueous medium phase;

(3) the oil phase is added and mixed in the aqueous medium phase, the active hydrogen group-containing compound is sequentially added thereto so as to form the dispersed droplets, and then the active hydrogen group-containing compound and the polymer capable of reacting with the active hydrogen group-containing compound are subjected to elongation and/or cross-linking reaction at an interface of dispersion particles in the aqueous medium phase.

In the case of the method (3), it should be noted that modified polyester is initially formed from a surface of the thus obtained toner particles, and thus it is possible to form a contrast of the modified polyester in the toner particles.

Conditions for forming the adhesive-base material by the emulsifying and/or dispersing are not particularly limited, and can be appropriately adjusted in accordance with a combination of the active hydrogen group-containing compound and the polymer capable of reacting therewith. A suitable reaction time is preferable 10 minutes to 40 hours, and more preferably 2 hours to 24 hours. A suitable reaction temperature is preferably 0° C. to 150° C., and more preferably 40° C. to 98° C.

A suitable formation of the dispersed droplets containing the active hydrogen group-containing compound and the polymer capable of reacting with the active hydrogen group-containing compound (e.g. the (A) polyester prepolymer containing an isocyanate group) in the aqueous medium phase is realized by, to the aqueous medium phase, adding the oil phase in which the toner material such as the polymer (e.g. the (A) polyester prepolymer containing an isocyanate group), the colorant, the charge controlling agent, the unmodified polyester and the like are dissolved and/or dispersed in the organic solvent, and dispersing by a shear force.

In course of the emulsification and dispersing, the usage amount of the aqueous medium phase is preferably 50 parts by mass to 2,000 parts by mass, and more preferably 100 parts by mass to 1,000 parts by mass with respect to the 100 parts by mass of the toner material.

When the usage amount of less than 50 parts by mass, the toner material is not desirably dispersed, and thus toner particles having a predetermined particle diameter are rarely obtained. When the usage amount is more than 2,000 parts by mass, on the other hand, the production cost is liable to increase.

In course of the emulsification and dispersing, a dispersing agent is preferably used in accordance with the necessity in order to sharpen the particle size distribution and to stably perform a dispersing procedure.

The dispersing agent is not particularly limited, and may be suitably selected in accordance with the intended use. Suitable examples of the dispersing agent include surfactants, water-insoluble inorganic dispersing agents, and polymeric protective colloids. These dispersing agents may be used alone or in combination with two or more.

Examples of the surfactant include anionic surfactants, cationic surfactants, nonionic surfactants, and ampholytic surfactants.

Examples of the anionic surfactant include alkylbenzene sulfonic acid salts, α-olefin sulfonic acid salts, and phosphoric acid salts. Among these, the anionic surfactant having a fluoroalkyl group is preferable.

Examples of the anionic surfactant having a fluoroalkyl group include fluoroalkyl carboxylic acid having 2-10 carbon atoms or a metal salt thereof, disodium perfluorooctanesulfonylglutamate, sodium-3-{omega-fluoroalkyl($C_6$ to $C_{11}$)oxy}-1-alkyl($C_3$ to $C_4$)sulfonate, sodium-3-{omega-fluoroalkanoyl($C_6$ to $C_8$)-N-ethylamino}-1-propanesulfonate, fluoroalkyl($C_{11}$ to $C_{20}$)carboxylic acid or a metal salt thereof, perfluoroalkyl($C_7$ to $C_{11}$)carboxylic acid or a metal salt thereof, perfluoroalkyl($C_4$ to $C_{12}$)sulfonic acid or a metal salt thereof, perfluorooctanesulfonic acid diethanol amide, N-propyl-N-(2-hydroxyethyl)perfluorooctanesulfone amide, perfluoroalkyl($C_6$ to $C_{10}$)sulfoneamidepropyltrimethylammonium salt, salts of perfluoroalkyl($C_6$ to $C_{10}$)-N-ethylsulfonyl glycin, and monoperfluoroalkyl($C_6$ to $C_{16}$)ethylphosphate. Examples of the commercially available surfactant having a fluoroalkyl group include Surflon S-111, S-112 and S-113 (manufactured by Asahi Glass Co.); Frorard FC-93, FC-95, FC-98 and FC-129 (manufactured by Sumitomo 3M Ltd.); Unidyne DS-101 and DS-102 (manufactured by Daikin Industries, Ltd.); Megafac F-110, F-120, F-113, F-191, F-812 and F-833 (manufactured by Dainippon Ink and Chemicals, Inc.); ECTOP EF-102, 103, 104, 105, 112, 123A, 123B, 306A, 501, 201 and 204 (manufactured by Tohchem Products Co.); Futargent F-100 and F150 (manufactured by Neos Co.).

Examples of the cationic surfactant include amine salts, and quaternary amine salts. Examples of the amine salt include alkyl amine salts, aminoalcohol fatty acid derivatives, polyamine fatty acid derivatives, and imidazolines. Examples of the quaternary ammonium salts include alkyltrimethyl ammonium salts, dialkyldimethyl ammonium salts, alkyldimethyl benzyl ammonium salts, pyridinium salts, alkyl isoquinolinium salts, and benzethonium chlorides. Among these, preferable examples include primary, secondary or tertiary aliphatic amines having a fluoroalkyl group, aliphatic quaternary ammonium salts such as perfluoroalkyl($C_6$ to $C_{10}$) sulfoneamidepropyltrimethylammonium salts, benzalkonium salts, benzetonium chlorides, pyridinium salts, and imidazolinium salt. Specific examples of the commercially available product thereof include Surflon S-121 (manufactured by Asahi Glass Co.), Frorard FC-135 (manufactured by Sumitomo 3M Ltd.), Unidyne DS-202 (manufactured by Daikin Industries, Ltd.), Megaface F-150 and F-824 (manufactured by Dainippon Ink and Chemicals, Inc.), Ectop EF-132 (manufactured by Tohchem Products Co.), and Futargent F-300 (manufactured by Neos Co.).

Examples of the nonionic surfactant include fatty acid amide derivatives, and polyhydric alcohol derivatives.

Examples of the ampholytic surfactant include alanine, dodecyldi(aminoethyl)glycin, di(octylaminoethyle)glycin, and N-alkyl-N,N-dimethylammonium betaine.

Examples of the water-insoluble inorganic dispersing agent include tricalcium phosphates, calcium carbonates, titanium oxides, colloidal silicas, and hydroxyl apatites.

Examples of the polymeric protective colloid include acids, (meth)acryl monomers having a hydroxyl group, vinyl alcohols or esters thereof, esters of vinyl alcohol and compounds having a carboxyl group, amide compounds or methylol compounds thereof, chlorides, monopolymers or copolymers having a nitrogen atom or heterocyclic ring thereof, polyoxyethylenes, and celluloses.

Examples of the acid include acrylic acids, methacrylic acids, α-cycnoacrylic acids, α-cycnomethacrylic acids, itaconic acids, crotonic acids, fumaric acids, maleic acids, and maleic anhydrides. Examples of the (meth)acryl monomer having a hydroxyl group include β-hydroxyethyl acrylates, β-hydroxyethyl methacrylates, β-hydroxypropyl acrylates, β-hydroxypropyl methacrylates, γ-hydroxypropyl acrylates, γ-hydroxypropyl methacrylates, 3-chloro-2-hydroxypropyl acrylates, 3-chloro-2-hydroxypropyl methacrylates, diethylene glycol monoacrylates, diethylene glycol monomethacrylates, glycerin monoacrylates, glycerin monomethacrylates, N-methylol acrylamides, and N-methylol methacrylamides. Examples of the vinyl alcohol or ester or vinyl alcohol include vinyl methyl ethers, vinyl ethyl ethers, and vinyl propyl ethers. Examples of the ester of vinyl alcohol and compounds having a carboxyl group include vinyl acetates, vinyl propionates, and vinyl butyrates. Examples of the amide compound or methylol compound thereof include acryl amides, methacryl amides, diacetone acrylic amide acids, or methylol thereofs. Examples of the chloride include acrylic chlorides, and methacrylic chlorides. Examples of the monopolymers or copolymers having a nitrogen atom or heterocyclic ring thereof, include vinyl pyridines, vinyl pyrrolidones, vinyl imidazoles, and ethylene imines. Examples of the polyoxyethylene include polyoxyethylenes, polyoxypropylenes, polyoxyethylene alkylamines, polyoxypropylene alkylamines, polyoxyethylene alkylamides, polyoxypropylene alkylamides, polyoxyethylene nonylphenylethers, polyoxyethylene laurylphenylethers, polyoxyethylene stearylarylphenyl esters, and polyoxyethylene nonylphenyl esters. Examples of the cellulose include methyl celluloses, hydroxyethyl celluloses, and hydroxypropyl celluloses.

In the preparation of the oil droplet-in-water dispersion, a dispersing stabilizer is employed in accordance with necessity. The dispersing stabilizer is, for example, acid such as calcium phosphate, alkali-soluble compound, or the like.

When the dispersing stabilizer is employed, the dispersing stabilizer is dissolved by acid such as hydrochloric acid, and then is washed with water or decomposed by a enzyme, thereby being removed from particles.

In the granulation of the toner, the dispersion particles formed in the preparation of oil droplet-in-water dispersion are made to coalesce, further, the organic solvent is removed from the dispersion particles.

It should be noted that the removal of the organic solvent is performed, for example, when a toner is produced by the dissolution and suspension method or a preferred aspect of the method for producing a toner of the present invention.

Examples of the removal method of the organic solvent include (1) a method in which the pressure of the entire reaction system is gradually reduced so as to completely evaporate and remove the organic solvent in the dispersion particles; (2) a method in which the temperature of the entire reaction system is gradually raised so as to completely evaporate and remove the organic solvent in the dispersion particles; and (3) a method in which the oil droplet-in-water dispersion is sprayed in dry atmosphere so as to completely remove the insoluble organic solvent in the dispersed particles.

For the dry atmosphere into which the oil droplet-in-water dispersion is sprayed, heated gases yielded by heating air, nitrogen gas, carbon dioxide gas, combustion gas, and the like, or various flows or streams heated at temperatures higher than the boiling point of a specific solvent having the highest boiling point among the solvents are typically used. It is possible to obtain a satisfactory and desired quality of each of these dry atmospheres in a short time process using a spray dryer, a belt dryer, a rotary kiln, or the like.

When the organic solvent is removed, toner particles are formed. The toner particles may be subjected to washing, drying, and the like. Sequentially, the toner particles are optionally subjected to a classification. The classification is, for example, carried out by cyclone, decanter, or centrifugal separation in the solution. Alternatively, the classification is carried out after the toner particles are obtained as powder by drying. The classification performed in the solution is preferable in view of production efficiency. At the time of classification in the solution, the unselected fine particles and coarse particles are placed back to the kneading step to form toner particles therefrom. Such fine particles and coarse particles may be in a wet-condition.

The thus obtained toner particles are subjected to mixing with particles such as the colorant, the releasing agent, the charge controlling agent, etc. (external additives), and mechanical impact, thereby preventing the particles such as the releasing agent falling off from the surface of the toner particles.

The toner after being mixed with the external additives may be simply referred as "toner" in the specification.

Examples of the method of imparting mechanical impact include a method in which an impact is imparted by rotating a blade at high speed, and a method in which an impact is imparted by introducing the mixed particles into a high-speed flow and accelerating the speed of the flow so as to make the particles impact with each other or so as to make the composite particles to impact upon an impact board. Examples of a device employed to such a method include angmill (manufactured by Hosokawamicron Corp.), modified I-type mill (manufactured by Nippon Pneumatic Mfg. Co., Ltd.) to decrease crushing air pressure, hybridization system (manufactured by Nara Machinery Co., Ltd.), krypton system (manufactured by Kawasaki Heavy Industries, Ltd.), and automatic mortars.

A toner obtained by the method for producing a toner of the present invention preferably has the following volume average particle diameter (Dv), volume average particle diameter (Dv)/number average particle diameter (Dn), penetration rate, low-temperature fixing property, offset-occurring temperature, thermal characteristics, glass transition temperature, acid value, and image density.

The volume average particle diameter (Dv) of the toner is preferably 3 μm to 9 μm, and more preferably 3 μm to 7 μm.

When the volume average particle diameter is less than 3 μm, the toner of two-component developer is liable to fuse onto carrier surfaces as a result of stirring in the developing unit for a long period, and a one-component developer is liable to cause a filming to a developing roller or fusion to a member such as a blade for reducing a thickness of a toner layer formed onto a developing roller. When the volume average particle diameter is more than 9 μm, an image of high resolution and high quality is rarely obtained, and the mean toner particle diameter is liable to fluctuate when a toner is repeatedly added to the developer to compensate the consumed toner.

The ratio (Dv/Dn) of the volume average particle diameter (Dv) to the number average particle diameter (Dn) is preferably 1.05 to 1.25, and more preferably 1.05 to 1.20.

When the ratio (Dv/Dn) is less than 1.05, the toner of a two-component developer is liable to fuse onto carrier surfaces due to agitation in a developing unit over a long-period of time, thereby degrading a charging ability of the carrier or cleaning ability, and when used in a one-component developer, it is liable to cause a filming to a developing roller or fusion to a member such as a blade for reducing a thickness of a toner layer formed onto a developing roller. When the ratio is more than 1.25, an image of high resolution and high quality is rarely obtained, and the mean toner particle diameter is liable to fluctuate when a toner is repeatedly added to the developer to compensate the consumed toner.

When a toner has a ratio (Dv/Dn) of the volume average particle diameter to the number average particle diameter is 1.05 to 1.20, the toner excels in any of heat resistant storage stability, low-temperature fixing property, and anti-hot-offset property and particularly when used in a full color copier, the toner excels in glossiness of images. When the toner is used in a two-component developer, the particle diameter of toner particles in the developer rarely varies even with toner inflow/outflow over a long period of time, and even under long-term agitation in a developing unit, excellent developing property can be obtained stably. When the toner is used in a one-component developer, even with toner inflow/outflow, the particle diameter of the toner rarely varies, and it rarely cause a filming to a developing roller or fusion to a member such as a blade for reducing a thickness of a toner layer formed onto a developing roller, and even under long-term agitation in a developing unit, excellent developing property can be obtained stably, therefore, high quality images can be obtained.

The volume average particle diameter (Dv), the number average particle diameter (Dn), and the ratio (Dv/Dn) of the volume average particle diameter to the number average particle diameter can be measured using a particle size analyzer (MultiSizer III, manufactured by Beckmann Coulter Inc.) with an aperture diameter of 100 μm and analyzed by means of analyzer software (Beckman Coulter Multisizer III Version 3.51). Specifically, to a 100 mL of glass 1.5 beaker, 0.5 mL of a 10% by mass surfactant (alkylbenzene sulfonate NeoGen SC-A, manufactured by DAI-ICHI KOGYO SEIYAKU CO., LTD.) is added, 5 g of the toner is added, and stirred using Microspartel. Next, 80 mL of ion exchange water is added to the dispersion. The obtained dispersion is subjected to a dispersion treatment for 10 minutes using an ultrasonic dispersion apparatus (W-113MK-II, manufactured by HONDA ELECTRONICS Co., Ltd.). Then, the obtained dispersion is measured by the Multisizer III, using Isoton III (manufactured by Beckmann Coulter Inc.) as a solution for measurement. The dispersion is fallen in drops such that the concentration of the dispersion indicated by the Multisizer III is 8% by mass±2% by mass. In the measurement method through the use of the Multisizer III, it is important to drop the dispersion in drops so as to have a concentration of 8% by mass±2% by mass. Within the range of the concentration, it is recognized that there is no error of measurement in particle diameter.

The penetration is 15 mm or more, and preferably 20 mm to 30 mm in accordance with a penetration test (JIS K2235-1991).

When the penetration is less than 15 mm, it is liable to degrade heat resistance preservation.

The penetration is measured in accordance with JIS K2235-1991. Specifically, the penetration is measure by filling a toner into a 50 ml glass container, leaving the glass container filled with the toner in a thermostat of 50° C. for 20 hours, sequentially cooling the toner to an ambient temperature, and then carrying out a penetration test thereto. Note that, the higher the penetration is, more excellent heat resistance preservation the toner has.

As the low-temperature fixing properties of the toner, the lowest fixing temperature is preferably as low as possible, and the offset-occurring temperature is preferably as high as possible, in view of realizing both lower fixing temperature and prevention of offset. When the lowest fixing temperature is less than 150° C. and the offset-occurring temperature is 200° C. or more, both the lower fixing temperature and prevention of offset are realized.

The lowest fixing temperature is determined as follows. A transfer sheet is set in an image-forming apparatus, a copy test is carried out, the thus obtained fixed image is scrubbed by pads, and the persistence of the image density is measured. The lowest fixing temperature is determined as a temperature at which the persistence of the image density becomes 70% or more.

The offset-occurring temperature is measured as follows: For example, using an image-forming apparatus, the image-forming apparatus is adjusted so as to develop a solid image with a given amount of toner to be evaluated and such that the temperature of the is fixing member is variable. The offset-occurring temperature is determined as the highest fixing temperature at which offset does not occur.

The thermal characteristics are also referred to flow tester characteristics, and are evaluated by softening temperature (Ts), flow-beginning temperature (Tfb), ½ method softening temperature (T½), and the like.

Thermal characteristics are obtained from a flow curve measured by means of an elevated flow tester CFT500 manufactured by SHIMADZU Corp.

The load, and the rate of temperature rise are respectively set to 10 kg/cm$^2$ and 3.0° C./minute to measure the thermal characteristics of the toner using a die aperture of 0.50 mm and a die length of 10.0 mm.

Figure 5A:
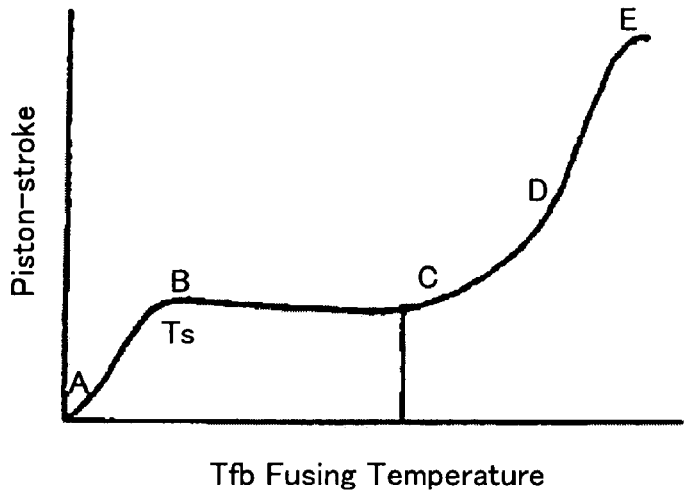
FIG. 5A is a schematic illustration showing a flow curve of the thermal characteristics of the toner of the present invention through the use of a flow tester.
Figure 5B:
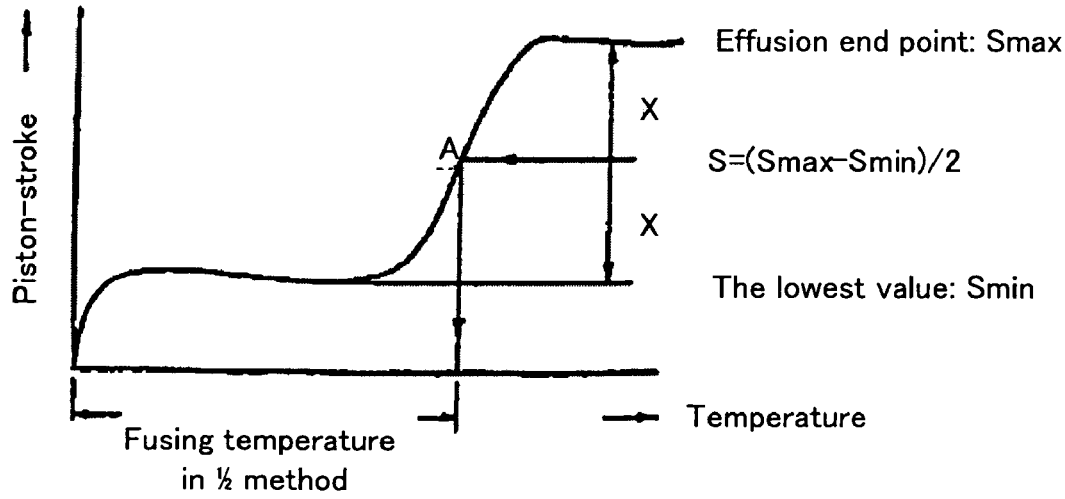
FIG. 5B is another schematic illustration showing a flow curve of the thermal characteristics of the toner of the present invention through the use of a flow tester.

FIGS. 5A and 5B show an example of the flow curve. In FIG. 5A, Ts indicates the softening point, and Tfb indicates the flow beginning temperature. In FIG. 5B, the melting temperature by means of ½ method represents T½ softening temperature (½ method softening temperature).

The softening temperature (Ts) is not particularly limited, and can be appropriately adjusted in accordance with the necessity. It is preferably 30° C. or more, and more preferably 50° C. to 90° C. When the softening temperature (Ts) is less than 30° C., at least one of the heat resistance preservation or low-temperature preservation may be degraded.

The flow-beginning temperature (Tfb) is not particularly limited, and can be appropriately adjusted in accordance with the intended use. It is preferably 60° C. or more, and more preferably 80° C. to 120° C. When the flow-beginning temperature (Tfb) is less than 60° C., at least one of the heat resistance preservation or low-temperature preservation may be degraded.

The ½ method softening temperature (T½) is not particularly limited, and can be appropriately adjusted in accordance with the intended use. It is preferably 90° C. or more, and more preferably 100° C. to 170° C. When the ½ method softening temperature (T½) is less than 90° C., at least one of the heat resistance preservation or low-temperature preservation may be degraded.

The glass transition temperature (Tg) is not particularly limited and may be suitably selected in accordance with the intended use. For example, the grass-transition temperature (Tg) is preferably 40° C. to 70° C., and more preferably 45° C. to 65° C. When the glass transition temperature (Tg) is less than 40° C., heat resistant storage stability of the toner may degrade, and when the glass transition temperature (Tg) is more than 70° C., sufficient low-temperature fixing property may not be obtained.

The glass transition temperature (Tg) of the toner can be measured based on the following measurement conditions using TA-60WS and DSC-60 manufactured by SHIMADZU Corp.

Namely, an aluminum sample pan (with a lid) is used as a sample vessel. To the sample vessel, 5 mg of the toner is added as the sample amount, and another aluminum sample pan is used for 10 mg of alumina as a reference to measure the sample in the presence of nitrogen atmosphere at a flow rate of 50 mL/minutes. For the temperature conditions, the temperature of the sample is raised from 20° C. as the beginning temperature at a rate of temperature rise of 10° C./minute to 150° C. of the end temperature, and then with no retention time, the temperature of the sample is lowered at a rate of temperature decrease of 10° C./minute to 20° C. as the end temperature, and further with no retention time, the temperature of the sample is raised again at a rate of temperature rise of 10° C./minute to 150° C. as the end temperature.

The measurement result obtained under the measurement conditions can be analyzed by using data analyzer software (TA-60 Version 1.52, manufactured by SHIMADZU Corp.). For the detailed analyzing method, centering on the maximum peak point on the lowest temperature side in the DrDSC curve which is the DSC derivative curve of the second time temperature raise, the maximum peak point±5° C. is designated as the range to obtain the peaked temperature of the sample using the peak analyzing function of the analyzer software. Next, the maximum endothermic temperature in the DSC curve of the sample in the range +5° C. to −5° C. is obtained using the peak analyzing function of the analyzer software. The temperature indicated by the analyzer software corresponds to the glass transition temperature (Tg) of the adhesive base material.

The acid value of the toner is preferably, for example, 0.5 KOHmg/g to 40.0 KOHmg/g, and more preferably 3.0 KOHmg/g to 35.0 KOHmg/g. By imparting the acid value to the toner, the toner is generally liable to be negatively chargeable.

The acid value (AV) or the hydroxyl value (OHV) of the toner can be measured by the following measuring device based on the following conditions:

For the measuring device, an automatic potentiometric titrator (DL-53 Titrator, manufactured by Metller Toledo) is used. Electrodes (DG113-SC manufactured by Metller Toledo) are used. A mixed solvent of 120 mL of toluene and 30 mL of ethanol is used as the composition used in the measuring device, and the toner is analyzed through analyzer software (LabX Light Version 1.00.00).

The measurement conditions for the measuring device were set as follows:

Measurement temperature: 23° C.

Stirring conditions:
- Speed: 25%
- Time (s): 15

EQP titration conditions:
- Titrant: $CH_3ONa$
- Concentration (mol/L): 0.1
- Sensor DG115
- Unit of measurement: mV Predispensing conditions: Set to volume
- Volume 1.0 mL
- Wait time (s) 0

Titrant addition conditions: Dynamic
- dE (set) 8.0 mV
- dV (Min) 0.03 mL
- dV (Max) 0.5 mL Measure mode conditions: Equilibrium controlled
- dE 0.5 mV
- dt (s) 1.0
- t(Min) (s) 2.0
- t(Max) (s) 20.0

Recognition conditions:
- Threshold 100.0
- Steepest jump only No
- Range None
- Tendency None Termination conditions:
- At maximum volume 10.0 mL
- At potential No
- At slope No
- After number EQPs Yes
- n=1
- Comb. Termination conditions: No Evaluation conditions:
- Procedure Standard
- Potential 1 No
- Potential 2 No
- Stop for reevaluation No In conformity with the measuring method described in JIS K0070-1992, the toner is measured under the measurement conditions, using the measuring device.

Here, for the sample, 0.5 g of toner (0.3 g of ethyl acetate soluble component) is added to 120 mL of toluene and stirred at a temperature of 23° C. for approx. 10 hours to be dissolved. Further, a solution to which 30 mL of ethanol is added is used.

The titration is performed using a preliminary standardized N/10 caustic potash-alcohol solution. The acid value (AV) can b calculated from the consumed amount of the alcoholic caustic potash solution based on the following Equation:

$$\text{Acid value (AV)}=\text{KOH (mL)}\times N\times 56.1/\text{mass of sample} \qquad \text{Equation}$$

In the Equation, N represents a factor of N/10KOH.

The image density is determined as a density value measured by means of a spectrometer (SpectroDensitometer 938, manufactured by X-Rite), and the density value is preferably 1.40 or more, more preferably 1.45 or more, and still more preferably 1.50 or more.

When the image density is less than 1.40, the image density is low and thus a high quality image may not be obtained.

The image density is measured as follows. A solid image is formed by using a transfer sheet (Type 6200 manufactured by Ricoh Company, Ltd.), and a tandem-type color photocopier (Imagio Neo 450, manufactured by Ricoh Company, Ltd.) The photocopier was adjusted so that 1.00±0.1 mg/cm$^2$ of toner is transferred onto the sheet, and the transferred image is fixed by the fixing roller having a surface temperature of 160±2° C. The thus obtained solid image is subjected to a measurement of glossines by means of a spectrometer (SpectroDensitometer 938. manufactured by X-Rite), and an average value of measurements at arbitrary selected tree points in the solid image is calculated.

The coloration of the toner is not particularly limited, and may be suitably selected in accordance with the intended use. For example, the coloration is at least one selected from a black toner, a cyan toner, a magenta toner, and a yellow toner. Each color toner is obtained by appropriately selecting the colorant to be contained therein.

In the method for producing a toner of the present invention, since a dissolved and dispersed solution of the toner materials is dispersed as dispersion particles in the aqueous medium containing no organic resin fine particles stated above to prepare the oil droplet-in-water dispersion, and the organic resin fine particles are added to the oil droplet-in-water dispersion to granulate a toner in the presence of the organic resin fine particles, it is possible to obtain a toner having a uniform composition of toner materials among the toner particles, excelling in charge stability, enabling high-quality images without substantially causing fog and toner scattering, and having a small particle diameter and a narrow particle size distribution.

A toner of the present invention has a small particle diameter, a narrow particle size distribution and a uniform composition of toner materials among the toner particles, excels in charge stability, causes less fog and toner scattering, and enables high-quality images. Further, when the toner comprises particles containing at least the adhesive base material which is obtained by reacting the active hydrogen group-containing compound and the polymer capable of reacting with the active hydrogen-group-containing compound in an aqueous medium, the toner excels in various properties such as anti-agglutinating property, charging ability, flowability, releasing property, and fixing property. Thus, the toner of the present invention can be suitably used for a variety of fields, more suitably used for image formation by means of electrophotography and particularly suitably used for the following toner container, the developer, the process cartridge, the image forming apparatus, and the image forming method of the present invention.

(Developer)

A developer of the present invention comprises the toner of the present invention. The developer further comprises other appropriately selected components such as the carrier. The developer is either one-component developer or two-component developer. However, the two-component developer is preferable in view of improved life span when the developer is used with, for example, a high speed printer that complies with improvements in recent information processing speed.

The one-component developer using the toner of the present invention shows little changes in the average toner particle size when the toner is repeatedly supplied after consumption thereof. There is no toner filming on the developing roller or adhered by fusion to the members such as the blade for forming a thin toner layer. The one-component developer provides excellent and stable developing property and images after being used (stirred) for a long period of time of a developing device. The two-component developer using the toner of the present invention shows little changes in the average toner particle size in the developer when the toner is repeatedly supplied after consumption due to developing. Even after a long time-period of stirring in a developing device, the two-component developer provides excellent and stable developing properties.

The carrier is not particularly limited and may be suitably selected in accordance with the intended use. However, the carrier is preferably those having a core material and a resin layer coating the core material.

The core material is not particularly limited and may be suitably selected from the known materials. For example, 50 emu/g to 90 emu/g manganese-strontium (Mn—Sr) materials, manganese-magnesium (Mn—Mg) materials are preferable materials. Highly magnetizable materials such as iron powder (100 emu/g or higher) and magnetite (75 emu/g to 120 emu/g) are preferable in view of ensuring the image density. Weakly magnetizable materials such as copper-zinc (Cu—Zn) materials (30 emu/g to 80 emu/g) is preferable in view of reducing the shock to the photoconductor the toner ears from, which is advantageous for high image quality. These are used alone or in combination with two or more.

The core material preferably has a volume average particle size of 10 μm to 150 μm, more preferably 40 to 100 μm.

When the average particle size (volume average particle size ($D_{50}$) is smaller than 10 μm, an increased amount of fine powder is observed in the carrier particle size distribution, and thus magnetization per particle is lowered, which may cause the carrier to fly. When the average particle size is larger than 150 μm, the specific surface area is reduced, which may cause the toner to fly. Therefore, a full color image having many solid parts may not be well reproduced particularly in the solid parts.

The material for the resin layer is not particularly limited and may be suitably selected from known resins in accordance with the intended use. Examples of such a material include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and an acryl monomer, copolymers of vinylidene fluoride and vinyl fluoride, fluoroterpolymers such as terpolymer of tetrafluoroethylene, vinylidene fluoride and non-fluoride monomer, and silicone resins. These are used alone or in combination with two or more.

Examples of the amino resin include urea-formaldehyde resins, melamine resins, benzoguanamine resins, urea resins, polyamide resins, and epoxy resins. Examples of the polyvinyl resin include acryl resins, polymethylmetacrylate resins, polyacrylonitrile resins, polyvinyl acetate resins, polyvinyl alcohol resins, and polyvinyl butyral resins. Examples of the polystyrene resin include polystyrene resins, and styrene acryl copolymer resins. Examples of the halogenated olefin resin include polyvinyl chlorides. Examples of the polyester resin include polyethyleneterephtalate resins, and polybutyleneterephtalate.

The resin layer contains, for example, conductive powder in accordance with necessity. Examples of the conductive powder include metal powder, carbon black, titanium oxides, tin oxides, and zinc oxides. The conductive power preferably has an average particle size of 1 μm or smaller. When the average particle size is larger than 1 μm, it may difficult to control electronic resistance.

The resin layer is formed, for example, by dissolving the silicone resin or the like in a solvent to prepare a coating solution, uniformly applying the coating solution to the surface of the core material by a known technique, drying, and baking. Examples of the application technique include immersion, spraying, and brushing.

The solvent is not particularly limited and may be suitably selected in accordance with the intended use. Examples of the solvent include toluene, xylene, methyethylketone, methylisobutylketone, and cerusolbutylacetate.

Baking is not particularly restricted and can be performed by external heating or internal heating. For example, a technique using a fixed electric furnace, a flowing electric furnace, a rotary electric furnace, or a burner or a technique using a microwave can be used.

The content of the resin layer in the carrier is preferably 0.01% by mass to 5.0% by mass. When it is less than 0.01% by mass, the resin layer may not be uniformly formed on the surface of the core material. When it is more than 5.0% by mass, the resin layer may become excessively thick and cause the granulation between carriers, is thereby uniform carrier particles may not be obtained.

When the developer is a two-component developer, the content of the carrier in the two-component developer is not particularly limited and may be suitably selected in accordance with the intended use. For example, the content is preferably 90% by mass to 98% by mass, and more preferably 93% by mass to 97% by mass.

The developer containing the toner of the present invention has an excellent cleaning ability and reliably forming high quality images.

The developer of the present invention can be preferably used in forming images by known, various electrophotographic techniques such as magnetic one-component developing, non-magnetic one-component developing, and two-component developing. In particular, the developer can be preferably used in the toner container, process cartridge, image-forming apparatus, and the image-forming method of the present invention below.

(Toner Container)

The toner container comprises a container and the toner or the developer of the present invention filled in the container.

The container is not particularly limited and may be suitably selected from known containers. Preferred examples of the container include one having a toner container body and a cap.

The toner container body is not particularly limited in size, shape, structure, and material and may be suitably selected in accordance with the intended use. The shape is preferably a cylinder. It is particularly preferable that a spiral ridge is formed on the inner surface, thereby the content or the toner moves toward the discharging end when rotated and the spiral part partly or entirely serves as a bellows.

The material of the toner container body is not particularly limited and preferably offers dimensional accuracy. For example, resins are preferable. Among these, polyester resin, polyethylene resin, polypropylene resin, polystyrene resin, polyvinyl chloride resin, polyacrylic acid, polycarbonate resin, ABS resin, polyacetal resin are preferable.

The toner container is easy to preserve and ship, is handy, and is preferably used with the process cartridge and image forming apparatus, which are described later, by detachably mounting therein for supplying toner.

(Process Cartridge)

The process cartridge comprises a latent electrostatic image bearing member which is configured to bear a latent electrostatic image thereon, and a developing unit which is configured to develop the latent electrostatic image by using a developer to form a visible image. The process cartridge further comprises suitably selected other units or members in accordance with necessity.

The developing unit has a developer container for storing the toner or developer of the present invention and a developer bearing member which is configured to bear and transfer the toner or developer stored in the developer container and may further have a layer thickness control member for controlling the thickness of a toner layer formed on the developer bearing member.

The process cartridge can be detachably mounted in a variety of electrophotographic apparatuses and preferably detachably mounted in the electrophotographic apparatus of the present invention, which is described later.

(Image-forming Method and Image-forming Apparatus)

The image-forming method of the present invention comprises a latent electrostatic image formation, developing, transferring, and fixing. The image-forming method of the present invention comprises suitably selected other steps such as charge removal, cleaning, recycling, and controlling.

The image-forming apparatus comprises a latent electrostatic image bearing member, a latent electrostatic image forming unit, a developing unit, a transferring unit, and a fixing unit. The image-forming apparatus comprises suitably selected other units or members such as a charge eliminating unit, a cleaning unit, a recycling unit, and a controlling unit.

—Latent Electrostatic Image Formation and Latent Electrostatic Image Forming Unit—

The latent electrostatic image formation is a step for forming a latent electrostatic image on a latent electrostatic image bearing member.

It should be noted that, in the present specification, the latent electrostatic image bearing member is also referred to a photoconductive insulator, or a photoconductor. The latent electrostatic image bearing member is not particularly limited in the material, shape, structure or size thereof and may be suitably selected from those known in the art. A suitable example of the shape thereof is a drum shape. Examples of the material thereof include inorganic photoconductors such as amorphous silicone, or selenium, organic photoconductors such as polysilane, or phthalopolymethine. Among these examples, the amorphous silicone is preferable in view of long lifetime.

The latent electrostatic image formation is carried out, for example, by exposing the latent electrostatic image bearing member imagewisely after uniformly charging the entire surface of the latent electrostatic image bearing member. This is performed by means of the latent electrostatic image forming unit.

The latent electrostatic image forming unit comprises a charging unit which is configured to uniformly charge the surface of the photoconductor, and an exposing unit which is configured to imagewisely expose the surface of the latent electrostatic image bearing member.

The charging is carried out, for example, by applying voltage to the surface of the photoconductor by means of the charging unit.

The charging unit is not particularly limited, and may be suitably selected in accordance with the intended use. Examples of the charging unit include the conventional contact-charging unit equipped with a conductive or semiconductive roller, blush, film, and rubber blade; and the conventional non-contact-charging unit utilizing corona discharge such as corotron, or scorotoron, and the like.

The exposure is carried out, for example, by exposing the surface of the latent electrostatic image bearing member imagewisely by means of the exposing unit.

The exposing unit is not particularly limited, provided that a predetermined exposure is performed imagewisely on the surface of the charged latent electrostatic image bearing member by the charging unit, and may be suitably selected in accordance with the intended use. Examples of the irradiating unit include various irradiating units such as optical copy units, rod-lens-eye units, optical laser units, and optical liquid crystal shatter units.

In the present invention, a backlight system may be applied for the exposure, in which exposure is carried out imagewie from the back side of the latent electrostatic image bearing member.

Developing and Developing Unit—

The developing is a step of developing the latent electrostatic image with the toner to form a visible image (toner image).

The developing is performed, for example, by developing the latent electrostatic image with the toner or developer of the present invention by means of the developing unit.

The developing unit is not particularly limited, provided that developing is carried out with the toner or developer of the present invention, and may be suitably selected in accordance with the intended use. A suitable example of the developing unit is a developing unit which contains the toner or developer therein and capable of directly or indirectly applying the toner to the latent electrostatic image. It is preferred that such a developing unit is equipped with the toner container.

The developing unit may be of dry developing or wet developing, and for mono-color or a developing unit for multi-color. A suitable example of the developing unit is a developing unit comprising a stirring unit which stirs the toner to impart frictional electrification, and a magnet roller which is rotatably mounted.

Within the developing unit, the toner and carrier are mixed and stirred, and the toner is charged at the time of friction with the carrier, the rotatable magnetic roller bears the charged toner on the surface thereof to form a magnetic blush. Since the magnet roller is disposed adjacent to the photoconductor, a part of the toner consisting of the magnetic blush, which is formed on the surface of the magnetic roller, is electrically attracted and transferred to the surface of the photoconductor. As a result, the latent electrostatic image is developed by the toner, and the visible image (toner image) of the toner is formed on the photoconductor.

The developer contained in the developing unit is a developer comprising the toner. The developer is either one-component developer or two-component developer.

Transferring and Transferring Unit—

The transferring is a step of transferring the visible image onto a recording medium. The preferably aspect of the transfer is such that a visible image is primary transferred to an intermediate transferring member, the visible image transferred on the intermediate transferring member is secondary transferred to a recording member. The more preferably aspect of the transfer is such that the toner is of two or more color, or preferably full-color toner, and the transferring contains a primary transfer wherein a visible image is transferred to the intermediate transferring member to form a composite transferred image, and a secondary transfer wherein the composite transferred image is transferred onto a recording member.

The transfer is carried out, for example, by charging the visible image on the photoconductor by means of a transfer charging unit. This transfer is performed by means of the transferring unit.

The preferable aspect of the transferring unit is such that a transferring unit comprises a primary transferring unit which is configured to transfer a visible image onto an intermediate transferring member to form a composite transferred image, and a secondary transferring unit which is configured to transfer the composite transferred image onto a recording medium.

The intermediate transferring member is not particularly limited, and may be selected from the conventional transferring members in accordance with the intended use. Examples thereof include transferring belts.

The transferring unit (the primary transferring unit and the secondary transferring unit) preferably comprises a transferring element which is configured to charge so as to separate the toner image from the photoconductor and to transfer onto a recording medium. In the image-forming apparatus of the present invention, either one, or plurality of transferring units are disposed.

Examples of the transferring element include corona transferring elements utilizing corona discharge, transferring belts, transferring rollers, pressure-transferring rollers, and adhesion-transferring elements.

The recording medium is not particularly limited and may be suitably selected from the conventional recording media (recording paper) in accordance with the intended use.

—Fixing and Fixing Unit—

The fixing is a step of fixing the transferred visible image onto the recording member by means of the fixing unit. The fixing may be performed every time each color of the toner is transferred to the recording medium, or after all colors of the toner are transferred and form a superimposed layer of the toner on the recording medium.

The fixing unit is not particularly limited, and may be suitably selected in accordance with the intended use. Examples of the fixing unit include heating-pressurizing units. The heating-pressurizing unit is preferably a combination of a heating roller and a pressurizing roller, a combination of a heating roller, a pressurizing roller, and an endless belt, and the like.

The heating by means of the heating-pressurizing unit is preferably performed at 80° C. to 200° C.

The conventional optical fixing unit may be used in addition to or instead of the fixing and fixing unit in accordance with necessity.

The charge eliminating is a step of applying a bias to the charged photoconductor so as to remove the charge. This is suitably performed by the charge eliminating unit.

The charge eliminating unit is not particularly limited, provided that bias is applied to the charged photoconductor to thereby remove the charge, and may be suitably selected from the conventional charge eliminating units in accordance with the intended use. A suitable example thereof is a charge eliminating lamp.

The cleaning is a step of removing the residual toner on the photoconductor. This is suitably performed by means of the cleaning unit.

The cleaning unit is not particularly limited, provided that the residual toner on the photoconductor is removed, and may be suitably selected from the conventional cleaners in accordance with the intended use. Examples thereof include magnetic blush cleaners, electrostatic brush cleaners, magnetic roller cleaners, blade cleaners, blush cleaners, and wave cleaners.

The recycling is a step of recycling or recovering the color toner collected by the cleaning to the developing unit. This is suitably performed by means of the recycling unit.

The recycling unit is not particularly limited, and may be suitably selected from the conventional conveyance systems.

The controlling is a step of controlling each of the steps. This is suitably performed by means of the controlling unit.

The controlling unit is not particularly limited, provided that each of the units or members is controlled, and may be suitably selected in accordance with the intended use. Examples thereof include devices such sequencers, and computers.

An aspect of the image-forming method of the present invention by means of the image-forming apparatus of the present invention will be explained with reference to FIG. 1.

The image-forming apparatus 100 shown in FIG. 1 comprises a photoconductor drum 10 (referred to a photoconductor 10 hereinafter) as the latent electrostatic image bearing member, a charging roller 20 as the charging unit, an exposure device 30 as the exposing unit, a developing device 40 as the developing unit, an intermediate transferring member 50, a cleaning device 60 as the cleaning unit having a cleaning blade, and a charge eliminating lamp 70 as the charge eliminating unit.

The intermediate transferring member 50 is an endless belt, and spanned over three rollers 51 which are disposed inside thereof. The intermediate transferring member 50 is configured to rotate in the direction shown with the arrow by means of the rollers 51. One or more of the three rollers 51 also servers as a transfer bias roller which is capable of applying a certain transfer bias (primary bias) to the intermediate transferring member 50. Adjacent to the intermediate transferring member 50, there are disposed a cleaning device 90 having a cleaning blade, and a transferring roller 80 faces to the intermediate transferring member 50, as the transferring unit which is capable of applying a transfer bias so as to transfer (secondary transfer) a developed image (toner image) to a transfer sheet 95 as a final recording medium. Further, there is disposed a corona charger 52 for applying a charge to the toner image transferred on the intermediate transferring medium 50, beside the intermediate transferring medium 50, and in between the contact region of the photoconductor 10 and the intermediate transferring medium 50 and the contact region of the intermediate transferring medium 50 and the transfer sheet 95 in the rotational direction of the intermediate transferring medium 50.

The developing device 40 comprises a black developing unit 45K, yellow developing unit 45Y, magenta developing unit 45M, and cyan developing unit 45C, in which the developing units positioned around the developing belt 41. The black developing unit 45K comprises a developer container 42K, a developer supplying roller 43K, and a developing roller 44K; the yellow developing unit 45Y comprises a developer container 42Y, a developer supplying roller 43Y, and a developing roller 44Y; the magenta developing unit 45M comprises a developer container 42M, a developer supplying roller 43M, and a developing roller 44M; the cyan developing unit 45C comprises a developer container 42C, a developer supplying roller 43C, and a developing roller 44C.

In the image-forming apparatus 100 shown in FIG. 1, the photoconductor 10 is uniformly charged by the charging roller 20. The exposure device 30 sequentially exposes the photoconductor 10 imagewisely so as to form a latent electrostatic image. The latent electrostatic image formed on the photoconductor 10 is supplied with a toner from the developing device 40 so as to form a visible image (toner image). The roller 51 applies a bias to the visible image (toner image) so as to transfer (primary transfer) the toner image onto the intermediate transferring medium 50, and further applies a bias to transfer (secondary transfer) the toner image from the intermediate transferring medium 50 to the transfer sheet 95. In this way, the transferred image is formed on the transfer sheet 95. Thereafter, the residual toner on the photoconductor 10 is removed by the cleaning device 60, and the charged photoconductor 10 is diselectrified by the charge eliminating lamp 70.

Figure 2:
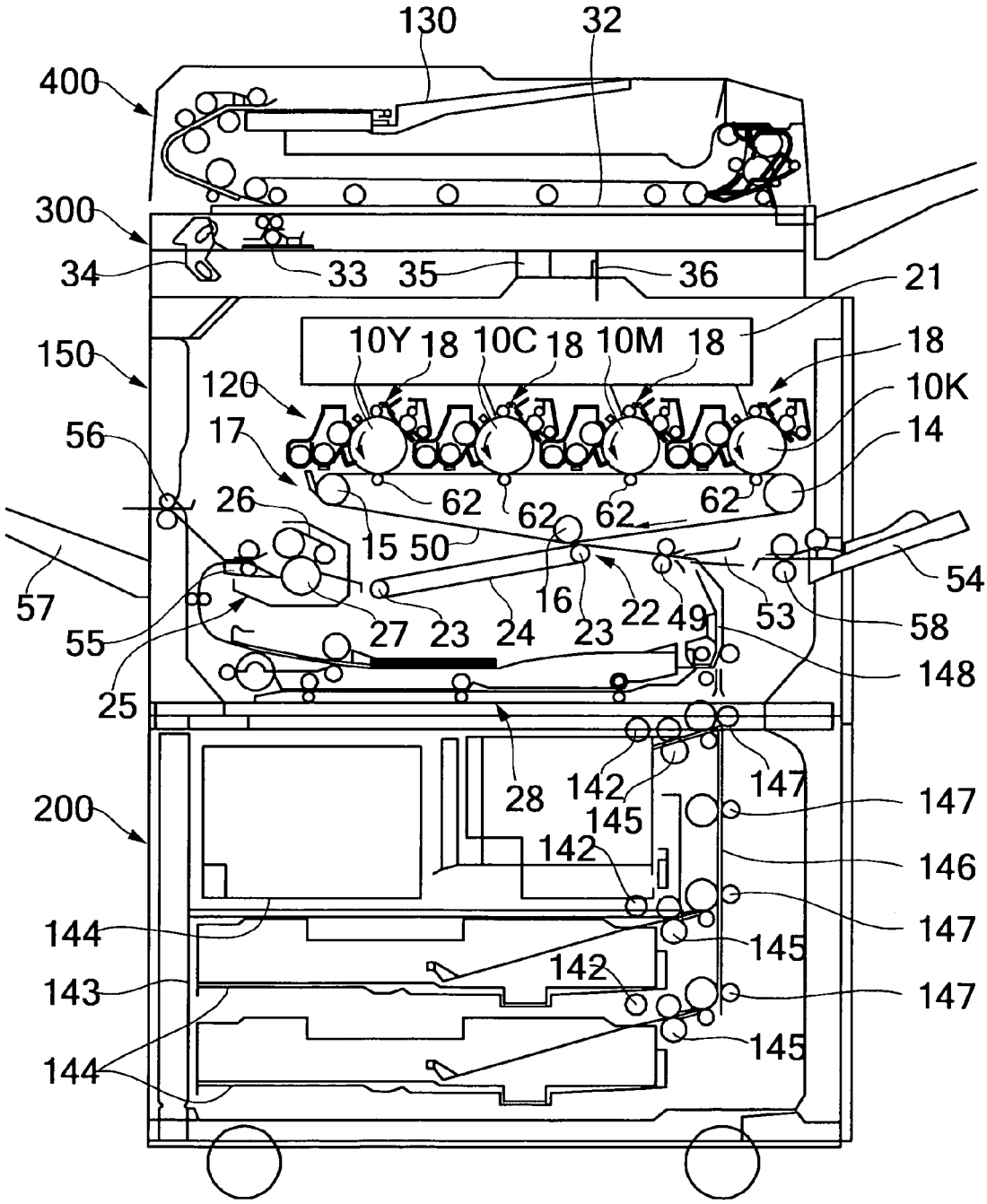
FIG. 2 is an illustration schematically exemplarily showing an example of performing the image forming method of the present invention using an image forming apparatus of the present invention (a tandem-type color image forming apparatus).

Another aspect of the image-forming method of the present invention by means of the image-forming apparatus of the present invention will be explained with reference to FIG. 2. The image forming apparatus 100 shown in FIG. 2 is a tandem-type full color image-forming apparatus. The tandem image-forming apparatus 100 comprises a copier main body 150, a feeder table 200, a scanner 300, and an automatic document feeder (ADF) 400.

The copier main body 150 includes intermediate transferring member 50 formed in an endless-belt shape. The intermediate transferring member 50 is spanned over support rollers 14, 15 and 16 and is configured to rotate in a clockwise direction in FIG. 2. There is disposed a cleaning device 17 for the intermediate transferring member adjacent to the support roller 15. The cleaning device 17 for the intermediate transferring member is capable of removing a residual toner on the intermediate transferring member 50 after transferring a toner image. Above the intermediate transferring member 50 spanned over the support rollers 14 and 15, four image-forming units 18 of yellow, cyan, magenta, and black are arrayed in parallel in a conveyance direction of the intermediate transferring member 50 to thereby constitute a tandem developing unit 120. There is also disposed an exposing unit 21 adjacent to the tandem developing unit 120. A secondary transferring unit 22 is disposed on the opposite side of the intermediate transferring member 50 where the tandem developing unit 120 is disposed. The secondary transferring unit 22 comprises a secondary transferring belt 24 of an endless belt, which is spanned over a pair of rollers 23. The secondary transferring unit 22 is configured so that the transfer sheet conveyed on the secondary transferring belt 24 contacts with the intermediate transferring member 50. Adjacent to the secondary transferring unit 22, there is disposed an image-fixing device 25. The image-fixing device 25 comprises a fixing belt 26 which is an endless belt, and a pressurizing roller 27 which is disposed so as to contact against the fixing belt 26.

In the tandem image-forming apparatus 100, a sheet reverser 28 is disposed adjacent to the secondary transferring unit 22 and the image-fixing device 25. The sheet reverser 28 is configured to reverse a transfer sheet in order to form images on the both sides of the transfer sheet.

Next, full-color image-formation (color copy) formed by means of the tandem developing unit 120 will be described. Initially, a document is placed on a document platen 130 of the automatic document feeder 400. Alternatively, the automatic document feeder 400 is opened, the document is placed on a contact glass 32 of the scanner 300, and the automatic document feeder 400 is closed to press the document.

At the time of pushing a start switch (not shown), the document placed on the automatic document feeder 400 is transported onto the contact glass 32. When the document is initially placed on the contact glass 32, the scanner 300 is immediately driven to operate a first carriage 33 and a second carriage 34. Light is applied from a light source to the document, and reflected light from the document is further reflected toward the second carriage 34 at the first carriage 33. The reflected light is further reflected by a mirror of the second carriage 34 and passes through an image-forming lens 35 into a read sensor 36 to thereby read the color document (color image). The read color image is interrupted to image information of black, yellow, magenta and cyan.

Figure 3:
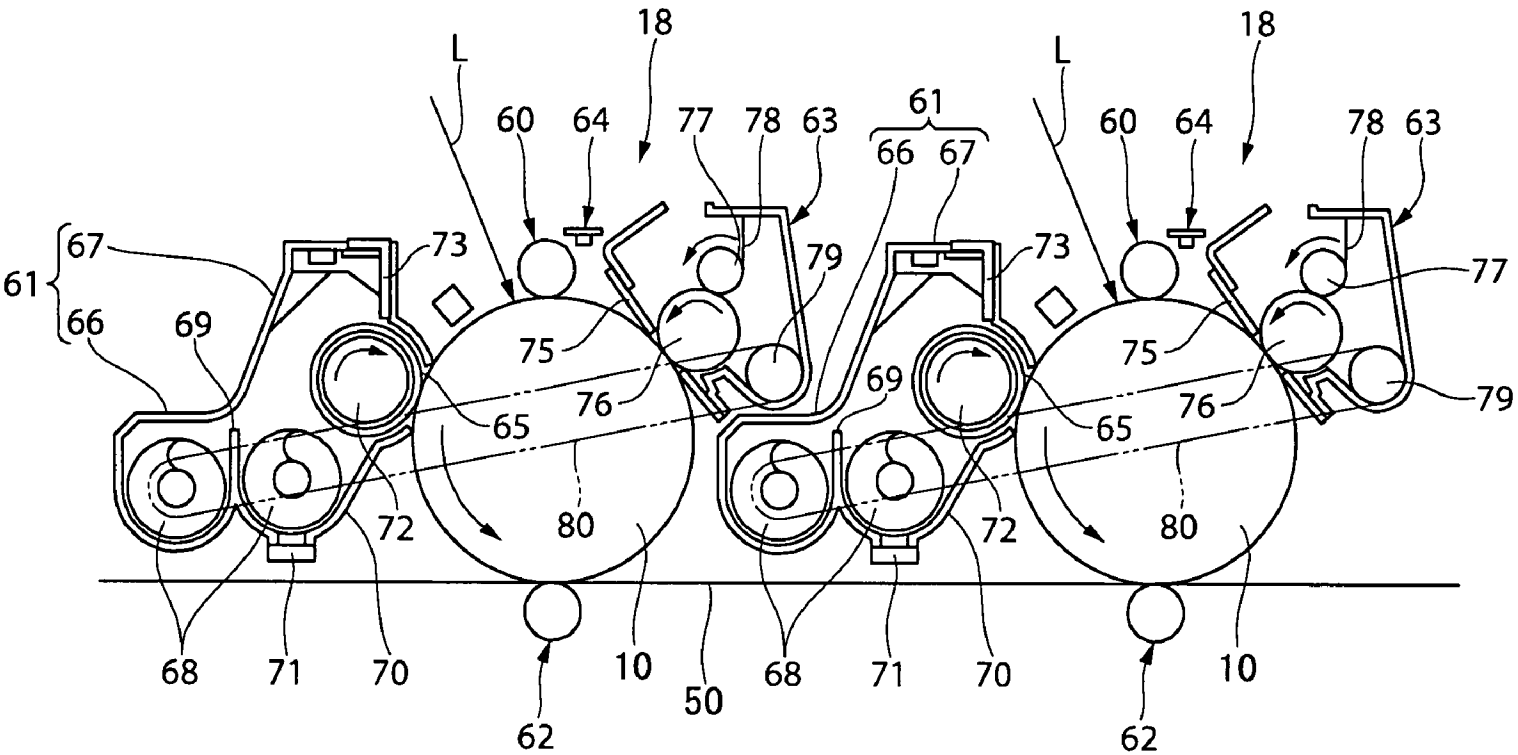
FIG. 3 is a partially enlarged schematic illustration of the image forming method shown in FIG. 2.

Each of black, yellow, magenta, and cyan image information is transmitted to respective image-forming units 18 (black image-forming unit, yellow image-forming unit, magenta image-forming unit, and cyan image-forming unit) of the tandem developing device 120, and then toner images of black, yellow, magenta, and cyan are separately formed in each image-forming unit 18. With respect to each of the image-forming units 18 (black image-forming unit, yellow image-forming unit, magenta image-forming unit, and cyan image-forming unit) of the tandem developing device 120, as shown in FIG. 3, there are disposed a photoconductor 10 (a photoconductor for black 10K, a photoconductor for yellow 10Y, a photoconductor for magenta 10M, or a photoconductor for cyan 10C), a charger 60 which uniformly charge the photoconductor, an exposure unit (L) which form a latent electrostatic image corresponding to each color image on the photoconductor, an developing unit 61 which develops the latent electrostatic image with the corresponding color toner (a black toner, a yellow toner, a magenta toner, or a cyan toner) to form a toner image of each color, a transfer charger 62 for transferring the toner image to the intermediate transferring member 50, a photoconductor cleaning device 63, and a charge eliminating unit 64. Accordingly, each mono-color images (a black image, a yellow image, a magenta image, and a cyan image) are formed based on the corresponding color-image information. The thus obtained black toner image formed on the photoconductor for black 10K, yellow toner image formed on the photoconductor for yellow 10Y, magenta toner image formed on the photoconductor for magenta 10M, and cyan toner image formed on the photoconductor for cyan 10C are sequentially transferred (primary transfer) onto the intermediate transferring member 40 which rotates by means of support rollers 14, 15 and 16. These toner images are superimposed on the intermediate transferring member 40 to form a composite color image (color transferred image).

One of feeder rollers 142 of the feeder table 200 is selectively rotated, sheets are ejected from one of multiple feeder cassettes 144 in a paper bank 143 and are separated by a separation roller 145 one by one into a feeder path 146, are transported by a transport roller 147 into a feeder path 148 in the copier main body 150 and are bumped against a resist roller 49. Alternatively, one of the feeder rollers 142 is rotated to eject sheets from a manual-feeding tray 54, and the sheets are separated by a separation roller 58 one by one into a manual feeding path 53, transported one by one and then bumped against the resist roller 49. Note that, the resist roller 49 is generally earthed, however, it may be biased for removing paper dust of the sheets.

The resist roller 49 is rotated synchronously with the movement of the composite color image on the intermediate transferring member 50 to transport the sheet (recording medium) into between the intermediate transferring member 50 and the secondary transferring unit 22, and the composite color image is transferred onto the sheet by action of the secondary transferring unit 22. After transferring the toner image, the residual toner on the intermediate transferring member 50 is cleaned by means of the intermediate cleaning device 17.

The sheet bearing the transferred image is transported by the secondary transferring unit 22 into the image-fixing device 25, is applied with heat and pressure in the image-fixing device 25 to fix the composite color image (transferred image) to the sheet (recording medium). Thereafter, the sheet changes its direction by action of a switch blade 55, is ejected by an ejecting roller 56 and is stacked on an output tray 57. Alternatively, the sheet changes its direction by action of the switch blade 55 into the sheet reverser 28, turns the direction, is transported again to the transfer section, subjected to an image formation on the back surface thereof. The sheet bearing images on both sides thereof is then ejected with assistance of the ejecting roller 56, and is stacked on the output tray 57.

The image forming apparatus and the image-forming method of the present invention efficiently produce high quality images, because the toner of the present invention, which has a small particle diameter and a narrow particle size distribution and excels in releasing property at low temperatures, causes less toner filming, and achieves both of low-temperature fixing property and heat resistant storage stability, is used.

PRODUCTION EXAMPLE 1

Preparation of Water Dispersion of Wax (Wax Dispersion) (1)—

In a vessel, 200 parts by mass of paraffin wax (melting point of 78° C.), 10 parts by mass of anionic surfactant (Neo-Gen SC), and 790 parts by mass of water were poured, heated at 95° C., emulsified using Gaulin Homogenizer at a discharge pressure of $560\times10^5 N/m^2$ and then quenched to thereby prepare a water dispersion of a wax (wax dispersion) (1).

The volume average particle diameter (Dv) of the wax dispersion particles included in the obtained wax dispersion (1) was measured through the use of a particle size distribution analyzer (LA-920, manufactured by HORIBA Ltd.) using laser light scattering method, and the wax dispersion particles had a volume average particle diameter (Dv) of 0.160 μm. In the wax dispersion particles, the existing ratio of coarse particles having a volume average particle diameter (Dv) of 0.8 μm or more was 5% or less.

PRODUCTION EXAMPLE 2

—Preparation of Water Dispersion of Wax (Wax Dispersion) (2)—

In a vessel, 200 parts by mass of paraffin wax (melting point of 68° C.), 10 parts by mass of anionic surfactant (Neo-Gen SC), and 790 parts by mass of water were poured, heated at 95° C., emulsified using Gaulin Homogenizer at a discharge pressure of $560\times10^5 N/m^2$ and then quenched to thereby prepare a water dispersion of a wax (wax dispersion) (2).

The volume average particle diameter (Dv) of the wax dispersion particles included in the obtained wax dispersion (2) was measured through the use of a particle size distribution analyzer (LA-920, manufactured by HORIBA Ltd.) using laser light scattering method, and the wax dispersion particles had a volume average particle diameter (Dv) of 0.130 μm. In the wax dispersion particles, the existing ratio of coarse particles having a volume average particle diameter (Dv) of 0.8 μm or more was 3% or less.

PRODUCTION EXAMPLE 3

—Preparation of Water Dispersion of Wax (Wax Dispersion) (3)—

In a vessel, 200 parts by mass of carbonyl group-containing wax (melting point of 82° C.), 10 parts by mass of anionic surfactant (NeoGen SC), and 790 parts by mass of water were poured, heated at 130° C., emulsified using Gaulin Homogenizer at a discharge pressure of $560\times10^5 N/m^2$ and then quenched to thereby prepare a water dispersion of a wax (wax dispersion) (3).

The volume average particle diameter (Dv) of the wax dispersion particles included in the obtained wax dispersion (3) was measured through the use of a particle size distribution analyzer (LA-920, manufactured by HORIBA Ltd.) using laser light scattering method, and the wax dispersion particles had a volume average particle diameter (Dv) of 0.182 μm. In the wax dispersion particles, the existing ratio of coarse particles having a volume average particle diameter (Dv) of 0.8 μm or more was 5% or less.

PRODUCTION EXAMPLE 4

—Preparation of Water Dispersion of Wax (Wax Dispersion) (4)—

In a vessel, 200 parts by mass of carbonyl group-containing wax (melting point of 116° C.), 10 parts by mass of anionic surfactant (NeoGen SC), and 790 parts by mass of water were poured, heated at 130° C., emulsified using Gaulin Homogenizer at a discharge pressure of $560\times10^5 N/m^2$ and then quenched to thereby prepare a water dispersion of a wax (wax dispersion) (4).

The volume average particle diameter (Dv) of the wax dispersion particles included in the obtained wax dispersion (4) was measured through the use of a particle size distribution analyzer (LA-920, manufactured by HORIBA Ltd.) using laser light scattering method, and the wax dispersion particles had a volume average is particle diameter (Dv) of 0.162 μm. In the wax dispersion particles, the existing ratio of coarse particles having a volume average particle diameter (Dv) of 0.8 μm or more was 5% or less.

PRODUCTION EXAMPLE 5

—Preparation of Water Dispersion of Wax (Wax Dispersion) (5)—

The water dispersion of the wax (wax dispersion) (1) produced in Production Example 1 was heated at 95° C., emulsified using Gaulin Homogenizer at a discharge pressure of $560\times10^5 N/m^2$ and then quenched to thereby prepare a water dispersion of a wax (wax dispersion) (5).

The volume average particle diameter (Dv) of the wax dispersion particles included in the obtained wax dispersion (5) was measured through the use of a particle size distribution analyzer (LA-920, manufactured by HORIBA Ltd.) using laser light scattering method, and the wax dispersion particles had a volume average particle diameter (Dv) of 0.676 μm. In the wax dispersion particles, the existing ratio of coarse particles having a volume average particle diameter (Dv) of 1.0 μm or more was 29%.

EXAMPLES

Hereinafter, the present invention will be described in detail referring to specific examples, however, the present invention is not limited to the disclosed examples.

Example 1

<Preparation of Oil Droplet-In-Water-Dispersion>

An oil droplet-in-water-dispersion with dispersion particles dispersed therein was prepared as follows:

—Preparation of Dissolved and Dispersed Solution of Toner Materials—

—Preparation of Unmodified (Lower Molecular Mass) Polyester—

Into a reaction vessel equipped with a condenser, a stirrer, and a nitrogen inlet tube, 682 parts by mass of ethylene oxide bisphenol A dimolar adduct, 81 parts by mass of propylene oxide bisphenol A dimolar adduct, 283 parts by mass of terephthalic acid, 22 parts by mass of anhydrous trimellitic acid, and 2 parts by mass of dibutyltin oxide were poured, and the reaction was performed under normal pressure at 230° C. for 5 hours to synthesize an unmodified polyester.

The obtained unmodified polyester had a number-average molecular mass (Mn) of 2,100, a mass-average molecular mass (Mw) of 9,500, a glass transition temperature (Tg) of 55° C., an acid value of 0.5 mg KOH/g, and a hydroxyl value of 51.

—Preparation of Masterbatch—

To 1,200 parts by mass of water, 540 parts by mass of carbon black (Printex 35, manufactured by Degussa; DBP absorption amount: 42 ml/100 g; pH 9.5) as a colorant, and 1,200 parts by mass of the unmodified polyester were poured and mixed by means of HENSCHEL MIXER (manufactured by Mitsui Mining Co.). The mixture was kneaded at 150° C. for 30 minutes by a two-roller mill, cold-rolled, and crushed by a pulverizer (manufactured by Hosokawa micron Corp.), to thereby prepare a masterbatch.

—Preparation of Organic Solvent Phase—

Into a reaction vessel equipped with a stirrer and a thermometer, 378 parts by mass of the unmodified polyester, 110 parts by mass of carnauba wax, 22 parts by mass of CCA (salicylic acid metal complex E-84, manufactured by Orient Chemical Industries, Ltd.), and 947 parts by mass of ethyl acetate were poured. The mixture was heated to 80° C. with stirring, and the temperature of the mixture was maintained for 5 hours and was then cooled to 30° C. in 1 hour. Next, 500 parts by mass of the masterbatch and 500 parts by mass of ethyl acetate were poured to the reaction vessel and mixed for 1 hour to thereby prepare an initial material solution.

Thereafter, 1,324 parts by mass of the initial material solution was poured into a vessel, and the carbon black and the carnauba wax therein were dispersed using a bead mill (Ultravisco-Mill, by manufactured by Aimex Co.) at a liquid feed rate of 1 kg/hr, a disc circumferential speed of 6 m/s, using zirconia beads 0.5 mm in diameter filled 80% by volume. The dispersing procedure was is repeated three times. Next, 1,324 parts by mass of a 65% by mass ethyl acetate solution of the unmodified polyester were added to the dispersion. The mixture was dispersed under the above-noted conditions except that the dispersion procedure was repeated once to yield an organic solvent phase (pigment-wax dispersion).

The obtained organic solvent phase had a solid content of 50% by mass as determined by heating to 130° C. for 30 minutes.

—Synthesis of Prepolymer—

Into a reaction vessel equipped with a condenser, a stirrer, and a nitrogen inlet tube, 410 parts by mass of the unmodified polyester, 89 parts by mass of isophorone diisocyanate, 500 parts by mass of ethyl acetate were poured, and the reaction was performed at 100° C. for 5 hours to synthesize a prepolymer (polymer capable of reacting with the active hydrogen group-containing compound).

The obtained prepolymer had a free isocyanate content of 1.53% by mass.

—Synthesis of Ketimine (the Active Hydrogen Group-containing Compound)—

Into a reaction vessel equipped with a stirrer and a thermometer, 170 parts by mass of isophorone diisocyanate, and 75 parts by mass of methyl ethyl ketone were poured, and the reaction was performed at 50° C. for 5 hours to thereby synthesize a ketimine compound (the active hydrogen group-containing compound).

The obtained ketimine compound (the active hydrogen group-containing compound) had an amine value of 418.

Into a reaction vessel, 749 parts by mass of the organic solvent phase, 115 parts by mass of the prepolymer, and 2.9 parts by mass of the ketimine compound, and 3.5 parts by mass of a tertiary amine compound (U-CAT 660M, manufactured by SAN-APRO Ltd.) were poured. The mixture was mixed at 7.5 m/s for 1 minute using a TK HomoMixer (manufactured by Tokushu Kika Kogyo Co.) to thereby prepare a dissolved and dispersed solution of the toner materials.

—Preparation of Aqueous Medium—

To 990 parts by mass of water, 37 parts by mass of a 48.5% by mass sodium dodecyldiphenylether disulfonate aqueous solution (Eleminol MON-7, manufactured by Sanyo Chemical Industries Co.), and 90 parts by mass of ethyl acetate were added, and the mixture was mixed and stirred to thereby yield a milky white liquid (aqueous medium phase).

—Emulsification and Dispersion—

To the dissolved and dispersed solution of the toner materials, 1,200 parts by mass of the aqueous medium phase were added and mixed at a circumferential speed of 15 m/s for 20 minutes using a TK HomoMixer (manufactured by Tokushu Kika Kogyo Co.) to thereby prepare an oil droplet-in-water dispersion.

The volume average particle diameter (Mv) of the dispersion particles in the obtained oil droplet-in-water dispersion (emulsion slurry) was measured by means of a particle size distribution analyzer (nanotrac UPA-150EX, manufactured by NIKKISO Co., Ltd.), and the oil droplet-in-water dispersion had a volume average particle diameter (Mv) of 0.392 μm.

<Granulation of Toner >

—Controlling Particle Diameter of Dispersion Particles—

—Preparation of Organic Resin Fine Particle Dispersion—

In a reaction vessel equipped with a stirrer and a thermometer, 683 parts by mass of water, 20 parts by mass of sodium salt of sulfuric acid ester of ethylene oxide adduct of methacrylic acid (Eleminol RS-30 manufactured by Sanyo Chemical Industries Co.), 78 parts by mass of styrene, 78 parts by mass of methacrylic acid, 120 parts by mass of butyl acrylate, and 1 part by mass of ammonium persulfate were poured, and the mixture was then stirred at 400 rpm for 15 minutes to thereby yield a white emulsion. The emulsion was heated to 75° C. to be reacted therein for 5 hours. Next, to the reaction mixture, 30 parts by mass of a 1% by mass aqueous solution of ammonium persulfate was added and aged at 75° C. for 5 hours to thereby yield an aqueous dispersion (organic resin fine particle dispersion) of vinyl resin particles (a copolymer of styrene-methacrylic acid-butyl acrylate-sodium salt of sulfate of methacrylic acid-ethylene oxide adduct).

The volume average particle diameter (Mv) of the organic resin fine particles included in the obtained organic resin fine particle dispersion was measured using a particle size distribution analyzer (nanotrac UPA-150EX, manufactured by NIKKISO Co., Ltd.) and analyzed using analyzer software (MicroTrack Particle Size Analyzer Ver. 10.1.2-016EE, manufactured by NIKKISO Co., Ltd.).

First, to a 30 mL glass sample-bottle, the organic fine resin fine particle dispersion and water as the solvent used for the organic resin fine particle dispersion were added to prepare a 10% by mass dispersion. The obtained dispersion was subjected to a dispersion treatment for 2 minutes using an ultrasonic dispersion apparatus (W-113MK-II, manufactured by HONDA ELECTRONICS Co., Ltd.).

After measuring the background of the organic resin fine particle dispersion with water as the solvent, the dispersion that had been subjected to the dispersion treatment was fallen in drops to the sample-bottle, and the particle diameter of the dispersion was measured under a condition that the value of the sample loading measured by the particle size distribution analyzer was ranging from 1 to 10. To obtain the value of the sample loading, the dropped amount of the dispersion was appropriately controlled.

The measurement and the analysis were carried out after the measurement and the analyzing conditions were respectively set as follows: Particle distribution display: Volume; particle diameter category: Standard; particle permeability: Permeation; particle shape: Non-spherical shape; number of channels: 44; measurement time: 60 seconds; the number of measurement time: Once; particle refractive index: 1.5; and degree of density: 1 g/cm$^3$. For the refractive index value of the solvent, among the values described in "Guideline of Input Conditions in Measurement' (see FIGS. 4A to 4C), the refractive index of water 1.33 for the solvent of the organic resin fine particle dispersion was used.

As a result, the organic resin fine particles had a volume average particle diameter (Mv) of 55 nanometers.

Further, a part of the organic resin fine particle dispersion was dried to isolate the resin part. The resin part was measured with respect to the glass transition temperature and the mass average molecular mass, and the measurement result showed that the resin part dispersion had a glass transition temperature (Tg) of 48° C. and a mass average molecular mass (Mw) of 450,000.

Next, the oil droplet-in-water dispersion (emulsion slurry) was stirred using Paddle Stirrer at a circumferential speed of 0.7 m/s, 15 parts by mass of the organic resin fine particle dispersion was added to the emulsion slurry, and 80 parts by mass of a 10% by mass of sodium chloride solution were poured to control the particle diameter of the dispersion particles in the emulsion slurry.

—Removal of Organic Solvent—

Into a reaction vessel equipped with a stirrer and a thermometer, the emulsion slurry that the particle diameter had been controlled was poured, and the solvent therein was removed at 30° C. for 8 hours. Thereafter, the emulsion slurry was aged at 45° C. for 4 hours to thereby yield a dispersion slurry.

The volume average particle diameter and the number average particle diameter of the obtained dispersion slurry were measured using MultiSizer III (manufactured by Beckmann Coulter Inc.) in the same manner as the method for measuring a particle diameter of toner, which will be described hereinafter. The dispersion slurry had a volume average particle diameter of 4.3 μm and a number average particle diameter of 3.8 μm.

—Washing and Drying—

After filtering 100 parts by mass of the dispersion slurry under reduced pressure, 100 parts by mass of ion exchange water were added to the filter cake, mixed in a TK homomixer at a rotation speed of 10.0 m/s for 10 minutes and filtered under reduced pressure. To the obtained filter cake, 100 parts by mass of a 10% by mass sodium hydroxide solution were added, mixed in a TK homomixer at a rotation speed of at a rotation speed of 10.0 m/s for 10 minutes and then filtered. To the obtained filter cake, 300 parts by mass of ion exchange water were added, mixed in a TK homomixer at a rotation speed of 10.0 m/s for 10 minutes, and then filtered, and the procedure was repeated twice to thereby obtain a final filter cake.

The final filter cake was dried in a circulating air dryer at 45° C. for 48 hours, and then sieved through a sieve of 75 μm mesh to thereby obtain toner-base particles for Example 1.

—Addition of External Additives—

To 100 parts by mass of the obtained toner-base particles prepared in Example 1, 1.5 parts by mass of hydrophobized silica and 0.5 parts by mass of hydrophobized titanium oxide (manufactured by MITSUI MINING Ltd.) were added. The mixtures was mixed by means of HENSCHEL MIXER and sieved through a sieve of 35 μm mesh to produce a toner for Example 1.

With respect to the obtained toner, the volume average particle diameter (Dv), the number average particle diameter (Dn), and the particle size distribution (volume average particle diameter (Dv)/number average particle diameter (Dn) were measured based on the following method. Table 1 shows the measurement results.

(Particle Diameter of Toner)

The volume average particle diameter (Dv), and the number average particle diameter (Dn) of the toner were measured using a particle size analyzer (MultiSizer III, manufactured by Beckmann Coulter Inc.) with an aperture diameter of 100 μm and analyzed by means of analyzer software (Beckman Coulter Multisizer III Version 3.51). Specifically, to a 100 mL of glass beaker, 0.5 mL of a 10% by mass surfactant (alkylbenzene sulfonate NeoGen SC-A, manufactured by DAI-ICHI KOGYO SEIYAKU CO., LTD.) was added, 5 g of the toner was added, and stirred using Microspartel. Next, 80 mL of ion exchange water was added to the dispersion. The obtained dispersion was subjected to a dispersion treatment for 10 minutes using an ultrasonic dispersion apparatus (W-113MK-II, manufactured by HONDA ELECTRONICS Co., Ltd.). Then, the obtained dispersion was measured by the Multisizer III, using Isoton III (manufactured by Beckmann Coulter Inc.) as a solution for measurement. The dispersion was fallen in drops such that the concentration of the dispersion indicated by the Multisizer III was 8% by mass±2% by mass. In the measurement method through the use of the Multisizer III, it is important to drop the dispersion in drops so as to have a concentration of 8% by mass±2% by mass. Within the range of the concentration, it is recognized that there is no error of measurement in particle diameter.

In addition, from the measurement results, the particle size distribution (volume average particle diameter (Dv)/number average particle diameter (Dn)) was calculated.

Consequently, the toner had a volume average particle diameter (Dv) of 4.3 μm, a number average particle diameter (Dn) of 3.8 μm, and a particle size distribution (Dv/Dn) of 1.13.

Example 2

A toner for Example 2 was produced in the same manner as in Example 1 except that the stirring rate during the emulsification and the dispersion in the preparation of oil droplet-in-water dispersion was changed from 15 m/s to 8 m/s, and the stirring rate at the time of controlling the particle diameter of the dispersion particles in the granulation of toner was changed from 0.7 m/s to 2 m/s. Various physical properties of the toner were measured in the same manner as in Example 1. Table 1 shows the measurement results.

The volume average particle diameter (Mv) of the dispersion particles in the oil droplet-in-water dispersion (emulsion slurry) obtained in the preparation of oil droplet-in-water dispersion was measured using a particle size distribution analyzer (nanotrac UPA-150EX, manufactured by NIKKISO Co., Ltd.) and analyzed using analyzer software (MicroTrack Particle Size Analyzer Ver. 10.1.2-016EE, manufactured by NIKKISO Co., Ltd.).

First, to a 30 mL glass sample-bottle, the dissolved and dispersed solution of the toner materials, and ethyl acetate as the solvent used for the dissolved and dispersed solution of the toner materials, were added to prepare a 10% by mass dispersion. The obtained dispersion was subjected to a dispersion treatment for 2 minutes using an ultrasonic dispersion apparatus (W-113MK-II, manufactured by HONDA ELECTRONICS Co., Ltd.).

After measuring the background of the sample with ethyl acetate as the solvent, the dispersion that had been subjected to the dispersion treatment was fallen in drops to the sample-bottle, and the particle diameter of the dispersion was measured under a condition that the value of the sample loading measured by the particle size distribution analyzer was ranging from 1 to 10. It is required that the particle diameter of the dispersion be measured under a condition that the value of the sample loading is 1 to 10 from the perspective of measurement reproductivity of the particle diameter of the dispersion. To obtain the value of the sample loading, it is preferred that the dropped amount of the dispersion be appropriately controlled.

In the measurement and the analysis, the measurement and the analyzing conditions were respectively set as follows: Particle distribution display: Volume; particle diameter category: Standard; particle permeability: Permeation; particle shape: Non-spherical shape; number of channels: 44; measurement time: 60 seconds; the number of measurement time: Once; particle refractive index: 1.5; and degree of density: 1 g/cm$^3$. For the refractive index value of the solvent, among the values described in "Guideline of Input Conditions in Measurement' (see FIGS. 4A to 4C), the refractive index of ethyl acetate 1.37 for the solvent of the organic resin fine particle dispersion was used.

As a result, the disperion particles in the oil droplet-in-water dispersion had a volume average particle diameter (Mv) of 0.825 μm.

Example 3

A toner for Example 3 was produced in the same manner as in Example 1 except that the stirring rate during the emulsification and the dispersion in the oil droplet-in-water dispersion was changed from 15 m/s to 24 m/s, and the stirring rate at the timer of controlling the particle diameter of the dispersion particles in the granulation of toner was changed from 0.7 m/s to 0.4 m/s. Various physical properties of the toner were measured in the same manner as in Example 1. Table 1 shows the measurement results.

The volume average particle diameter (Mv) of the dispersion particles in the oil droplet-in-water dispersion (emulsion slurry) obtained in the preparation of the oil droplet-in-water dispersion was measured using a particle size distribution analyzer (nanotrac UPA-150EX, manufactured by NIKKISO Co., Ltd.), and the toner had a volume average particle diameter (Mv) of 0.232 μm.

Example 4

A toner for Example 4 was produced in the same manner as in Example 1 except that the toner was granulated after the preparation of the oil droplet-in-water dispersion and before the intermediate removal of organic solvent. Various physical properties of the toner were measured in the same manner as in Example 1.

<Intermediate Removal of Organic Solvent>

The oil droplet-in-water dispersion (emulsion slurry) containing dispersion particles having a volume average particle diameter of 0.392 μm, which was obtained in the preparation of the oil droplet-in-water dispersion of Example 1 was heated to 30° C. under reduced pressure with stirring using Paddle Stirrer at a circumferential speed of 0.7 m/s to remove the solvent for approx. 5 hours. With respect to the solvent-removed dispersion particles, the concentration of ethyl acetate was measured by means of gas chromatography, and the dispersion particles had an ethyl acetate concentration of 3.7% by mass.

<Granulation of Toner>

—Controlling of Particle Diameter of Dispersion Particles—

The solvent-removed emulsion slurry was held under normal pressure again, 15 parts by mass of the organic resin fine particle dispersion was added to the emulsion slurry, and 80 parts by mass of a 10% by mass sodium chloride solution was further added thereto, and the emulsion slurry was stirred for 30 minutes at a circumferential speed of 0.7 m/s to control the particle diameter of the dispersion particles in the emulsion slurry.

—Removal of Organic Solvent—

Into a reaction vessel equipped with a stirrer and a thermometer, the emulsion slurry that had been subjected to the controlling of the particle diameter was poured, 10 parts by mass of a 20% by mass sodium benzene sulfonate solution were added. The mixture was heated at 30° C. to remove the solvent for 5 hours, and then aged at 45° for 4 hours to thereby yield a dispersion slurry.

The dispersion slurry was washed and dried in the same manner as in Example 1 to yield toner base particles, and external additives were added to the toner base particles to thereby produce a toner for Example 4. Shape Factors of the obtained toner were measured by the following method.

(Shape Factors)

A toner picture was taken using a field emission type scanning electron microscope (S-4500, manufactured by Hitachi Ltd.) with an accelerating voltage of 8 kV and a lens magnification at 2,000×, and then the picture was scanned into an image analyzer (LUSEX3: manufactured by NIRECO Corp.) to analyze the picture and calculate the shape factors. The toner had a shape factor SF-1 of 138, and a shape factor SF-2 of 141.

Example 5

A toner for Example 5 was produced in the same manner as in Example 4 except that the timer of removal of the solvent under reduced pressure in the intermediate removal of the solvent was changed to 30 minutes. Various physical properties of the toner were measured in the same manner as in Example 1. Table 1 shows the measurement results.

With respect to the dispersion particles that had been subjected to the intermediate removal of the solvent, the concentration of ethyl acetate was measured by means of gas chromatography, and the dispersion particles had an ethyl acetate concentration of 42% by mass. Shape factors of the obtained toner were measured in the same manner as in Example 4, and the toner had a shape factor SF-1 of 110, and a shape factor SF-2 of 118.

Example 6

A toner for Example 6 was produced in the same manner as in Example 1 except that the organic solvent phase was prepared using the crystalline polyester synthesized by the following method. Various physical properties of the toner were measured in the same manner as in Example 1. Table 1 shows the measurement results.

—Synthesis of Crystalline Polyester—

Into a 5 liter four necked flask equipped with a nitrogen inlet tube, a dewatering tube, a stirrer and a thermocouple, 2,070 g of 1,4-butane diol, 2,535 g of fumaric acid, 291 g of trimellitic anhydride, and 4.9 g of hydroquinone were poured, and the reaction was performed at 160° C. for 5 hours, and the mixture was heated to 200° C. and reacted for 1 hour, and the mixture was further reacted at 8.3 kPa for 1 hour, to thereby synthesize a crystalline polyester.

The obtained crystalline polyester had a DSC endothermic peak temperature of 123° C., a number average molecular mass (Mn) of 710, and a mass average molecular mass (Mw) of 2,100.

—Preparation of Crystalline Polyester Dispersion—

Into a 2 L metal vessel, 100 g of the crystalline polyester and 400 g of ethyl acetate were poured, and the mixture was dissolved by heating at 79° C. and then cooled in iced water at a cooling rate of 27° C./minute. The resultant mixture was added with 500 ml of glass beads having a diameter of 3 mm and crushed by means of Batch-type Sand Mill (manufactured by Kanpe Hapio Co., Ltd.) for 10 hours to thereby prepare a crystalline polyester dispersion having a volume average particle diameter (Dv) of 0.4 μm.

—Preparation of Organic Solvent Phase—

Into a reaction vessel equipped with a stirrer, and a thermometer, 378 parts by mass of the unmodified polyester, 110 parts by mass of carnauba wax, 22 parts by mass of CCA (salicylic acid metal complex E-84, manufactured by Orient Chemical Industries, Ltd.), and 947 parts by mass of ethyl acetate were poured. The mixture was heated to 80° C. with stirring, and the temperature of the mixture was maintained at 80° C. for 5 hours and was then cooled to 30° C. in 1 hour. Next, 500 parts by mass of the masterbatch were poured to the reaction vessel and mixed for 1 hour to thereby prepare an initial material solution.

Thereafter, 1,324 parts by mass of the initial material solution was poured into a reaction vessel, and the carbon black and the carnauba wax therein were dispersed using a bead mill (Ultravisco-Mill, by manufactured by Aimex Co.) at a liquid feed rate of 1 kg/hr, a disc circumferential speed of 6 m/s, using zirconia beads 0.5 mm in diameter filled 80% by volume. The dispersing procedure was repeated three times. Next, 1,213 parts by mass of a 65% by mass ethyl acetate solution of the unmodified polyester were added to the dispersion, and 350 parts by mass of the crystalline polyester solution was further added thereto. The mixture was dispersed under the above-noted conditions except that the dispersion procedure was repeated once to yield an organic solvent phase (pigment-wax dispersion).

A dissolved and dispersed solution of the toner materials was prepared using the obtained organic solvent phase, and the subsequent procedures were performed in the same manner as in Example 1 to thereby yield a toner.

Example 7

A toner for Example 7 was produced in the same manner as in Example 1 except that 2.9 parts by mass of the ketimine compound used in the preparation of the oil droplet-in-water dispersion was changed to 3.5 parts by mass of N-oleyl 1,3-propanediamine having a distribution coefficient of 0.02, which was determined by the following method. Various physical properties of the toner were measured in the same manner as in Example 1. Table 1 shows the results.

(Distribution Coefficient)

To 50 g of a 50% by mass of the unmodified polyester resin ethyl acetate solution, 0.125 g of N-oleyl 1,3-propanediamine was sufficiently dissolved to prepare a mixture solution. Next, the mixture solution was added to 50 g of deionized water. Within a 200 mL of glass beaker, the mixture solution was stirred using a magnetic stirrer and a stirrer chip having a diameter of 20 mm at a rotation speed of 200 rpm to be formed in a pseudo emulsified condition. Then, the resultant mixture solution was left at 25° C. for 1 hour to be separated to an ethyl acetate solution (organic solvent phase) and deionized water (aqueous medium phase). Further, deionized water was isolated, and titrated with a hydrochloric acid aqueous solution to thereby quantitate the amount of N-oleyl 1,3-propandiamine in the deionized water. Then, the mass ratio of the N-oleyl 1,3-propane diamine dissolved and transferred into the deionized water relative to the entire amount of the added N-oleyl 1,3-propanediamine was determined as the distribution coefficient.

Example 8

A toner for Example 8 was produced in the same manner as in Example 1 except that 2.9 parts by mass of the ketimine compound used in the preparation of the oil droplet-in-water dispersion was changed to 0.7 parts by mass of ethylene diamine (1, 2 ethanediamine) having a distribution coefficient determined by the above method of 11.9. Various physical properties of the toner were measured in the same manner as in Example 1. Table 1 shows the results.

Comparative Example 1

A toner was produced in the same manner as in Example 1 except that the organic resin fine particles were not added in the controlling the particle diameter of the dispersion particles in the granulation of the toner, and 15 parts by mass of the organic resin fine particles were added in the preparation of the aqueous medium in the preparation of the oil droplet-in-water dispersion. Various physical properties of the toner were measured in the same manner as in Example 1. Table 1 shows the measurement results.

The volume average particle diameter (Mv) of the dispersion particles in the oil droplet-in-water dispersion (emulsion slurry) obtained in the preparation of the oil droplet-in-water dispersion was measured by means of a particle size distribution analyzer (nanotrac UPA-150EX, manufactured by NIKKISO Co., Ltd.), and the oil droplet-in-water dispersion had a volume average particle diameter (Mv) of 3.1 μm.

Comparative Example 2

A toner was produced in the same manner as in Example 1 except that the organic resin fine particles were not added to the controlling the particle diameter of the dispersion particles in the granulation of the toner.

However, a separation in the oil droplet-in-water dispersion (emulsion slurry) arose, and it was impossible to obtain a toner for Comparative Example 2.

TABLE 1

| | Before granulation | Toner | | | |
|---|---|---|---|---|---|
| | of toner Dispersion particle diameter Mv (μm) | Volume average particle diameter Dv (μm) | Number average particle diameter Dn (μm) | Particle size distribution Dv/Dn | Dv/Mv |
| Ex. 1 | 0.392 | 4.3 | 3.8 | 1.13 | 11.0 |
| Ex. 2 | 0.825 | 5.1 | 4.4 | 1.15 | 6.18 |
| Ex. 3 | 0.232 | 5.5 | 5.0 | 1.09 | 23.7 |
| Ex. 4 | 0.392 | 5.4 | 4.9 | 1.11 | 13.8 |
| Ex. 5 | 0.392 | 5.3 | 4.8 | 1.10 | 13.5 |
| Ex. 6 | 0.513 | 5.8 | 5.4 | 1.08 | 11.3 |
| Ex. 7 | 0.621 | 5.5 | 4.9 | 1.12 | 8.9 |
| Ex. 8 | 0.452 | 5.6 | 5.1 | 1.10 | 12.4 |
| Compara. Ex. 1 | 3.1 | 5.5 | 4.8 | 1.15 | 1.77 |
| Compara. Ex. 2 | | Impossible to measure | | | |

Example 9

A toner for Example 9 was produced in the same manner as in Example 1 except that a wax was not added in the preparation of the organic solvent phase, and the water dispersion of the wax was added along with the organic resin fine particles in the granulation of toner in accordance with the following method.

<Preparation of Oil Droplet-In-Water Dispersion>

An oil droplet-in-water dispersion with dispersion particles dispersed therein was prepared as follows:

—Preparation of Dissolved and Dispersed Solution of Toner Materials—

—Synthesis of Unmodified (Low Molecular Mass) Polyester—

Into a reaction vessel equipped with a condenser, a stirrer, and a nitrogen inlet tube, 229 parts by mass of ethylene oxide bisphenol A dimolar adduct, 529 parts by mass of propylene oxide bisphenol A trimolar adduct, 208 parts by mass of terephthalic acid, 46 parts by mass of adipic acid, and 2 parts by mass of dibutyltin oxide were poured, and the reaction was performed under normal pressure at 230° C. for 8 hours. The reactant solution was further reacted under reduced pressure of 10 mmHg to 15 mmHg for 5 hours. Then, into the reaction vessel, 44 parts by mass of anhydrous trimellitic acid were added, and the reaction was performed at 180° C. under reduced pressure for 2 hours to synthesize an unmodified polyester.

The obtained unmodified polyester had a number-average molecular mass (Mn) of 2,500, a mass-average molecular mass (Mw) of 6,700, a glass transition temperature (Tg) of 43° C., and an acid value of 25 mg KOH/g.

—Preparation of Masterbatch—

To 1,200 parts by mass of water, 540 parts by mass of carbon black (Printex 35, manufactured by Degussa; DBP absorption amount: 42 ml/100 g; pH 9.5) as a colorant, and 1,200 parts by mass of the unmodified polyester were added and mixed by means of HENSCHEL MIXER (manufactured by Mitsui Mining Co.). The mixture was kneaded at 150° C. for 30 minutes by a two-roller mill, cold-rolled, and crushed by a pulverizer (manufactured by Hosokawa micron Corp.), to thereby prepare a masterbatch.

—Preparation of Organic Solvent Phase—

Into a reaction vessel equipped with a stirrer and a thermometer, 500 parts by mass of the masterbatch, and 500 parts by mass of ethyl acetate were poured. The mixture was mixed for 1 hour to yield an initial material solution.

Thereafter, 1,324 parts by mass of the initial material solution was poured into a reaction vessel, and the carbon black and the carnauba wax therein were dispersed using a bead mill (Ultravisco-Mill, by manufactured by Aimex Co.) at a liquid feed rate of 1 kg/hr, a disc circumferential speed of 6 m/s, using zirconia beads 0.5 mm in diameter filled 80% by volume. The dispersing procedure was repeated three times. Next, 1,324 parts by mass of a 65% by mass ethyl acetate solution of the unmodified polyester were added to the dispersion. The mixture was dispersed under the above-noted conditions except that the dispersion procedure was repeated once to yield an organic solvent phase.

The obtained organic solvent phase had a solid content of 50% by mass as determined by heating to 130° C. for 30 minutes.

—Synthesis of Prepolymer—

Into a reaction vessel equipped with a condenser, a stirrer, and a nitrogen inlet tube, 410 parts by mass of the unmodified polyester, 89 parts by mass of isophorone diisocyanate, 500 parts by mass of ethyl acetate were poured, and the reaction was performed at 100° C. for 5 hours to synthesize a prepolymer (polymer capable of reacting with the active hydrogen group-containing compound).

The obtained prepolymer had a free isocyanate content of 1.53% by mass.

—Synthesis of Ketimine (the Active Hydrogen Group-containing Compound)—

Into a reaction vessel equipped with a stirrer and a thermometer, 170 parts by mass of isophorone diisocyanate, and 75 parts by mass of methyl ethyl ketone were poured, and the reaction was performed at 50° C. for 5 hours to thereby synthesize a ketimine compound (the active hydrogen group-containing compound).

The obtained ketimine compound (the active hydrogen group-containing compound) had an amine value of 418.

Into a reaction vessel, 749 parts by mass of the organic solvent phase, 115 parts by mass of the prepolymer, and 2.9 parts by mass of the ketimine compound were poured. The mixture was mixed at 7.5 m/s for 1 minute using a TK Homo-Mixer (manufactured by Tokushu Kika Kogyo Co.) to thereby prepare a dissolved and dispersed solution of the toner materials.

—Preparation of Aqueous Medium Phase—

To 990 parts by mass of water, 37 parts by mass of a 48.5% by mass sodium dodecyldiphenylether disulfonate aqueous solution (Eleminol MON-7, manufactured by Sanyo Chemical Industries Co.), and 90 parts by mass of ethyl acetate were added, and the mixture was mixed and stirred to thereby yield a milky white liquid (aqueous medium phase).

—Emulsification and Dispersion—

To the dissolved and dispersed solution of the toner materials, 1,200 parts by mass of the aqueous medium phase were added and mixed at a circumferential speed of 15 m/s for 20 minutes using a TK HomoMixer (manufactured by Tokushu Kika Kogyo Co.) to thereby prepare an oil droplet-in-water dispersion (emulsion slurry).

The particle diameter (Mv) of the dispersion particles in the obtained oil droplet-in-water dispersion (emulsion slurry) was measured by means of a particle size distribution analyzer (nanotrac UPA-150EX, manufactured by NIKKISO Co., Ltd.), and the oil droplet-in-water dispersion had a particle diameter (Mv) of 0.392 μm.

<Granulation of Toner>

—Preparation of Organic Resin Fine Particle Dispersion—

In a reaction vessel equipped with a stirrer and a thermometer, 683 parts by mass of water, 20 parts by mass of sodium salt of sulfuric acid ester of ethylene oxide adduct of methacrylic acid (Eleminol RS-30 manufactured by Sanyo Chemical Industries Co.), 78 parts by mass of styrene, 78 parts by mass of methacrylic acid, 120 parts by mass of butyl acrylate, and 1 part by mass of ammonium persulfate were poured, and the mixture was then stirred at 400 rpm for 15 minutes to thereby yield a white emulsion. The emulsion was heated to 75° C. to be reacted therein for 5 hours. Next, to the reaction mixture, 30 parts by mass of a 1% by mass aqueous solution of ammonium persulfate was added and aged at 75° C. for 5 hours to thereby yield an aqueous dispersion (organic resin fine particle dispersion) of vinyl resin particles (a copolymer of styrene-methacrylic acid-butyl acrylate-sodium salt of sulfate of methacrylic acid-ethylene oxide adduct).

The volume average particle diameter (Dv) of the organic resin fine particles included in the obtained organic resin fine particle dispersion was measured by means of a particle size distribution analyzer (nanotrac UPA-150EX, manufactured by NIKKISO Co., Ltd.), and the organic resin fine particle dispersion had a volume average particle diameter (Dv) of 55 nanometers. Further, a part of the organic resin fine particle dispersion was dried to isolate the resin part. The resin part was measured as to the glass transition temperature and the mass average molecular mass, and the measurement result showed that the resin part dispersion had a glass transition temperature (Tg) of 48° C. and a mass average molecular mass (Mw) of 450,000.

—Controlling Particle Diameter of Dispersion Particles—

The oil droplet-in-water dispersion (emulsion slurry) was stirred using Paddle Stirrer at a circumferential speed of 0.7 m/s, 15 parts by mass of the water dispersion of the wax (1) prepared in Production Example 1 was added to the emulsion slurry, 15 parts by mass of the organic resin fine particles were added, and 80 parts by mass of a 10% by mass of sodium chloride solution were further poured to control the particle diameter of the dispersion particles in the emulsion slurry.

—Removal of Organic Solvent—

Into a reaction vessel equipped with a stirrer and a thermometer, the emulsion slurry that the particle diameter had been controlled was poured, and the solvent therein was removed at 30° C. for 8 hours. Thereafter, the emulsion slurry was aged at 45° C. for 4 hours to thereby yield a dispersion slurry.

The volume average particle diameter and the number average particle diameter of the obtained dispersion slurry were measured using MultiSizer III (manufactured by Beckmann Coulter Inc.). The dispersion slurry had a volume average particle diameter of 4.3 μm and a number average particle diameter of 3.8 μm.

Thereafter, the dispersion slurry was subjected to a washing treatment and a drying treatment to thereby yield toner base particles. Further, external additives were added to the toner base particles to thereby yield a toner for Example 9.

Example 10

A toner for Example 10 was produced in the same manner as in Example 9 except that the water dispersion of the wax (1) obtained in Production Example 1 was changed to the water dispersion of the wax (2) obtained in Production Example 2. Various physical properties of the toner were measured in the same manner as in Example 1. Table 1 shows the measurement results.

The volume average particle diameter (Mv) of the dispersion particles in the obtained oil droplet-in-water dispersion (emulsion slurry) was measured by means of a particle size distribution analyzer (nanotrac UPA-150EX, manufactured by NIKKISO Co., Ltd.), and the oil droplet-in-water dispersion had a volume average particle diameter (Mv) of 0.392 μm.

Next, the oil droplet-in-water dispersion (emulsion slurry) was stirred using Paddle Stirrer at a circumferential speed of 0.7 m/s, 15 parts by mass of the water dispersion of the wax (2) obtained in Production Example 2 and 15 parts by mass of the organic resin fine particles were added to the emulsion slurry, and 80 parts by mass of a 10% by mass of sodium chloride solution were further poured to control the particle diameter of the dispersion particles in the emulsion slurry. The particle diameter of the dispersion particles was measured using the particle size distribution analyzer (nanotrac UPA-150EX, manufactured by NIKKISO Co., Ltd.), and the dispersion slurry had a particle diameter of 5.1 μm.

Example 11

A toner for Example 11 was produced in the same manner as in Example 9 except that the water dispersion of the wax (1) obtained in Production Example 1 was changed to the water dispersion of the wax (3) obtained in Production Example 3.

Example 12

A toner for Example 12 was produced in the same manner as in Example 9 except that the water dispersion of the wax (1) was changed to the water dispersion of the wax (4) obtained in Production Example 4.

Example 13

A toner for Example 13 was produced in the same manner as in Example 9 except that the water dispersion of the wax (1) was changed to the water dispersion of the wax (5) obtained in Production Example 5.

With respect to the toners for Examples 9 to 13, the volume average particle diameter (Dv), the number average particle diameter (Dn), and the particle size distribution (Dv/Dn) were measured. Table 2 shows the measurement results.

TABLE 2

| | Wax | | | | Toner | | |
|---|---|---|---|---|---|---|---|
| | Water dispersion No. | Component | Melting point (° C.) | Dispersion particle diameter (μm) | Volume average particle diameter Dv (μm) | Number average particle diameter Dn (μm) | Particle size distribution Dv/Dn |
| Ex. 1 | — | Carnauba wax | 85 | — | 4.3 | 3.8 | 1.13 |
| Ex. 9 | (1) | Paraffin wax | 78 | 0.160 | 5.2 | 4.6 | 1.13 |
| Ex. 10 | (2) | Paraffin wax | 68 | 0.130 | 5.0 | 4.5 | 1.11 |
| Ex. 11 | (3) | Carbonyl group-containing wax | 82 | 0.182 | 4.8 | 4.2 | 1.14 |
| Ex. 12 | (4) | Carbonyl group-containing wax | 116 | 0.162 | 5.4 | 4.8 | 1.13 |
| Ex. 13 | (5) | Paraffin wax | 78 | 0.676 | 5.1 | 4.6 | 1.11 |

Next, 2.5 parts by mass of each of the toners obtained in Examples 1 to 13 and Comparative Example 1 each of which had been subjected to the addition of external additives, 97.5 parts by mass of a silicone-coated ferrite carrier (with a core material having a particle diameter of 45 μm were respectively stirred in a tabular mixer to respectively produce each developer for Examples 1 to 13 and Comparative Example 1.

Using each of the obtained developers, (a) charge stability, (b) image graininess and image sharpness, (c) fog, (d) toner scattering, (e) charging ability, (f) fixing property (low-temperature fixing property and anti-hot-offset property, (g) cleaning ability, (h) image density, (i) heat resistant storage stability, (j) anti-filming property, and (k) wax dispersibility were measured. Tables 3 and 4 show the measurement results.

(a) Charge Stability

A color electrophotographic machine (IPSiO Color 8100, manufactured by Ricoh Co., Ltd.) was modified and tuned to a system taking an oil-less fixing approach. Each of the prepared developer was individually set in the modified machine. Output durability test was performed by consecutively outputting 100,000 sheets of a chart having a 5% image area ratio, and the result of the change in the charged amount was evaluated based on the following criteria:

(Evaluation Criteria)

A: The changed amount in the charged amount was 5 μc/g or less

B: The changed amount in the charged amount was 10 μc/g or less

C: The changed amount in the charged amount was 15 μc/g or less

D: The changed amount in the charged amount was more than 15 μc/g (b) Image Graininess and Image Sharpness A color electrophotographic machine (IPSiO Color 8100, manufactured by Ricoh Co., Ltd.) was modified and tuned to a system taking an oil-less fixing approach. Using the modified machine, a photographic image was output in monochrome, and the degree of the graininess and the sharpness of the monochrome image were visually observed, and the result was evaluated based on the following criteria:

(Evaluation Criteria)

A: Equivalent to offset printing

B: Slightly poorer than offset printing

C: Considerably poorer than offset printing

D: Very poorer than offset printing and was equal to conventional electrophotographic images (c) Fog A color electrophotographic machine (IPSiO Color 8100, manufactured by Ricoh Co., Ltd.) was modified and tuned to a system taking an oil-less fixing approach. Using each of the prepared developers, output durability test was performed by consecutively outputting 100,000 sheets of a chart having a 5% image area ratio under a condition of a temperature of 10° C. and a humidity of 15%. Thereafter, the degree of toner smear in background part of the transferring sheet was visually observed through a loupe, and the result was evaluated based on the following criteria:

(Evaluation Criteria)

A: No toner smear was observed, and it was excellent

B: A slight amount of toner smear was observed, however, it was still on a level where no problem was caused C: A small amount of toner smear was observed D: Toner smear was conspicuously observed, and it exceeded the allowable range (d) Toner Scattering A color electrophotographic machine (IPSiO Color 8100, manufactured by Ricoh Co., Ltd.) was modified and tuned to a system taking an oil-less fixing approach. Using each of the prepared developers, output durability test was performed by consecutively outputting 100,000 sheets of a chart having a 5% image area ratio under a condition of a temperature of 40° C. and a humidity of 90%. Thereafter, the degree of the contaminated condition with toner within the machine was visually observed, and the result was evaluated based on the following criteria:

(Evaluation Criteria)

A: No toner smear was observed, and it was excellent

B: A slight toner smear was observed, however, it was still on a level where no problem was caused C: A little toner smear was observed D: Toner smear was conspicuously observed, and it exceeded the allowable range (e) Charge Property To a stainless roll mill vessel having a diameter of 6.0 cm and a height of 6.5 cm, a carrier for color electrophotographic machine (IPSiO Color 8100, manufactured by Ricoh Co., Ltd. in an amount of approx. 10 g was put, and each of the prepared toners was added to the vessel in Tc 5% and then stirred at a rotation speed of 153 rpm for 30 seconds.

From the individually stirred developer, 10 pieces of developer samples were randomly taken out for each of the prepared developer, and the charge amount distribution of the sample was measured using a charge amount distribution analyzer (E-Spart Analyzer II, manufactured by Hosokawa Micron Corp.). From the obtained data on the charge amount distribution, the content of the number of reversed toner particles relative to the entire number of toner particles was calculated, and the average value was obtained. Further, the standard deviation of the number of reversed toner particles calculated from each of the obtained data was determined.

(f) Fixing Property (Low-Temperature Fixing Property and Anti-Hot-Offset Property)

The fixing part of a copier (MF 2200, manufactured by Ricoh Co., Ltd.) was modified such that a Teflon™ roller was used as a fixing roller. A transferring sheet (Type 6200, manufactured by Ricoh Co., Ltd.) was set in the modified copier to perform a copying test. The lower limit fixing temperature and the hot-offset causing temperature were measured by changing the temperature of the fixing roller.

<Lower Limit Fixing Temperature>

In the copier, the linear velocity of paper feed was set to 120 mm/s to 150 mm/s, the contact pressure was set to 1.2 kgf/cm$^2$, and the nip width was set to 3 mm to measure the lower limit fixing temperature, and the result was evaluated based on the following criteria:

It should be noted that the lower limit fixing temperature of conventional low-temperature fixing toner is 140° C. to 150° C., it means that the lower the lower limit fixing temperature is, the more excellent in low-temperature fixing property the toner has.

(Evaluation Criteria)

A: The lower limit fixing temperature was less than 120° C.

B: The lower limit fixing temperature was 120° C. or more and less than 130° C.

C: The lower limit fixing temperature was 130° C. or more and less than 140° C.

D: The lower limit fixing temperature was more than 140° C.

<Offset Causing Temperature>

In the copier, the linear velocity of paper feed was set to 50 mm/s, the contact pressure was set to 2.0 kgf/cm$^2$, and the nip width was set to 4.5 mm, and the offset causing temperature (the lower limit value of the temperature at which offset is caused) was measured, and each of the developers was measured as to anti-hot-offset property based on the following criteria:

It should be noted that the following evaluation criteria mean that the higher the offset causing temperature is, the more excellent in anti-hot-offset property the toner has.

(Evaluation Criteria)

A: The offset causing temperature was 201° C. or more

B: The offset causing temperature was 191° C. to 200° C.

C: The offset causing temperature was 181° C. to 190° C.

D: The offset causing temperature was 171° C. to 180° C.

(g) Cleaning Ability

The transfer residual toner remaining on the photoconductor that had gone through a cleaning step was transferred to a sheet of white paper using a scotch tape (manufactured by Sumitomo 3M Ltd.) to measure the reflection density by a reflection densitometer (Macbeth reflection densitometer RD514). With respect to cleaning ability, the result was evaluated based on the following criteria:

(Evaluation Criteria)

A: Had a difference in reflection density from that of the blank portion of the paper being 0 to 0.01 and excellent cleaning ability B: Had a difference in reflection density from that of the blank portion of the paper being 0.02 to 0.05

C: Had a difference in reflection density from that of the blank portion of the paper being 0.06 to 0.1

D: Had a difference in reflection density from that of the blank portion of the paper being 0.2 or more and poor cleaning ability (h) Image Density A tandem color electrophotographic machine (imagio Neo 450, manufactured by Ricoh Co., Ltd.) was modified and tuned to a system taking a belt fixing approach. Using the modified machine, a solid image with an amount of each of the developer adhesion of 1.00±0.1 mg/cm$^2$ was printed on transferring sheets of regular paper (6200 manufactured by Ricoh Co., Ltd.) at a surface temperature of the fixing roller of 160° C. ±2° C. Five positions in the obtained solid image were optionally selected, and the image density of the five positions was measured. The image density value was represented by the average value of the five positions, and the result was evaluated based on the following criteria. It should be noted that the following criteria mean the higher the image density is, it is possible to form a high-density image. When the image density is 1.4 or more, it is recognized that the developer is on a practical level.

(Evaluation Criteria)

A: The image density was 1.4 or more

B: The image density was 1.2 or more

C: The image density was 1.0 or more

D: The image density was less than 1.0

(i) Heat Resistant Storage Stability

To a 50 cc glass vessel, the toner was filled and left in a constant-temperature bath with the temperature of 50° C. for 20 hours. The toner was cooled to the room temperature, and the penetration of the toner was measured according to the penetration test (JIS K2235-1991). The larger the penetration is, the more excellent in heat resistant storage stability it is and it means that blocking phenomenon hardly occurs. Using the penetration, the heat resistant storage stability of toner was evaluated based on the following criteria:

(Evaluation Criteria)

A: Had a penetration being 20 mm or more

B: Had a penetration being 15 mm or more and less than 20 mm

C: Had a penetration being 10 mm or more and less than 15 mm

D: Had a penetration being less than 10 mm (j) Anti-Filming Property

Using a color electrophotographic machine (IPSiO Color 8100, manufactured by Ricoh Co., Ltd.), 50,000 sheets were copied. The presence or absence of toner filming on the developing roller or the photoconductor immediately after the copying was visually observed, and the result was evaluated based on the following criteria:

(Evaluation Criteria)

A: No toner filming was observed

B: Streaky toner filming was hardly observed

C: Streaky toner filming was partly observed

D: Toner filming was wholly observed (k) Wax Dispersibility

With respect to wax dispersibility, the toner was observed through an electron microscope, and the result was evaluated based on the following criteria:

(Evaluation Criteria)

A: No variation in wax dispersibility was observed

B: A little variation in wax dispersibility was observed

C: A wide variation in wax dispersibility was observed

TABLE 3

| | | | | | Charge Property | |
|---|---|---|---|---|---|---|
| | Charge stability | Image graininess & sharpness | Fog | Toner scattering | Average content of reversed charge toner | Standard deviation σ |
| Ex. 1 | B | B | B | B | 1.3 | 1.04 |
| Ex. 2 | B | B | B | B | 4.5 | 3.15 |
| Ex. 3 | B | B | B | B | 2.8 | 2.28 |
| Ex. 4 | B | B | B | B | 2.5 | 1.95 |
| Ex. 5 | B | B | B | B | 3.5 | 2.08 |
| Ex. 6 | B | B | B | B | 4.3 | 3.11 |
| Ex. 7 | A | A | A | A | 1.1 | 1.02 |
| Ex. 8 | B | B | B | B | 1.9 | 1.64 |
| Compara. Ex. 1 | C | C | B | D | 15.3 | 6.1 |
| Compara. Ex. 2 | Impossible to measure | | | | | |

TABLE 4

| | Fixing Property | | | | Heat | | |
|---|---|---|---|---|---|---|---|
| | Low-temperature fixing property | Anti-hot-offset property | Cleaning ability | Image density | resistant storage stability | Anti-filming property | Wax dispersibility |
| Ex. 1 | B | B | B | B | C | C | B |
| Ex. 2 | B | B | B | B | — | — | — |
| Ex. 3 | B | B | B | B | — | — | — |
| Ex. 4 | B | B | A | B | — | — | — |
| Ex. 5 | B | B | B | B | — | — | — |
| Ex. 6 | A | B | B | B | — | — | — |
| Ex. 7 | A | A | B | A | — | — | — |
| Ex. 8 | B | B | B | B | — | — | — |
| Ex. 9 | A | A | — | B | A | A | A |
| Ex. 10 | A | B | — | B | A | A | A |
| Ex. 11 | A | A | — | B | A | A | A |
| Ex. 12 | A | A | — | B | A | B | A |
| Ex. 13 | A | A | — | B | C | C | B |
| Compara. Ex. 1 | B | B | B | B | — | — | — |
| Compara. Ex. 2 | | | Impossible to measure | | | | |

From the measurement results shown in Tables 1 to 4, the following was exemplified. It was found that in Examples 1 to 8, it was possible to obtain a toner having a small diameter and a narrow particle size distribution, a uniform composition of toner materials among toner particles, and excelling in charging ability, because an aqueous medium not containing organic resin fine particles was used to prepare an oil droplet-in-water dispersion, the organic resin fine particles were added to the oil droplet-in-water dispersion to granulate a toner in the presence of the organic resin fine particles. Further, it was also found that these toners excelled in charge stability, caused less fog and toner scattering had excellent evaluation results in image graininess, image sharpness, and image density, and enabled obtaining high-quality images. These toners also had excellent evaluation results in fixing properties (low-temperature fixing property and anti-hot-offset property), and cleaning ability.

In Example 4, a heteromorphous toner was obtained, and it was exemplified that the toner had excellence in cleaning ability. It was also found that the toner of Example 6 had excellence in low-temperature fixing property because it contained a crystalline polyester resin. In Example 7, elution of the active hydrogen group-containing compound to the aqueous medium was restrained in the emulsification and the dispersion, and the active hydrogen group-containing compound was retained within the dispersion particles, which enabled preventing reduction in toner physical properties and led to excellent results in each of the evaluation items. On the other hand, with respect to the toner obtained in Comparative Example 1, it was found that the toner had nonuniform composition of toner materials among toner particles and was poor in charging ability, which caused toner scattering, and the toner had poor evaluation results in image graininess and image sharpness and failed to obtain high-quality images.

In addition, in Examples 9 to 13, a wax was added as a water dispersion in the controlling the dispersion particles in the granulation of the toner, and thus it was possible to obtain a toner having a small diameter and a narrow particle distribution and excellent wax dispersibility. It was also exemplified that each of these toners were more excellent in releasing property at low temperatures, caused lesser toner filming, achieved both low-temperature fixing property and heat resistant storage stability, had more excellent evaluation results in image density and enabled higher-quality images, compared to the toner of Example 1 in which the water dispersion of the wax was not used.

The present invention enables solving various conventional problems and providing a toner having a uniform composition of toner materials among toner particles, excelling in charge stability, and enabling high-quality images without substantially causing fog and toner scattering, and having a small particle diameter and a narrow particle distribution. The present invention also enables providing and effective method of producing the toner, and a developer, a toner container, a process cartridge, an image forming apparatus, and an image forming method each of which enables high-quality images by using the toner.

According to the method for producing the toner of the present invention, it is possible to effectively obtain a toner having a small particle diameter and a narrow particle distribution, and a uniform composition among toner particles.

Since the toner of the present invention excels in charge stability, and causes less fog and toner scattering, it is suitably used for formation of high-quality images. The developer, the toner container, the process cartridge, the image forming apparatus, and the image forming method using the toner of the present invention are suitably used for formation of high-quality images.

What is claimed is:

1. A method for producing a toner comprising:

dissolving and dispersing toner materials in an organic solvent, thereby preparing a dissolved and dispersed solution of the toner materials, dispersing the dissolved and dispersed solution as dispersion particles in an aqueous medium containing no organic resin fine particles, thereby preparing an oil droplet-in-water dispersion, and adding organic resin fine particles in the oil droplet-in-water dispersion and granulating the toner, thereby producing the toner in the presence of the organic resin fine particles.

2. The method for producing a toner according to claim 1, further comprising adding a water dispersion of a wax to the oil droplet-in-water dispersion along with the organic resin fine particles.

3. The method for producing a toner according to claim 2, further comprising adding the water dispersion of the wax to the oil droplet-in-water dispersion after the oil droplet-in-water dispersion is prepared, and then adding the organic resin fine particles to the oil droplet-in-water dispersion.

4. The method for producing a toner according to claim 2, wherein the wax dispersion particles in the water dispersion of the wax have a volume average particle diameter of 0.1 μm to 2 μm.

5. The method for producing a toner according to claim 2, wherein the wax has a melting point of 50° C. to 90° C.

6. The method for producing a toner according to claim 2, wherein the wax is a paraffin wax.

7. The method for producing a toner according to claim 1, wherein a volume average particle diameter of the dispersion particles is increased from 3 to 45 times, compared to the volume average particle diameter before the oil droplet-in-water dispersion is prepared, before granulating the toner.

8. The method for producing a toner according to claim 1, wherein a volume average particle diameter of the dispersion particles obtained in the preparation of the oil droplet-in-water dispersion is from 0.1 μm to 3 μm, and the volume average particle diameter of the dispersion particles is increased from 3 μm to 9 μm before granulating the toner.

9. The method for producing a toner according to claim 1, wherein the dissolved and dispersed solution of the toner materials comprises a wax, and the wax is dispersed in the dissolved and dispersed solution.

10. The method for producing a toner according to claim 1, further comprising removing the organic solvent before the granulating the toner, and the organic solvent-removed dispersion particles have a content of the organic solvent of from 0.5% to 35% by mass.

11. The method for producing a toner according to claim 10, wherein the toner having a shape factor SF-1 of 120 to 160, and a shape factor SF-2 of 115 to 160 is produced.

12. The method for producing a toner according to claim 1, wherein the toner materials comprise an active hydrogen group-containing compound and a polymer capable of reacting with the active hydrogen group-containing compound, and the toner is granulated while forming an adhesive base material by reacting the active hydrogen group-containing compound with the polymer capable of reacting with the active hydrogen group-containing compound, and yielding particles comprising at least the adhesive base material.

13. The method for producing a toner according to claim 12, wherein the toner has a distribution coefficient of 0.01 or greater and less than 3, which is represented by a ratio of an eluted amount of the active hydrogen group-containing compound in the aqueous medium relative to an entire dissolved amount of the active hydrogen group-containing compound in the organic solvent.

14. The method for producing a toner according to claim 13, wherein the active hydrogen group-containing compound is an N-alkylalkanediamine.

15. The method for producing a toner according to claim 14, wherein the N-alkylalkanediamine is N-oleyl-1,3-propanediamine which is represented by the following Formula (1):

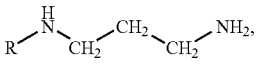

wherein 'R' represents an oleyl group.

16. The method for producing a toner according to claim 1, wherein the toner materials comprise a crystalline polyester resin.

17. The method for producing a toner according to claim 16, wherein the crystalline polyester resin has a DSC endothermic peak temperature of 50° C. to 150° C.

18. The method for producing a toner according to claim 16, wherein a molecular mass distribution of an ortho-dichlorobenzene soluble matter in the crystalline polyester resin based on the gel permeation chromatography (GPC) has a mass average molecular mass (Mw) of 1,000 to 30,000, a number average molecular mass (Mn) of 500 to 6,000, and a ratio of Mw/Mn of 2 to 8.

19. The method for producing a toner according to claim 16, wherein the crystalline polyester resin is represented by the following Formula (1):

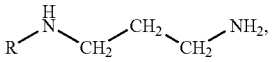

wherein 'n' and 'm', respectively, represent a repetitive unit value, 'L' represents an integer number from 1 to 3, and $R^1$ and $R^2$ may have the same value or individually have a different value and, respectively, represent a hydrogen atom or a hydrocarbon atom.

20. The method for producing a toner according to claim 16, wherein the crystalline polyester resin has an absorption of an olefin based on the out-of-plane bending vibration δCH at any one of wavelengths of 965±10 $cm^{-1}$ and 990±10 $cm^{-1}$ in the infrared absorption spectrum.

21. The method for producing a toner according to claim 1, wherein an ionizing agent is added to the oil droplet-in-water dispersion along with the organic resin fine particles.

22. The method for producing a toner according to claim 21, wherein the ionizing agent comprises at least one salt selected from the group of salts each of which comprises a monovalent cation and a monovalent anion.

23. The method for producing a toner according to claim 22, wherein the monovalent cation comprises a sodium ion and/or a potassium ion.

24. The method for producing a toner according to claim 1, wherein the dissolved and dispersed solution of the toner materials is dispersed in the aqueous medium with stirring.

25. The method for producing a toner according to claim 1, wherein when a stirring rate at the time of the dispersing the dissolved and dispersed solution of the toner materials in the aqueous medium is represented as Am/s, and the stirring rate at the time of the granulating the toner is represented as Bm/s, the following expressions are satisfied:

$$7<A<23, \text{ and } 1.4<B<100.$$

26. The method for producing a toner according to claim 1, wherein a volume average particle diameter of the dispersion particles before granulating the toner is 0.1 μm to 2 μm.

27. A toner produced by a method for producing a toner comprising:

dissolving and dispersing toner materials in an organic solvent, thereby preparing a dissolved and dispersed solution of the toner materials, dispersing the dissolved and dispersed solution as dispersion particles in an aqueous medium containing no organic resin fine particles thereby preparing an oil droplet-in-water dispersion, and adding organic resin fine particles in the oil droplet-in-water dispersion and granulating the toner, thereby producing the toner in the presence of the organic resin fine particles.

28. The toner according to claim 27, wherein an adhesive base material formed during the granulating comprises an unmodified polyester resin.

29. An image forming method comprising:

forming a latent electrostatic image on a latent electrostatic image bearing member, developing the latent electrostatic image using a toner to form a visible image, transferring the formed visible image onto a recording medium, and fixing the transferred image on the recording medium, wherein the toner is a toner produced by a method comprising:

dissolving and dispersing toner materials in an organic solvent, thereby preparing a dissolved and dispersed solution of the toner materials, dispersing the dissolved and dispersed solution as dispersion particles in an aqueous medium containing no organic resin fine particles, thereby preparing an oil droplet-in-water dispersion, and adding organic resin fine particles in the oil droplet-in-water dispersion and granulating the toner, thereby producing the toner in the presence of the organic resin fine particles.

* * * * *